US008384835B2

(12) United States Patent
Yamauchi

(10) Patent No.: US 8,384,835 B2
(45) Date of Patent: Feb. 26, 2013

(54) PIXEL CIRCUIT AND DISPLAY DEVICE

(75) Inventor: Yoshimitsu Yamauchi, Osaka-shi (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/392,893

(22) PCT Filed: May 24, 2010

(86) PCT No.: PCT/JP2010/058743
§ 371 (c)(1),
(2), (4) Date: Feb. 28, 2012

(87) PCT Pub. No.: WO2011/027599
PCT Pub. Date: Mar. 10, 2011

(65) Prior Publication Data

US 2012/0154365 A1 Jun. 21, 2012

(30) Foreign Application Priority Data

Sep. 7, 2009 (JP) ..... 2009-206473

(51) Int. Cl.
*G02F 1/136* (2006.01)

(52) U.S. Cl. ..... 349/41; 349/33; 349/42; 349/144; 349/149; 349/150

(58) Field of Classification Search ..... 349/19, 349/33, 41, 42, 144, 149, 150
See application file for complete search history.

(56) References Cited

U.S. PATENT DOCUMENTS

| | | | | |
|---|---|---|---|---|
| 6,784,411 | B2 * | 8/2004 | Zhang et al. | 250/208.1 |
| 8,188,964 | B2 * | 5/2012 | Tsuruta | 345/100 |
| 2004/0130544 | A1 | 7/2004 | Sun | |

FOREIGN PATENT DOCUMENTS

| | | | |
|---|---|---|---|
| JP | 4-060581 | A | 2/1992 |
| JP | 2004-212924 | A | 7/2004 |
| JP | 2005-018088 | A | 1/2005 |
| JP | 2006-343563 | A | 12/2006 |
| JP | 2007-334224 | A | 12/2007 |

OTHER PUBLICATIONS

International Search Report.

* cited by examiner

*Primary Examiner* — Jennifer Doan
(74) *Attorney, Agent, or Firm* — Harness, Dickey & Pierce, P.L.C.

(57) ABSTRACT

A display device includes liquid crystal capacitor element interposed between a pixel electrode and a counter electrode. The pixel electrode, one terminals of a first switch circuit and a second switch circuit, and a first terminal of a second transistor form an internal node. The other terminals of the first switch circuit is connected to the source line. The other terminal of the second switch circuit is connected to the voltage supply line and is configured by a series circuit of transistors. A control terminal of the transistor, a second terminal of the transistor, and one terminal of a boost capacitor element form an output node. The other terminal of the boost capacitor element, the control terminal of the transistor, and the control terminal of the transistor are connected to a boost line, a reference line, and a selecting line, respectively.

34 Claims, 50 Drawing Sheets

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | |
|---|---|---|
| T1 (Case A) | ON | OFF |
| T1 (Case B) | OFF | OFF |
| T2 (Case A) | OFF | OFF |
| T2 (Case B) | ON | ON |
| T3 | ON | OFF |
| T4 | OFF | OFF |

| | | | | | | | | | |
|---|---|---|---|---|---|---|---|---|---|
| T1 (Case A) | OFF | ON | ON | ON | ON | ON | ON | OFF | OFF |
| T1 (Case B) | OFF | OFF | OFF | OFF | OFF | OFF | OFF | OFF | OFF |
| T2 (Case A) | OFF | OFF | OFF | OFF | OFF | OFF | OFF | OFF | ON |
| T2 (Case B) | ON | ON | OFF | OFF | OFF | OFF | OFF | OFF | OFF |
| T3 | OFF | OFF | OFF | OFF | OFF | OFF | ON | OFF | OFF |
| T4 | OFF | OFF | OFF | OFF | ON | OFF | OFF | OFF | OFF |

| | | | | | | | | | |
|---|---|---|---|---|---|---|---|---|---|
| T1 (Case A) | OFF | ON | ON | ON | ON | ON | ON | OFF | OFF |
| T1 (Case B) | OFF | OFF | OFF | OFF | OFF | OFF | OFF | OFF | OFF |
| T2 (Case A) | OFF | OFF | OFF | OFF | OFF | OFF | OFF | OFF | ON |
| T2 (Case B) | ON | ON | OFF | OFF | OFF | OFF | OFF | OFF | OFF |
| T3 | OFF | OFF | OFF | OFF | OFF | OFF | ON | OFF | OFF |
| T4 | OFF | OFF | OFF | OFF | ON | OFF | OFF | OFF | OFF |

| | | | | | | | | | |
|---|---|---|---|---|---|---|---|---|---|
| T1 (Case A) | OFF | ON | ON | ON | ON | ON | ON | OFF | OFF |
| T1 (Case B) | OFF | OFF | OFF | OFF | OFF | OFF | OFF | OFF | OFF |
| T2 (Case A) | OFF | OFF | OFF | OFF | OFF | OFF | OFF | OFF | ON |
| T2 (Case B) | ON | ON | OFF | OFF | OFF | OFF | OFF | OFF | OFF |
| T3 | OFF | OFF | OFF | OFF | OFF | OFF | ON | OFF | OFF |
| T4 | OFF | OFF | OFF | OFF | ON | OFF | OFF | OFF | OFF |

| | | | | | | | | | |
|---|---|---|---|---|---|---|---|---|---|
| T1 (Case A) | OFF | ON | ON | ON | ON | ON | ON | OFF | OFF |
| T1 (Case B) | OFF | OFF | OFF | OFF | OFF | OFF | OFF | OFF | OFF |
| T2 (Case A) | OFF | OFF | OFF | OFF | OFF | OFF | OFF | OFF | ON |
| T2 (Case B) | ON | ON | OFF | OFF | OFF | OFF | OFF | OFF | OFF |
| T3 | OFF | OFF | OFF | OFF | ON | ON | ON | OFF | OFF |
| T4 | OFF | OFF | OFF | OFF | ON | OFF | OFF | OFF | OFF |

| | | | | | | | | | |
|---|---|---|---|---|---|---|---|---|---|
| T1 (Case A) | OFF | ON | ON | ON | ON | ON | ON | OFF | OFF |
| T1 (Case B) | OFF | OFF | OFF | OFF | OFF | OFF | OFF | OFF | OFF |
| T2 (Case A) | OFF | OFF | OFF | OFF | OFF | OFF | OFF | OFF | ON |
| T2 (Case B) | ON | ON | OFF | OFF | OFF | OFF | OFF | OFF | OFF |
| T3 | OFF | ON | ON | ON | ON | ON | ON | OFF | OFF |
| T4 | OFF | OFF | OFF | OFF | ON | OFF | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | OFF | OFF | OFF | OFF | OFF | OFF | ON |
| T2 (Case B) | ON | OFF | OFF | OFF | OFF | OFF | OFF | ON |
| T3 | OFF | OFF | OFF | OFF | OFF | ON | OFF | OFF |
| T4 | OFF | OFF | OFF | ON | OFF | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | OFF | OFF | OFF | OFF | OFF | OFF | ON |
| T2 (Case B) | ON | OFF | OFF | OFF | OFF | OFF | OFF | ON |
| T3 | OFF | OFF | OFF | OFF | OFF | ON | OFF | OFF |
| T4 | OFF | OFF | OFF | ON | OFF | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | OFF | OFF | OFF | OFF | OFF | OFF | ON |
| T2 (Case B) | ON | OFF | OFF | OFF | OFF | OFF | OFF | ON |
| T3 | OFF | OFF | OFF | OFF | OFF | ON | OFF | OFF |
| T4 | OFF | OFF | OFF | ON | OFF | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | ON | OFF | OFF | OFF | OFF | OFF | ON |
| T2 (Case B) | ON | ON | OFF | OFF | OFF | OFF | OFF | ON |
| T3 | OFF | ON | ON | ON | ON | ON | OFF | OFF |
| T4 | OFF | OFF | OFF | OFF | ON | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | OFF | OFF | OFF | OFF | OFF | OFF | ON |
| T2 (Case B) | ON | OFF | OFF | OFF | OFF | OFF | OFF | ON |
| T3 | OFF | OFF | OFF | OFF | OFF | ON | OFF | OFF |
| T4 | OFF | OFF | OFF | ON | OFF | OFF | OFF | OFF |

| | | | | | | | | |
|---|---|---|---|---|---|---|---|---|
| T1 (Case A) | OFF | OFF | OFF | OFF | OFF | ON | ON | OFF |
| T1 (Case B) | OFF | OFF | OFF | OFF | OFF | OFF | OFF | OFF |
| T2 (Case A) | ON | ON | OFF | OFF | OFF | OFF | OFF | ON |
| T2 (Case B) | ON | ON | OFF | OFF | OFF | OFF | OFF | ON |
| T3 | OFF | ON | ON | ON | ON | ON | OFF | OFF |
| T4 | OFF | OFF | OFF | OFF | ON | OFF | OFF | OFF |

PIXEL CIRCUIT AND DISPLAY DEVICE

CROSS-REFERENCE TO RELATED APPLICATIONS

This application is a National Phase filing under 35 U.S.C. §371 of International Application No. PCT/JP2010/058743 filed on May 24, 2010, and which claims priority to Japanese Patent Application No. 2009-206473 filed on Sep. 7, 2009.

TECHNICAL FIELD

The present invention relates to a pixel circuit and a display device including the pixel circuit and, in particular, an active-matrix type display device.

BACKGROUND ART

In a mobile terminal such as a cellular phone or a mobile game console, a liquid crystal display device is generally used as a display means. Since a cellular phone is driven by a battery, a power consumption is strongly required to be reduced. For this reason, information such as time or a battery life that is required to be always displayed is displayed on a reflective sub-panel. In recent years, on the same main panel, a normal display by a full-color display and a reflective always-on display have been required to be compatible.

FIG. 49 shows an equivalent circuit of a pixel circuit in a general active-matrix type liquid crystal display device. FIG. 50 shows a circuit arrangement of an active-matrix type liquid crystal display device having m×n pixels. Both reference symbols m and n denote integers each of which is 2 or more.

As shown in FIG. 50, switch elements configured by thin film transistors (TFTs) are arranged at intersections between m source lines SL1, SL2, . . . , SLm and n scanning lines GL1, GL2, . . . , GLn. In FIG. 49, the source lines SL1, SL2, . . . , SLm are represented by a source line SL, and, similarly, the scanning lines GL1, GL2, . . . , GLn are represented by a symbol GL.

As shown in FIG. 49, a liquid crystal capacitor element Clc and an auxiliary capacitor element Cs are connected in parallel to each other through a TFT. The liquid crystal capacitor element Clc is configured by a laminated structure in which a liquid crystal layer is formed between a pixel electrode 20 and a counter electrode 80. The counter electrode is also called a common electrode.

In FIG. 50 simply shows only a TFT and a pixel electrode (black rectangular portion) in each pixel circuit.

The auxiliary capacitor element Cs has one terminal (one electrode) connected to the pixel electrode 20 and the other terminal (other electrode) connected to an auxiliary capacitive line CSL to stabilize a voltage of pixel data held in the pixel electrode 20. The auxiliary capacitor element Cs advantageously suppresses a voltage of pixel data held in a pixel electrode from varying due to generation of a leakage current in the TFT, a variation in electric capacitance of the liquid crystal capacitor element Clc between a black display and a white display caused by dielectric anisotropy held by liquid crystal molecules, a variation in voltage through a parasitic capacitance between a pixel electrode and a peripheral wire, and the like. Voltages of the scanning lines are sequentially controlled to set TFTs connected to one scanning line to a conducting state, and voltages of pixel data supplied to source lines in units of scanning lines are programmed in corresponding pixel electrodes, respectively.

In a normal display by a full-color display, even though display contents are a still image, the same display contents are repeatedly programmed in the same pixel for each frame. In this manner, the voltages of the pixel data held in the pixel electrodes are updated to minimize a variation in voltage of the pixel data and to secure a display of a high-quality still image.

A power consumption to drive a liquid crystal display device is almost controlled by a power consumption to drive a source line by a source driver, and is almost expressed by a relational expression represented by the following numerical expression 1. In numerical expression 1, reference symbol P denotes a power consumption; f, a refresh rate (the number of times of a refresh action of one frame per unit time); C, a load capacitance driven by a source driver; V, a drive voltage of the source driver; n, the number of scanning lines; and m, the number of source lines. In this case, the refresh action is an operation that applies a voltage to a pixel electrode through a source line while keeping display contents.

$$P \propto f \cdot C \cdot V^2 \cdot n \cdot m \qquad \text{(Numerical Expression 1)}$$

In the always-on display, since the display contents are a still image, the voltage of the pixel data need not be always updated for each frame. For this reason, in order to further reduce the power consumption of the liquid crystal display device, a refresh frequency in the always-on display state is lowered. However, when the refresh frequency is lowered, a pixel data voltage held in a pixel electrode varies by an influence of a leakage current of a TFT. The variation in voltage causes a variation in display luminance (transmittance of liquid crystal) of each pixel and becomes to be observed as flickers. Since an average potential in each frame period also decreases, deterioration of display quality such as insufficient contrast may be probably caused.

In this case, as a method of simultaneously realizing a solution of a problem of deterioration of display quality caused by a decrease in refresh frequency in an always-on display of a still image such as a display of a battery life or time and a reduction in power consumption, for example, a configuration described in the following Patent Document 1 is disclosed. In the configuration disclosed in Patent Document 1, liquid crystal displays by both transmissive and reflective functions are possible. Furthermore, a memory unit is arranged in a pixel circuit in a pixel area in which a reflective liquid crystal display can be obtained. The memory unit holds information to be displayed in a reflective liquid crystal display unit as a voltage signal. In a reflective liquid crystal display state, a voltage held in the memory unit of the pixel circuit is read to display information corresponding to the voltage.

In Patent Document 1, the memory unit is configured by an SRAM, and the voltage signal is statically held. For this reason, a refresh action is not required, maintenance of display quality and a reduction in power consumption can be simultaneously realized.

PRIOR ART

Patent Document

[Patent Document 1] Unexamined Japanese Patent Publication No. 2007-334224

SUMMARY OF THE INVENTION

Problem to be Solved by the Invention

However, when the above configuration is applied to a liquid crystal display device used in a cellular phone or the like, in addition to an auxiliary capacitor element to hold a voltage of each pixel data serving as analog information in a normal operation, a memory unit to store the pixel data needs to be arranged for each pixel or each pixel group. In this manner, since the numbers of elements and signal lines to be formed on an array substrate (active matrix substrate) that configures the display unit in the liquid crystal display device increase, an aperture ratio in a transmission mode decreases. When a polarity-inverted drive circuit to AC-drive a liquid crystal is arranged together with the memory unit, the aperture ratio further decreases. In this manner, when the aperture ratio decreases due to the increase in number of elements or signal lines, a luminance of a display image decreases in a normal display mode.

In the liquid crystal display device, in a display of a still image obtained by an always-on display, in addition to the problem of a variation in voltage in a pixel electrode, a problem in which, when a voltage of the same polarity is continuously applied across a pixel electrode and a counter electrode, a small amount of ionic impurity contained in a liquid crystal layer is concentrated on any one of the pixel electrode and the counter electrode to cause the entire display screen to burn is posed. For this reason, in addition to the refresh action, a polarity inverting action to invert polarities of a voltage applied across the pixel electrode and the counter electrode is necessary.

In each of the normal display and the always-on display, in a display of a still image, as the polarity inverting action, an operation that stores pixel data of 1 frame in a frame memory and repeatedly programs a voltage corresponding to the pixel data while a polarity determined with reference to the counter electrode is inverted in each case is performed. For this reason, as described above, an operation that drives a scanning line and a source line from the outside and programs voltages of pixel data supplied to the source lines in units of scanning lines in the pixel electrodes, respectively, is necessary.

Thus, in an always-on display required to be operated with a low power consumption, when the scanning line and the source line are driven from the outside to perform the polarity inverting action, a larger power consumption occurs because a voltage amplitude of the pixel electrode is larger than that in the refresh action.

The present invention has been made in consideration of the above problems and, it is an object of the present invention to provide a pixel circuit and a display device that can prevent deteriorations of a liquid crystal and display quality with a low power consumption without causing a decrease in aperture ratio.

Means for Solving the Problem

In order to achieve the above object, the pixel circuit according to the present invention is characterized to employ the following configuration.

A pixel circuit according to the present invention includes:

a display element unit including a unit display element;

an internal node that configures a part of the display element unit and holds a voltage of pixel data applied to the display element unit;

a first switch circuit that transfers the voltage of the pixel data supplied from a data signal line to the internal node through at least predetermined switch element;

a second switch circuit that transfers the voltage supplied from the data signal line to the internal node without passing through the predetermined switch element; and a control circuit that holds a predetermined voltage depending on the voltage of the pixel data held by the internal node at one terminal of a first capacitor element and controls connection/disconnection of the second switch circuit.

The pixel circuit includes first to third transistor elements each having a first terminal, a second terminal, and a control terminal that controls an electrical connection between the first and second terminals. Of the transistor elements, the second switch circuit includes the first and third transistor elements and the control circuit includes the second transistor element. The second switch circuit is configured by a series circuit having the first transistor element and the third transistor element, and the control circuit is configured by a series circuit having the second transistor element and the first capacitor element.

The first switch circuit has one terminal connected to a data signal line, and the second switch circuit has one terminal connected to a voltage supply line. Both the switch circuits have the other terminals connected to the internal node. The first terminal of the second transistor element is also connected to the internal node.

The control terminal of the first transistor element, the second terminal of the second transistor element, and the one terminal of the first capacitor element are connected to each other to form a node (an output node). A control terminal of the second transistor element is connected to a first control line, and a control terminal of the third transistor element is connected to a second control line. Furthermore, the other terminal of the first capacitor element (i.e. the terminal which does not form the node) is connected to the second control line or a third control line.

The power supply line may also be an independent signal line or the first control line may also serve as the power supply line.

In addition to the configuration, a second capacitor element having one terminal connected to the internal node and having the other terminal connected to a fourth control line or a predetermined fixed voltage line may be further arranged. At this time, a fourth control line may also serve as the voltage supply line.

The predetermined switch element is configured by a fourth transistor element having a first terminal, a second terminal, and a control terminal that controls an electrical connection between the first and second terminals, and the fourth transistor element also preferably has a first terminal connected to the internal node, a second terminal connected to the data signal line or the first terminal of the third transistor element, and a control terminal connected to the scanning signal line.

The first switch circuit also preferably has a configuration that does not include a switch element except for the predetermined switch element.

The first switch circuit is preferably configured by a series circuit of the third transistor element in the second switch circuit and the predetermined switch element or a series circuit of a fifth transistor having a control terminal connected to the control terminal of the third transistor element in the second switch circuit and the predetermined switch element.

Furthermore, a display device according to the present invention includes a pixel circuit array configured by arranging a plurality of pixel circuits having the above characteristics in a row direction and a column direction, in which the data signal line is arranged for each of the columns one by one, the pixel circuits arranged along the same column have one terminals of the first switch circuits connected to the common data signal line, the pixel circuits arranged along the same row or the same column have the control terminals of the second transistor elements connected to the common first control line, the pixel circuits arranged along the same row or the same column have the control terminals of the third transistor elements connected to the common second control line, the pixel circuits arranged along the same row or the same column have the other terminals of the first capacitor elements connected to the common second control line or the common third control line, a data signal line drive circuit that independently drives the data signal lines and a control line drive circuit that independently drives the first and second control lines are provided, in the case where the first control line serves as the voltage supply line or in the case where the voltage supply line is an independent wire, the control line drive circuit drives the power supply line, and in the case where the other terminal of the first capacitor element is connected to the third control line, the control line drive circuit drives the third control line.

In the case where the pixel circuit further includes a second capacitor element having one terminal connected to the internal node and the other terminal connected to the fourth control line, the fourth control line may be driven by the control line drive circuit.

In addition to the above configuration, in the case where the power supply line is an independent wire, the pixel circuits arranged along the same row or the same column preferably have a configuration in which the one terminals of the second switch circuits are connected to the common voltage supply line.

The predetermined switch element is configured by a fourth transistor element having a first terminal, a second terminal, and a control terminal that controls an electrical connection between the first and second terminals, and the control terminal of the fourth transistor element is preferably connected to a scanning signal line.

The first switch circuit may not include a switch element except for the predetermined switch element, or may be configured by a series circuit of the third transistor element in the second switch circuit and the predetermined switch element or a series circuit of a fifth transistor having a control terminal connected to the control terminal of the third transistor element in the second switch circuit and the predetermined switch element.

A display device according to the present invention includes a pixel circuit array configured by arranging a plurality of pixel circuits having the above characteristics in a row direction and a column direction, in which the data signal line is arranged for each of the columns one by one, the pixel circuits arranged along the same column have the one terminals of the first switch circuits connected to the common data signal line, the pixel circuits arranged along the same row or the same column have the control terminals of the second transistor elements connected to the common first control line, the pixel circuits arranged along the same row or the same column have the control terminals of the third transistor elements connected to the common second control line, the pixel circuits arranged along the same row or the same column have the other terminals of the first capacitor elements connected to the common second control line or the common third control line, a data signal line drive circuit that independently drives the data signal lines and a control line drive circuit that independently drives the first and second control lines are provided, in the case where the first control line serves as the voltage supply line or in the case where the voltage supply line is an independent wire, the control line drive circuit drives the power supply line, and in the case where the other terminal of the first capacitor element is connected to the third control line, the control line drive circuit drives the third control line.

At this time, in the case where the power supply line is an independent wire, the pixel circuits arranged along the same row or the same column preferably have a configuration in which the one terminals of the second switch circuits are connected to the common power supply line.

In addition to the above configuration, in the case where the first switch circuit does not include a switch element except for the predetermined switch element, and the predetermined switch element is a fourth transistor element having a first terminal, a second terminal, and a control terminal that controls an electrical connection between the first and second terminals, and the first terminal, the second terminal, and the control terminal are connected to the internal node, the data signal line, and a scanning signal line, respectively, it is preferable that the scanning signal line is arranged for each of the rows one by one, and the pixel circuits arranged along the same row are connected to the common scanning signal line, and a scanning signal line drive circuit that independently drives the scanning signal lines is provided.

On the other hand, in the case where the predetermined switch element is configured by a fourth transistor element having a first terminal, a second terminal, and a control terminal that controls an electrical connection between the first and second terminals, and the first switch circuit is configured by a series circuit of a third transistor element in the second switch circuit and the fourth transistor element or a series circuit of a fifth transistor having a control terminal connected to the control terminal of the third transistor element in the second switch circuit and the fourth transistor element, it is preferable that one scanning signal line and one second control line are arranged for each of the rows, the control terminal of the fourth transistor element is connected to the scanning signal line, the pixel circuits arranged along the same row are connected to the common scanning signal line and the common second control line, and a scanning signal line drive circuit that independently drives the scanning signal lines is arranged.

In a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, and the data signal line drive circuit applies data voltages corresponding to pixel data to be programmed in the pixel circuits of the columns of the selected row to the data signal lines, respectively.

In the programming action, the control line drive circuit preferably applies a predetermined voltage to the second control line to set the third transistor element to a non-conducting state.

In the programming action, the control line drive circuit preferably applies a predetermined voltage to the first control line to set the second transistor element to a conducting state.

In the programming action, the control line drive circuit preferably applies a predetermined voltage to the first control line to set the second transistor element to a conducting state regardless of a voltage state of the internal node, and preferably applies a predetermined voltage to the voltage supply line to set the first transistor element to a non-conducting state and set the second switch circuit to a non-conducting state.

The display device according to the present invention is characterized in that, in the case where the first switch circuit is configured by a series circuit of the third transistor element in the second switch circuit and the fourth transistor element or a series circuit of a fifth transistor having a control terminal connected to the control terminal of the third transistor element in the second switch circuit and the fourth transistor, in a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, the control line drive circuit applies a predetermined selecting voltage to the second control line of the selected row to set the third transistor element to a conducting state and applies a predetermined non-selecting voltage to the second control line of the non-selected row to set the third transistor element to a non-conducting state, and the data signal line drive circuit independently applies data voltages corresponding to the pixel data to be programmed in the pixel circuits of the columns of the selected row to the data signal lines, respectively.

In the programming action, the control line drive circuit preferably applies a predetermined voltage to the first control line to set the second transistor element to a conducting state.

The display device according to the present invention is characterized in that, in the case where the power supply line is an independent wire, in a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, the control line drive circuit applies a predetermined selecting voltage to the second control line of the selected row to set the third transistor element to a conducting state, applies a predetermined voltage to the first control line to set the second transistor element to a conducting state regardless of a voltage state of the internal node, applies a predetermined voltage to the voltage supply line to set the first transistor element to a non-conducting state and set the second switch circuit to a non-conducting state, and the data signal line drive circuit independently applies data voltages corresponding to the pixel data to be programmed in the pixel circuits of the columns of the selected row to the data signal lines, respectively.

In the programming action, the control line drive circuit preferably applies a predetermined voltage to the first control line to set the second transistor element to a conducting state.

Furthermore, the display device according to the present invention is characterized in that, in a self-refresh action to operate the second switch circuits and the control circuits to simultaneously compensate for variations in voltage of the internal nodes in the plurality of pixel circuits, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line so that when a voltage state of binary pixel data held by the internal node is a first voltage state, a current flowing from one terminal of the first capacitor element to the internal node is blocked by the second transistor element, and when the voltage state is a second voltage state, the second transistor element is set to a conducting state, applies a predetermined voltage to the second control line to set the third transistor element to a conducting state, applies a voltage pulse having a predetermined voltage amplitude to the second control line or the third control line connected to the other terminal of the first capacitor element to give a change in voltage by a capacitive coupling through the first capacitor element to the one terminal of the first capacitor element, so that when the voltage of the internal node is in the first voltage state, the change in voltage is not suppressed and the first transistor element is set to a conducting state, and when the voltage of the internal node is in the second voltage state, the change in voltage is suppressed and the first transistor element is set to a non-conducting state, and supplies a voltage of the pixel data in the first voltage state to all the voltage supply lines connected to the plurality of pixel circuits targeted by the self-refresh action.

In the above configuration, in a standby state immediately after the self-refresh action is ended, and the control line drive circuit preferably applies a predetermined voltage to the second control line to set the third transistor element to a non-conducting state and ends the application of the voltage pulse.

At this time, the self-refresh action is also preferably repeated with the standby state interposed between the self-refresh action and the subsequent self-refresh action, and the standby state is not less than 10 times a period of the self-refresh action described above.

In the standby state, the control line drive circuit preferably applies a fixed voltage to the data signal line. At this time, as the fixed voltage, a voltage in the second voltage state can be applied.

In the case where the first switch circuit configuring a pixel circuit has a configuration that does not include a switch element except for the fourth transistor element, the plurality of the pixel circuits targeted by the self-refresh action are divided into a plurality of sections each of which consists of one or more columns, at least the second control line and the second control line or the third control line connected to the other terminal of the first capacitor element are arranged so as to be driven in units of the sections, and the control line drive circuit, with respect to a section that is not targeted by the self-refresh action, preferably applies a predetermined voltage to the second control line to set the third transistor element to a non-conducting state or does not apply the voltage pulse to the second control line or the third control line connected to the other terminal of the first capacitor element, and sequentially switches the sections targeted by the self-refresh action to separately execute the self-refresh action for each of the sections.

Furthermore, the display device according to the present invention in which the pixel circuit has a configuration in which the first switch circuit does not include a switch element except for the fourth transistor element and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or in a case where the voltage supply line is an independent wire, applies a predetermined voltage to the voltage supply line to set the first transistor element to a non-conducting state and sets the second switch circuit to a non-conducting state, and applies a predetermined initial voltage to the second control line or the third control line connected to the other terminal of the first capacitor element, after the initial state setting action, the control line drive circuit applies a voltage pulse having a predetermined voltage amplitude to the second control line or the third control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit applies a predetermined voltage to the second control line to set the third transistor element to a conducting state for at least a predetermined period after the scanning signal line drive circuit ends the application of the voltage pulse and, thereafter, stops pulse application to the second control line or the third control line connected to the other terminal of the first capacitor element, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

At this time, in the case where the first control line is also used as the voltage supply line, after the initial state setting action, the control line drive circuit may apply a voltage in the second voltage state to the first control line as the predetermined voltage to set the second transistor element to a non-conducting state regardless of a voltage state of the internal node.

Furthermore, in the case where the pixel circuit includes a second capacitor element having one terminal connected to the internal node and the other terminal connected to a fourth control line, and the fourth control line also serves as the voltage supply line, the control line drive circuit may continuously apply a voltage in the second voltage state to the fourth control line for a period of the self-polarity inverting action.

Furthermore, the display device according to the present invention in which the voltage supply line is an independent wire and the pixel circuit has a configuration in which the first switch circuit does not include a switch element except for the fourth transistor element and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state and sets the second switch circuit to a non-conducting state, and applies a predetermined initial voltage to the third control line, after the initial state setting action, the control line drive circuit applies a voltage pulse having a predetermined voltage amplitude to the second control line and the third control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and sets the third transistor element to a conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit stops the voltage pulse application to the second control line and the third control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the voltage pulse to the second control line to set the third transistor element to a conducting state.

Furthermore, the display device according to the present invention in which the voltage supply line is an independent wire and the pixel circuit has a configuration in which the first switch circuit does not include a switch element except for the fourth transistor element and the other terminal of the first capacitor element is connected to the second control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state and sets the second switch circuit to a non-conducting state, and applies a predetermined initial voltage to the second control line, after the initial state setting action, the control line drive circuit applies a voltage pulse having a predetermined voltage amplitude to the second control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set in a non-conducting state until the scanning signal line drive circuit ends application of the voltage pulse, the control line drive circuit stops the pulse application to the second control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

Furthermore, the display device according to the present invention in which the pixel circuit has a configuration in which the voltage supply line is an independent wire, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line and the voltage supply line, after the initial state setting action, the control line drive circuit applies a voltage pulse having a predetermined voltage amplitude to the third control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit applies a predetermined voltage to the second control line to set the third transistor element to a conducting state for at least a predetermined period from the voltage pulse application of the scanning signal line drive circuit to the end of the voltage pulse application, and, thereafter, stops pulse application to the third control line connected to the other terminal of the first capacitor element, and the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal line drive circuit and a voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

Furthermore, the display device according to the present invention in which the pixel circuit has a configuration in which the voltage supply line is an independent wire, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line and the voltage supply line, after the initial state setting action, the control line drive circuit applies a voltage pulse having a predetermined voltage amplitude to the second control line and the third control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit stops the voltage pulse application to the second control line and the third control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal drive circuit and the voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the application of the voltage pulse to the second control line and the third control line.

Furthermore, the display device according to the present invention in which the pixel circuit has a configuration in which the voltage supply line is an independent wire, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the second control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state or applies a predetermined voltage to the voltage supply line to set the first transistor element to a non-conducting state, and sets the second switch circuit to a non-conducting state, after the initial state setting action, the control line drive circuit applies a voltage pulse having a predetermined voltage amplitude to the second control line and the third control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit stops the voltage pulse application to the second control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal drive circuit and the voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the application of the voltage pulse to the second control line.

Furthermore, the display device according to the present invention in which the pixel circuit has a configuration in which the first switch circuit does not include a switch element except for the fourth transistor element and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, so that in the case where a voltage at a first or second terminals of the first transistor element is set in the second voltage state, when the internal node is in the first voltage state, the first transistor element is set to a conducting state, and when the internal nodes is in the second voltage state, the first transistor element is set to a non-conducting state, depending on the voltage difference at the one terminal of the first capacitor element, applies a predetermined voltage to the second control line to set the third transistor element to a non-conducting state or, in the case where the voltage supply line is an independent wire, applies a predetermined voltage to the voltage supply line to set the first transistor element to a non-conducting state and sets the second switch circuit to a non-conducting state, and applies a predetermined initial voltage to the third control line connected to the other terminal of the first capacitor element, after the initial state setting action, the control line drive circuit applies a predetermined voltage to the first control line to set the second transistor element to a non-conducting state regardless of whether the internal node is in the first voltage state or the second voltage state, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, and thereafter returns the fourth transistor element to a non-conducting state, the counter electrode voltage supply circuit changes a voltage applied to the counter electrode between two voltage states after the second transistor element is set to a non-conducting state until the scanning signal line drive circuit ends the application of the voltage pulse, the control line drive circuit applies a predetermined voltage to the second control line to set the third transistor element to a conducting state for at least a predetermined period after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

Furthermore, the display device according to the present invention in which the pixel circuit has a configuration in which the voltage supply line is an independent wire, the other terminal of the first capacitor element is connected to the third control line, and the first switch circuit is configured by a series circuit of the third transistor element and the fourth transistor element or a series circuit of a fifth transistor having a control terminal connected to the control terminal of the third transistor element in the second switch circuit and the fourth transistor element, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, is characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line connected to the other terminal of the first capacitor element, after the initial state setting action, the control line drive circuit applies a predetermined voltage to the first control line to set the second transistor element to a non-conducting state regardless of a voltage state of the internal node, thereafter, the scanning signal line drive circuit applies a voltage pulse having a predetermined voltage amplitude to the all the scanning signal lines connected to the plurality of pixel circuits targeted by the self-polarity-inverting action to temporarily set the fourth transistor element to a conducting state, and thereafter returns the fourth transistor element to a conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit applies a predetermined voltage to the second control line to set the third transistor element to a conducting state for at least a period from when the scanning signal line drive circuit applies the voltage pulse to when a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

Furthermore, in the case where the pixel circuit includes a second capacitor element having one terminal connected to the internal node and the other terminal connected to a fixed voltage line, after the scanning signal line drive circuit ends application of the voltage pulse, a variation in voltage of the internal node caused when the application of the voltage pulse is ended is compensated for by adjusting a voltage of the fixed voltage line.

Effect of the Invention

With the configuration of the present invention, in addition to a normal programming action, it is possible to execute an action (self-refresh action) that returns an absolute value of a voltage applied across both the terminals of the display element unit to a value in the immediately previous programming action without performing a programming action. In a display device such as a liquid crystal display device which requires a polarity inverting action depending on the configuration of the pixel circuit, an action that inverts a polarity of a voltage applied across both the terminals of the display element unit can be executed without performing a programming action (self-polarity-inverting action).

In the case where a plurality of pixel circuits are arranged, a normal programming action is generally executed for each row. For this reason, driver circuits the number of which is equal to the number of rows of the arranged pixel circuits need to be driven.

According to the pixel circuit of the present invention, since a refresh action can be executed by performing a self-refresh action while continuously applying a constant voltage to a data signal line, even though the refresh action is executed by the same scanning method as that in normal programming, the number of times of driving of a driver circuit required from the start of the refresh action to the end thereof can be considerably reduced to make it possible to realize a low power consumption. Furthermore, target pixels can also be refreshed at once. In this manner, a time required for refreshing can be shortened, and a power consumption can be considerably reduced.

Since a memory unit such as an SRAM need not be additionally arranged in the pixel circuit, an aperture ratio does not considerably decrease unlike in the conventional art.

Furthermore, according to the pixel circuit of the present invention, a self-polarity-inverting action is performed to make it possible to simultaneously execute a polarity inverting action to all the plurality of pixels that are maximally arranged. In comparison with polarity inversion performed by a normal programming action, the number of times of driving of a driver circuit required from the start of the polarity inverting action to the end thereof can be considerably reduced to make it possible to realize a low power consumption.

According to the pixel circuit and the display device according to the present invention, the self-refresh action and the self-polarity-inverting action can be arbitrarily combined to each other. Thus, an effect of a reduction in power consumption in an image display can be further improved.

MODE FOR CARRYING OUT THE INVENTION

Figure 49:
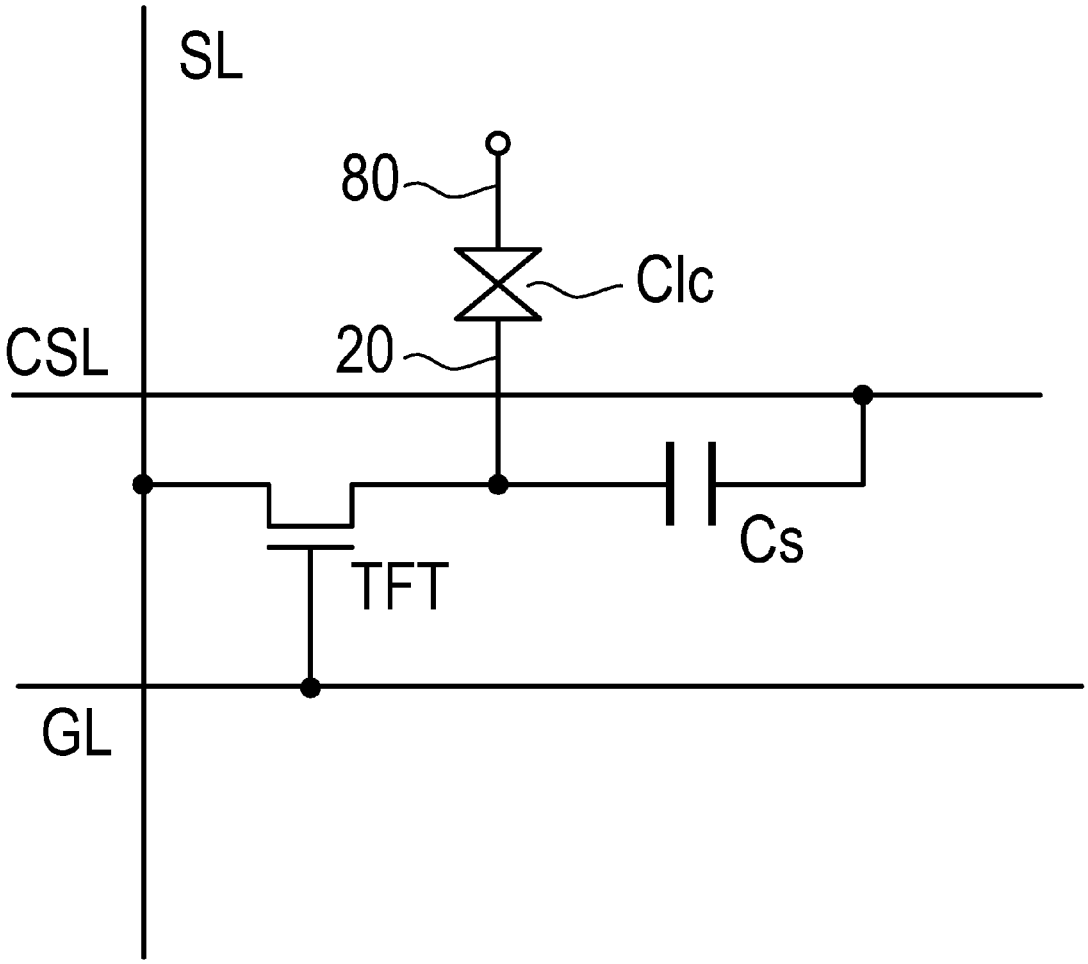
FIG. 49 is an equivalent circuit diagram of a pixel circuit in a general active-matrix type liquid crystal display device.
Figure 50:
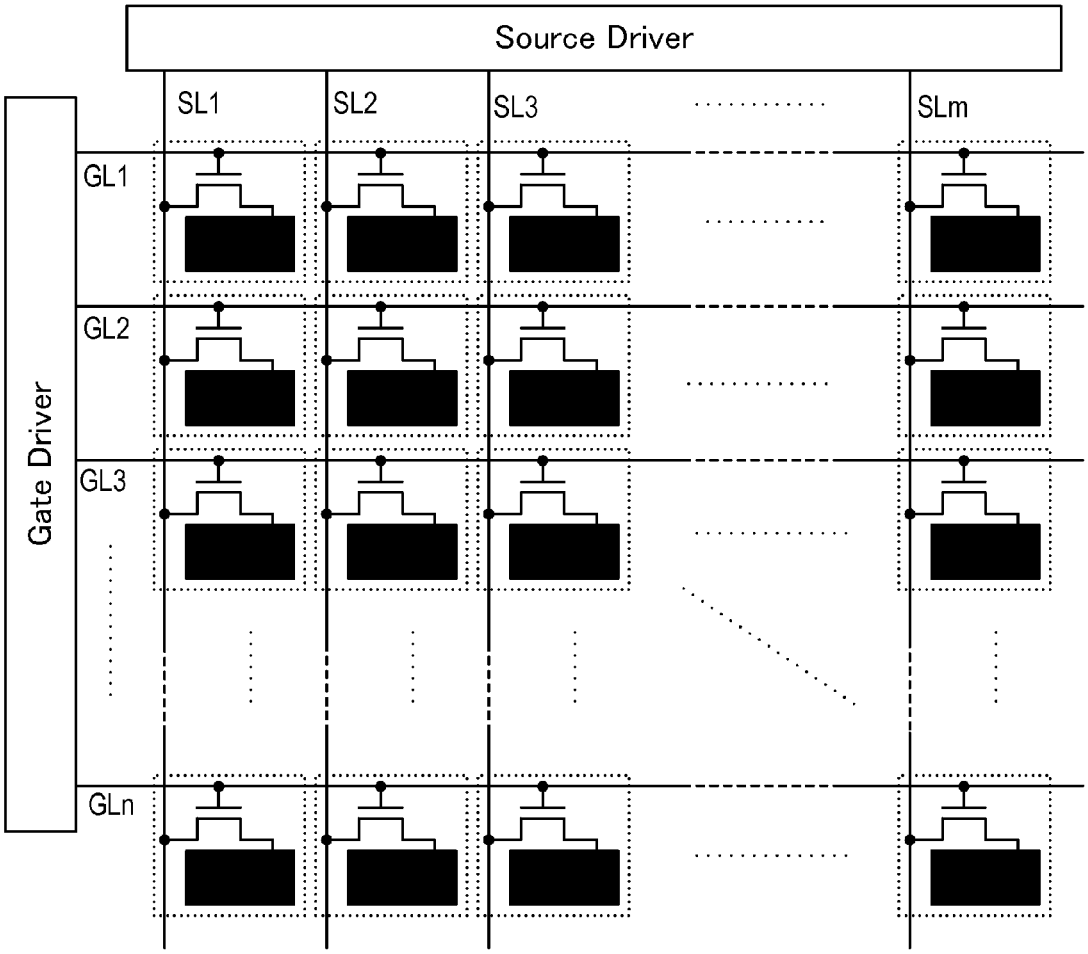
FIG. 50 is a block diagram showing a circuit arrangement of an active-matrix type liquid crystal display device having m×n pixels.

Embodiments of a pixel circuit and a display device of the present invention will be described below with reference to the accompanying drawings. The same reference numerals as in FIGS. 49 and 50 denote the same constituent elements in the embodiments.

First Embodiment

In the first embodiment, configurations of a display device of the present invention (to be simply referred to as a "display device" hereinafter) and a pixel circuit of the present invention (to be simply referred to as a "pixel circuit" hereinafter) will be described below.

<<Display Device>>

Figure 1:
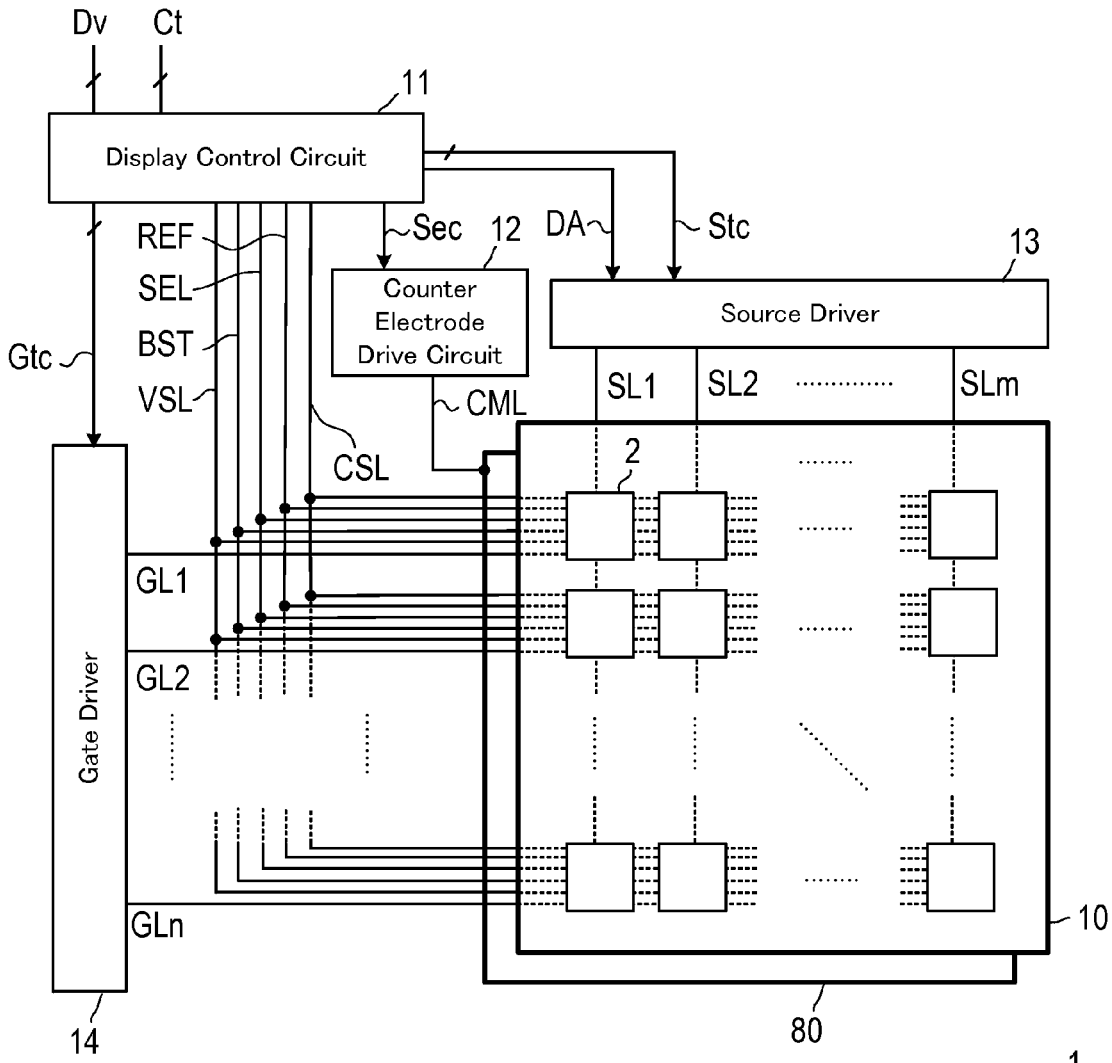
FIG. 1 is a block diagram showing an example of a schematic configuration of a display device according to the present invention.

FIG. 1 shows a schematic configuration of a display device 1. The display device 1 includes an active matrix substrate 10, a counter electrode 80, a display control circuit 11, a counter electrode drive circuit 12, a source driver 13, a gate driver 14, and various signal lines (will be described later). On the active matrix substrate 10, a plurality of pixel circuits 2 are arranged in row and column directions to form a pixel circuit array.

In FIG. 1, to avoid the drawings from being complex, the pixel circuits 2 are displayed to be blocked. In order to clarify that the various signal lines are formed on the active matrix substrate 10, for descriptive convenience, the active matrix substrate 10 is shown on the upper side of the counter electrode 80.

In the embodiment, the display device 1 has a configuration in which the same pixel circuits 2 are used to make it possible to perform screen display in two display modes including a normal display mode and an always-on display mode. The normal display mode is a display mode that displays a moving image or a still image in full color and uses a transmissive liquid crystal display using a back light. On the other hand, the always-on display mode of the embodiment is a display mode that performs two-tone (white and black) display in units of pixel circuits and allocates the three adjacent pixel circuits 2 to three primary colors (R, G, and B), respectively, to display eight colors. Furthermore, in the always-on display mode, a plurality of sets of three adjacent pixel circuits can also be combined to each other to increase the number of display colors by area coverage modulation. The always-on display mode according to the embodiment is a technique that can be used in transmissive liquid crystal display or reflective liquid crystal display.

In the following explanation, for descriptive convenience, a minimum display unit corresponding to one pixel circuit 2 is called a "pixel", and "pixel data" programmed in each of the pixel circuits serves as tone data of each color in color display in three primary colors (R, G, and B). When color display is to be performed by using, in addition to the three primary colors, white and black luminance data, the luminance data is included in pixel data.

Figure 2:
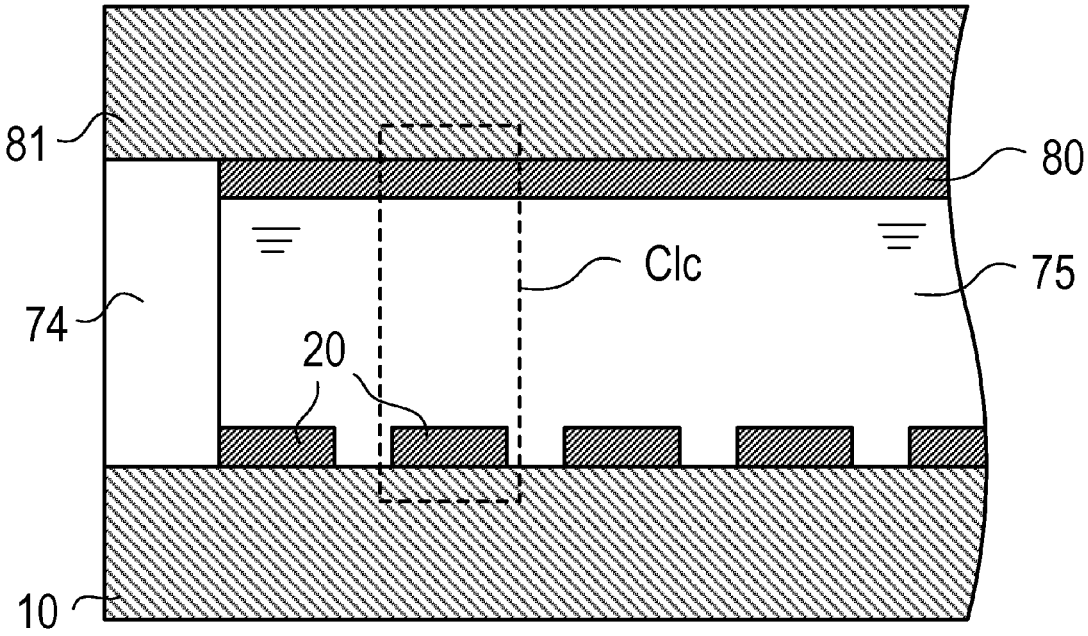
FIG. 2 is a schematic structural diagram of a partial section of a liquid display device.

FIG. 2 is a schematic sectional structural diagram showing a relation between the active matrix substrate 10 and the counter electrode 80, and shows a structure of a display element unit 21 (see FIG. 6) serving as a constituent element of the pixel circuit 2. The active matrix substrate 10 is a light-transmitting transparent substrate made of, for example, glass or plastic.

As illustrated in FIG. 1, the pixel circuits 2 including signal lines are formed on the active matrix substrate 10. In FIG. 2, the pixel electrode 20 is illustrated as a representative of a constituent element of the pixel circuit 2. The pixel electrode 20 is made of a light-transmitting transparent conductive material, for example, ITO (indium tin oxide).

A light-transmitting counter substrate 81 is arranged to face the active matrix substrate 10, and a liquid crystal layer 75 is held in a gap between both the substrates. Deflection plates (not shown) are stuck to outer surfaces of both the substrates.

The liquid crystal layer 75 is sealed by a seal member 74 at the peripheral portions of both the substrates. On the counter substrate 81, the counter electrode 80 made of a light-transmitting transparent conductive material such as ITO is formed to face the pixel electrode 20. The counter electrode 80 is formed as a single film to spread on an almost entire surface of the counter substrate 81. In this case, a unit liquid crystal display element Clc (see FIG. 6) is formed by one pixel electrode 20, the counter electrode 80, and the liquid crystal layer 75 held therebetween.

A back light device (not shown) is arranged on a rear surface side of the active matrix substrate 10 to make it possible to emit light oriented from the active matrix substrate 10 to the counter substrate 81.

As shown in FIG. 1, a plurality of signal lines are formed in vertical and horizontal directions on the active matrix substrate 10. The plurality of pixel circuits 2 are formed in the form of a matrix at positions where m source lines (SL1, SL2, . . . , SLm) extending in the vertical direction (column direction) and n gate lines (GL1, GL2, . . . , GLn) extending in the horizontal direction (row direction). Both reference symbols m and n denote natural numbers each of which is 2 or more. Each of the source lines is represented by a "source line SL", and each of the gate lines is represented by a "gate line GL".

In this case, the source line SL corresponds to a "data signal line", and the gate line GL corresponds to a "scanning signal lines". The source driver 13 corresponds to a "data signal line drive circuit", the gate driver 14 corresponds to a "scanning signal line drive circuit", the counter electrode drive circuit 12 corresponds to a "counter electrode voltage supply circuit", and a part of the display control circuit 11 corresponds to a "control line drive circuit".

In FIG. 1, the display control circuit 11 and the counter electrode drive circuit 12 are shown to be independent of the source driver 13 and the gate driver 14. However, in the drivers, the display control circuit 11 and the counter electrode drive circuit 12 may be included.

In the embodiment, as signal lines that drive the pixel circuits 2, in addition to the source line SL and the gate line GL described above, a reference line REF, a selecting line SEL, an auxiliary capacitive line CSL, and a boost line BST are provided.

Figure 3:
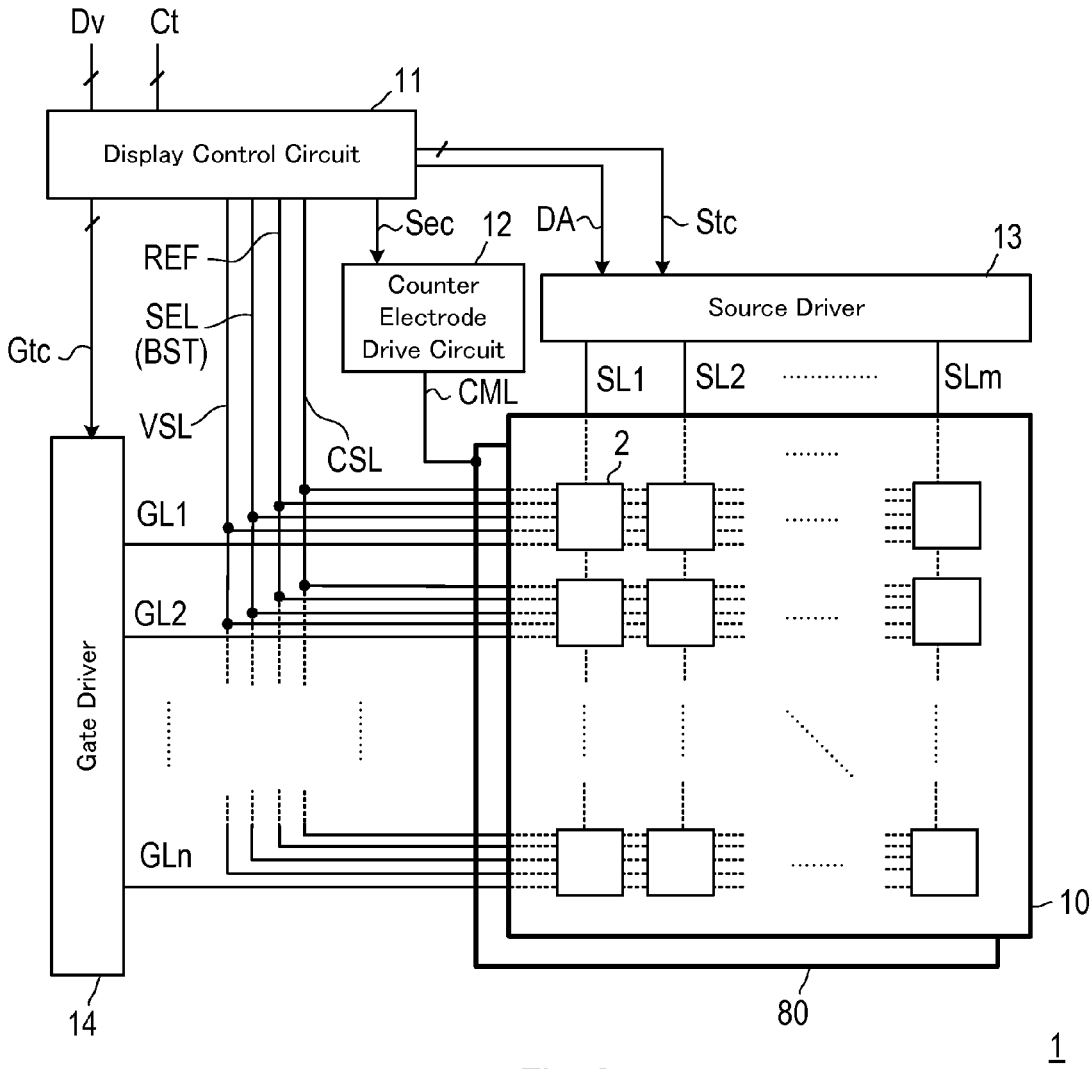
FIG. 3 is a block diagram showing an example of the schematic configuration of the display device according to the present invention.

The boost line BST can be arranged as a signal line different from the selecting line SEL, or can also be common to the selecting line SEL. The boost line BST and the selecting line SEL are made common to each other, the number of signal lines to be arranged on the active matrix substrate 10 can be reduced, and an aperture ratio of each pixel can be increased. FIG. 3 shows a configuration of a display device in which the selecting line SEL and the boost line BST are common to each other.

Furthermore, a voltage supply line VSL can be arranged as an independent signal line as shown in FIGS. 1 and 3, and can be made common to the auxiliary capacitive line CSL or the reference line REF. Configurations in which, in the configurations in FIGS. 1 and 3, the voltage supply line VSL is made common to the auxiliary capacitive line CSL or the reference line REF are shown in FIGS. 4 and 5.

Figure 4:
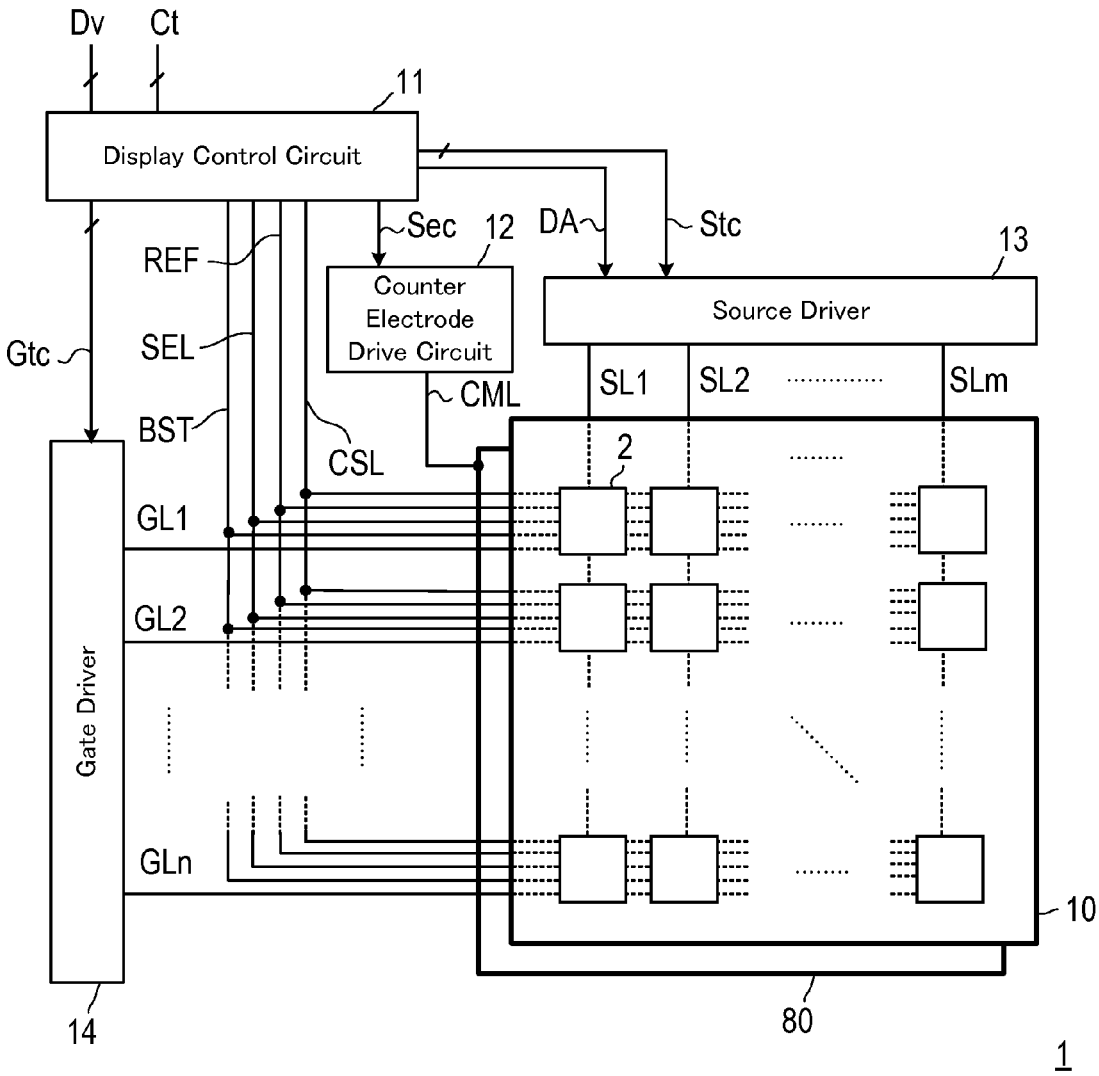
FIG. 4 is a block diagram showing an example of the schematic configuration of the display device according to the present invention.
Figure 5:
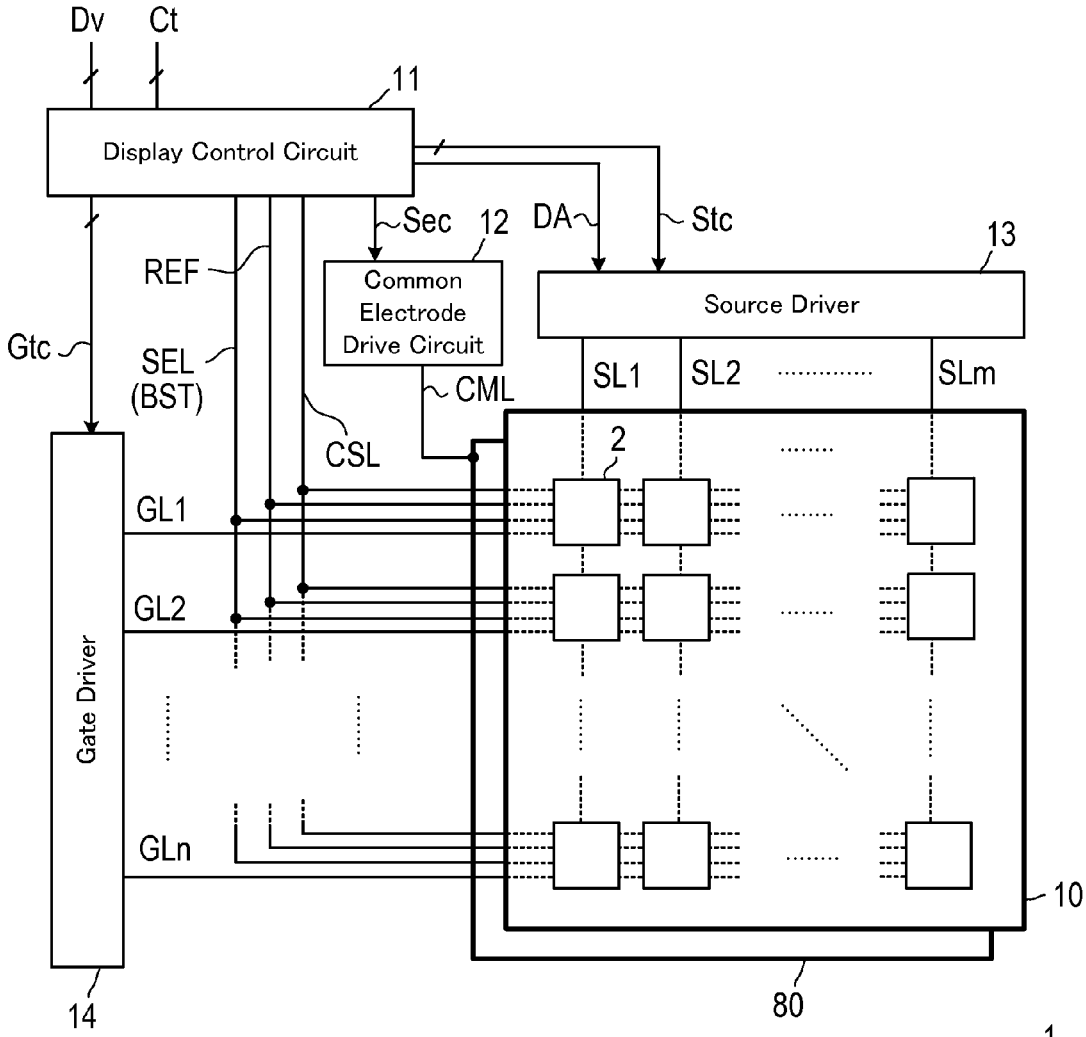
FIG. 5 is a block diagram showing an example of a schematic configuration of a display device according to the present invention.

As shown in FIG. 3 or 5, the selecting line SEL and the boost line BST are made common to each other, or, as shown in FIG. 4 or 5, the voltage supply line VSL is made common to the auxiliary capacitive line CSL or the reference line REF to make it possible to reduce the number of signal lines to be arranged on the active matrix substrate 10 and to increase an aperture ratio of each pixel.

The reference line REF, the selecting line SEL, and the boost line BST correspond to a "first control line", a "second control line", and a "third control line", and are driven by the display control circuit 11. The auxiliary capacitive line CSL corresponds to a "fourth control line" or a "fixed voltage line", and is driven by the display control circuit 11 for example.

In FIG. 1 and FIGS. 3 to 5, the reference line REF, the selecting line SEL, and the auxiliary capacitive line CSL are arranged for each row to extend in the row direction, and wires of the respective rows are connected to each other at a peripheral portion of the pixel circuit array to form a single wire. However, the wires of the respective rows are independently driven, and a common voltage may be able to be applied thereto depending on operating modes. Depending on a type of a circuit configuration of the pixel circuit 2 (will be described later), some or all of the reference lines REF, the selecting lines SEL, and the auxiliary capacitive lines CSL can also be arranged for each column to extend in the column direction. Basically, the reference line REF, the selecting line SEL, and the auxiliary capacitive line CSL are commonly used in the plurality of pixel circuits 2. When the boost line BST is arranged independently of the selecting line SEL, the boost line BST may be arranged by the same manner as that of the selecting line SEL.

The display control circuit 11 is a circuit that controls programming actions in a normal display mode and an always-on display mode and a self-refresh action and a self-polarity-inverting action in the always-on display mode as will be described later.

In the programming action, the display control circuit 11 receives a data signal Dv representing an image to be displayed and a timing signal Ct from an external signal source, and, based on the signals Dv and Ct, as signals to display an image on the display element unit 21 (see FIG. 6) of the pixel circuit array, generates a digital image signal DA and a data-side timing control signal Stc to be given to the source driver 13, a scanning-side timing control signal Gtc to be given to the gate driver 14, a counter voltage control signal Sec to be given to the counter electrode drive circuit 12, and signal voltages to be applied to the reference line REF, the selecting line SEL, the auxiliary capacitive line CSL, the boost line BST and the voltage supply line VSL, respectively.

The source driver 13 is a circuit that applies a source signal having a predetermined voltage amplitude at a predetermined timing to the source lines SL under the control of the display control circuit 11 in the programming action, the self-refresh action, and the self-polarity-inverting action.

In the programming action, the source driver 13, based on the digital image signal DA and the data-side timing control signal Stc, generates a voltage matched with a voltage level of a counter voltage Vcom corresponding to a pixel value of one display line represented by the digital image signal DA as source signals Sc1, Sc2, . . . , Scm every one-horizontal period (to be also referred to as a "1H period"). The voltage is a multi-tone analog voltage in the normal display mode, and is a two-tone (binary) voltage in the always-on display mode. The source signals are applied to the source lines SL1, SL2, . . . , SLm, respectively.

In the self-refresh action and the self-polarity-inverting action, the source driver 13 performs the same voltage application to all the source lines SL connected to the target pixel circuits 2 at the same timing under the control of the display control circuit 11 (will be described in detail later).

The gate driver 14 is a circuit that applies a gate signal having a predetermined voltage amplitude to the gate lines GL at a predetermined timing in the programming action, the self-refresh action, and the self-polarity-inverting action. The gate driver 14, like the pixel circuit 2, may be formed on the active matrix substrate 10.

In the programming action, the gate driver 14 sequentially selects the gate lines GL1, GL2, . . . , GLn every almost one-horizontal period in each frame period of the digital image signal DA based on the scanning-side timing control signal Gtc to program the source signals Sc1, Sc2, . . . , Scm in the pixel circuits 2.

In the self-refresh action and the self-polarity-inverting action, the gate driver 14 performs the same voltage application at the same timing to all the gate lines GL connected to the target pixel circuits 2 under the control of the display control circuit 11 (will be described in detail later).

The counter electrode drive circuit 12 applies the counter voltage Vcom to the counter electrode 80 through a counter electrode wire CML. In the embodiment, the counter electrode drive circuit 12 outputs the counter voltage Vcom in the normal display mode and the always-on display mode such that the level of the counter voltage Vcom is alternately switched between a predetermined high level (5 V) and a predetermined low level (0 V). In this manner, it is called "counter AC drive" that the counter electrode 80 is driven while switching the counter voltage Vcom between the high level and the low level.

The "counter AC drive" in the normal display mode switches the counter voltage Vcom between the high level and the low level every one-horizontal period and one-frame period. That is, in a certain one-frame period, in two sequential horizontal periods, a voltage polarity across the counter electrode 80 and the pixel electrode 20 changes. That is, in a certain one-frame period, in two sequential horizontal periods, a voltage polarity across the counter electrode 80 and the pixel electrode 20 changes.

On the other hand, in the always-on display mode, although the same voltage level is maintained in one-frame period, the voltage polarity across the counter electrode 80 and the pixel electrode 20 changes in two sequential programming actions.

When a voltage having the same polarity is continuously applied across the counter electrode 80 and the pixel electrode 20, a display screen burns in (surface burn-in), and the polarity inverting action is required. However, the "counter AC drive" is employed, an amplitude of a voltage applied to the pixel electrode 20 in the polarity inverting action can be reduced.

<<Pixel Circuit>>

A configuration of the pixel circuit 2 will be described below with reference to FIGS. 6 to 23.

Figure 6:
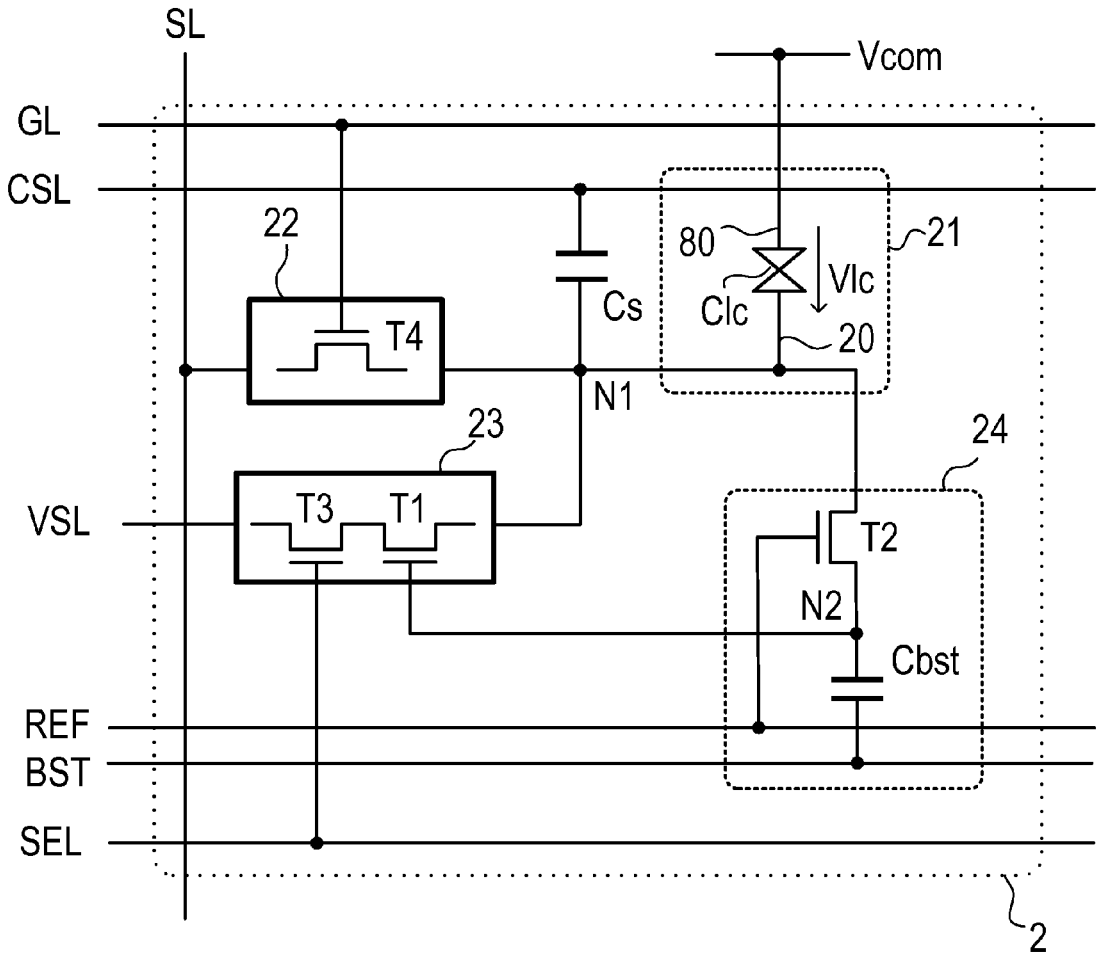
FIG. 6 is a circuit diagram showing a basic circuit configuration of a pixel circuit of the present invention.
Figure 7:
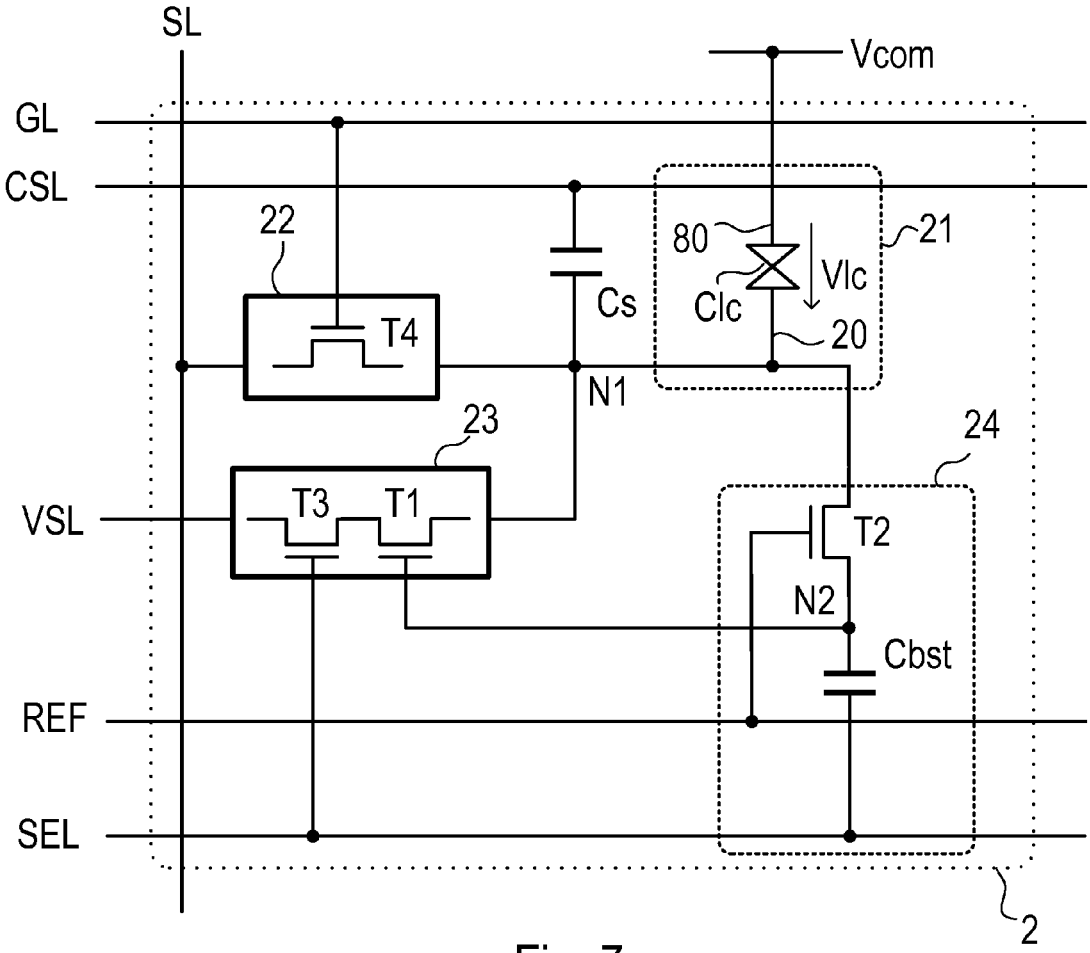
FIG. 7 is a circuit diagram showing another basic circuit configuration of the pixel circuit of the present invention.

FIGS. 6 and 7 show a basic circuit configuration of the pixel circuit 2 of the present invention. The pixel circuit 2, being common in all circuit configurations, includes a display element unit 21 including the unit liquid crystal display element Clc, a first switch circuit 22, a second switch circuit 23, a control circuit 24, and an auxiliary capacitor element Cs. The auxiliary capacitor element Cs corresponds to a "second capacitor element".

FIG. 6 corresponds to a basic configuration of each pixel circuit belonging to a group X (will be described later), and FIG. 7 corresponds to a basic configuration of each pixel circuit belonging to a group Y (will be described later). Since the unit liquid crystal display element Clc has been described with reference to FIG. 2, an explanation thereof will be omitted.

The pixel electrode 20 is connected to one terminal of the first switch circuit 22, the second switch circuit 23, and the control circuit 24 to form an internal node N1. The internal node N1 holds a voltage of pixel data supplied from the source line SL in the programming action.

The auxiliary capacitor element Cs has one terminal connected to the internal node N1 and the other terminal connected to the auxiliary capacitive line CSL. The auxiliary capacitor element Cs is additionally arranged to make it possible to cause the internal node N1 to stably hold the voltage of the pixel data.

The first switch circuit 22 has one terminal on which the internal node N1 is not configured and that is connected to the source line SL. The first switch circuit 22 includes a transistor T4 that functions as a switch element. The transistor T4 means the transistor having a control terminal connected to the gate line and corresponds to a "fourth transistor". When at least the transistor T4 is in an off state, the first switch circuit 22 is set to a non-conducting state, and an electrical connection between the source line SL and the internal node N1 is interrupted.

The second switch circuit 23 is connected to the voltage supply line VSL at one terminal on which the internal node N1 is not configured. The second switch circuit 23 includes a series circuit of a transistor T1 and a transistor T3. The transistor T1 means a transistor having a control terminal that is connected to an output node N2 of the control circuit 24, and corresponds to a "first transistor element". The transistor T3 means a transistor having a control terminal that is connected to the selecting line SEL, and corresponds to a "third transistor element". When both the transistor T1 and the transistor T3 are turned on, a second switch circuit 21 becomes in a conducting state, and a conducting state between the voltage supply line VSL and the internal node N1 is set.

The control circuit 24 includes a series circuit of the transistor T2 and a boost capacitor element Cbst. A first terminal of the transistor T2 is connected to the internal node N1, and a control terminal thereof is connected to the reference line REF. The second terminal of the transistor T2 is connected to the first terminal of the boost capacitor element Cbst and the control terminal of the transistor T1 to form an output node N2. The second terminal of the boost capacitor element Cbst is connected to the boost line BST as shown in FIG. 6 (group X) or connected to the selecting line SEL as shown in FIG. 7 (group Y).

One terminal of the auxiliary capacitor element Cs and one terminal of the liquid crystal capacitor element Clc are connected to the internal node N1. In order to avoid reference numerals from being complicated, an electrostatic capacitance (called an "auxiliary capacitance") of the auxiliary capacitor element is expressed by Cs, and an electrostatic capacitance (called a "liquid crystal capacitance") of a liquid crystal capacitor element is expressed by Clc. At this time, a full capacitance being parasitic in the internal node N1, i.e., a pixel capacitance Cp in which pixel data is programmed and that is to be held is approximately expressed by a sum of the liquid crystal capacitance Clc and the auxiliary capacitance Cs ($Cp \approx Clc+Cs$).

At this time, the boost capacitor element Cbst is set to establish $Cbst \ll Cp$ when the electrostatic capacitance (called a "boost capacitance") is described as Cbst.

The output node N2 holds a voltage depending on a voltage level of the internal node N1 when the transistor T2 is turned on, and holds the initial hold voltage when the transistor T2 is turned off even though the voltage level of the internal node N1 changes. By the hold voltage of the output node N2, the transistor T1 of the second switch circuit 23 is on/off-controlled.

All the transistors T1 to T4 of four types are thin film transistors such as polycrystalline silicon TFTs or amorphous silicon TFTs formed on the active matrix substrate 10. One of the first and second terminals corresponds to a drain electrode, the other corresponds to a source electrode, and the control terminal corresponds to a gate electrode. Furthermore, each of the transistors T1 to T4 may be configured by a single transistor element. When a request to suppress a leakage current in an off state is high, the plurality of transistors may be connected in series with each other to commonly use the control terminal. In an explanation of action of the pixel circuit 2, as all the transistors T1 to T4, N-channel type polycrystalline silicon TFTs each having a threshold voltage of about 2 V are supposed.

The pixel circuit 2, as will be described later, may have various circuit configurations. However, the circuit configurations may be patterned as follows.

1) With respect to the configuration of the first switch circuit 22, two patterns, i.e., a pattern in which the first switch circuit 22 is configured by only the transistor T4 and a pattern in which the first switch circuit 22 is configured by a series circuit of the transistor T4 and another transistor element are possible. In the latter, as another transistor element configuring the series circuit, the transistor T3 in the second switch circuit 23 can be used, or another transistor element having the control terminal connected to the control terminal of the transistor T3 in the second switch circuit 23 can also be used.

2) With respect to a signal line connected to a second terminal (terminal on an opposite side of the terminal forming the output node N2) of the boost capacitor element Cbst, two patterns, i.e., a pattern in which the signal line is connected to the boost line BST and a pattern in which the signal line is connected to the selecting line SEL are possible. In the latter, the selecting line SEL also serves as the boost line BST. As described above, the former corresponds to FIG. 6, and the latter corresponds to FIG. 7.

3) With respect to the voltage supply line VSL, three patterns, i.e., a pattern in which the voltage supply line VSL also serves as the reference line REF and is common to the reference line REF, a pattern in which the voltage supply line VSL also serves as the auxiliary capacitive line CSL and is common to the auxiliary capacitive line CSL, and a pattern in which an independent signal line is used are possible.

In the following, the pixel circuits 2 will be organized in units of types based on the 1) to 3). More specifically, two groups (X, Y) are defined depending on whether a signal line connected to the second terminal of the boost capacitor element Cbst is the boost line BST or the selecting line SEL, and, for each of the groups, combinations of the configuration of the first switch circuit 22 and the configuration of the voltage supply line VSL are classified into six types.

More specifically, cases in each of which the first switch circuit 22 is configured by only the transistor T4 are defined as first to third types, and cases in each of which the first switch circuit 22 is configured by a series circuit of the transistor T4 and another transistor element are defined as fourth to sixth types. Of the types, each of the first and fourth types has a configuration in which the voltage supply line VSL is common to the reference line REF, each of the second and fifth types has a configuration in which the voltage supply line VSL is common to the auxiliary capacitive line CSL, and each of the third and sixth type has a configuration in which the voltage supply line VSL is formed by an independent signal line.

Even pixel circuits of the same type belonging to the same group may have a plurality of modified patterns depending on a change of an arrangement position of the transistor T3 in the second switch circuit 23.

<1. Group X>

A pixel circuit in which the boost line BST is connected to the second terminal of the boost capacitor element Cbst and that belongs to the group X will be described first.

At this time, as described above, depending on the configurations of the voltage supply line VSL and the first switch circuit 22, pixel circuits 2A to 2F of the first to sixth types shown in FIGS. 8 to 17 are supposed.

Figure 8:
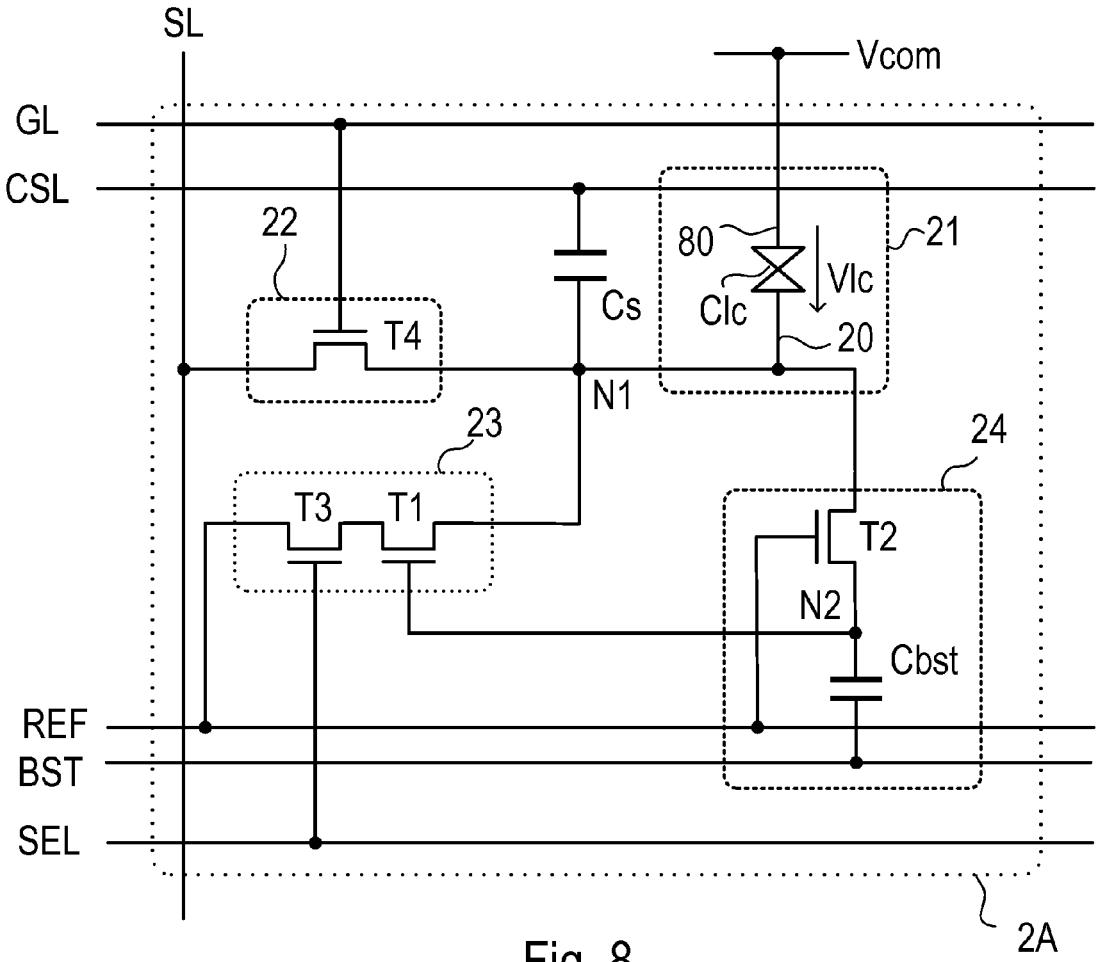
FIG. 8 is a circuit diagram showing a circuit configuration of a first type belonging to a group X of the pixel circuit of the present invention.

In the pixel circuit 2A of the first type shown in FIG. 8, the first switch circuit 22 is configured by only the transistor T4, and the voltage supply line VSL is common to the reference line REF. The reference line REF extends in a horizontal direction (row direction) in parallel with, for example, the gate line GL. However, the reference line REF may extend in a vertical direction (column direction) in parallel with the source line SL.

Figure 9:
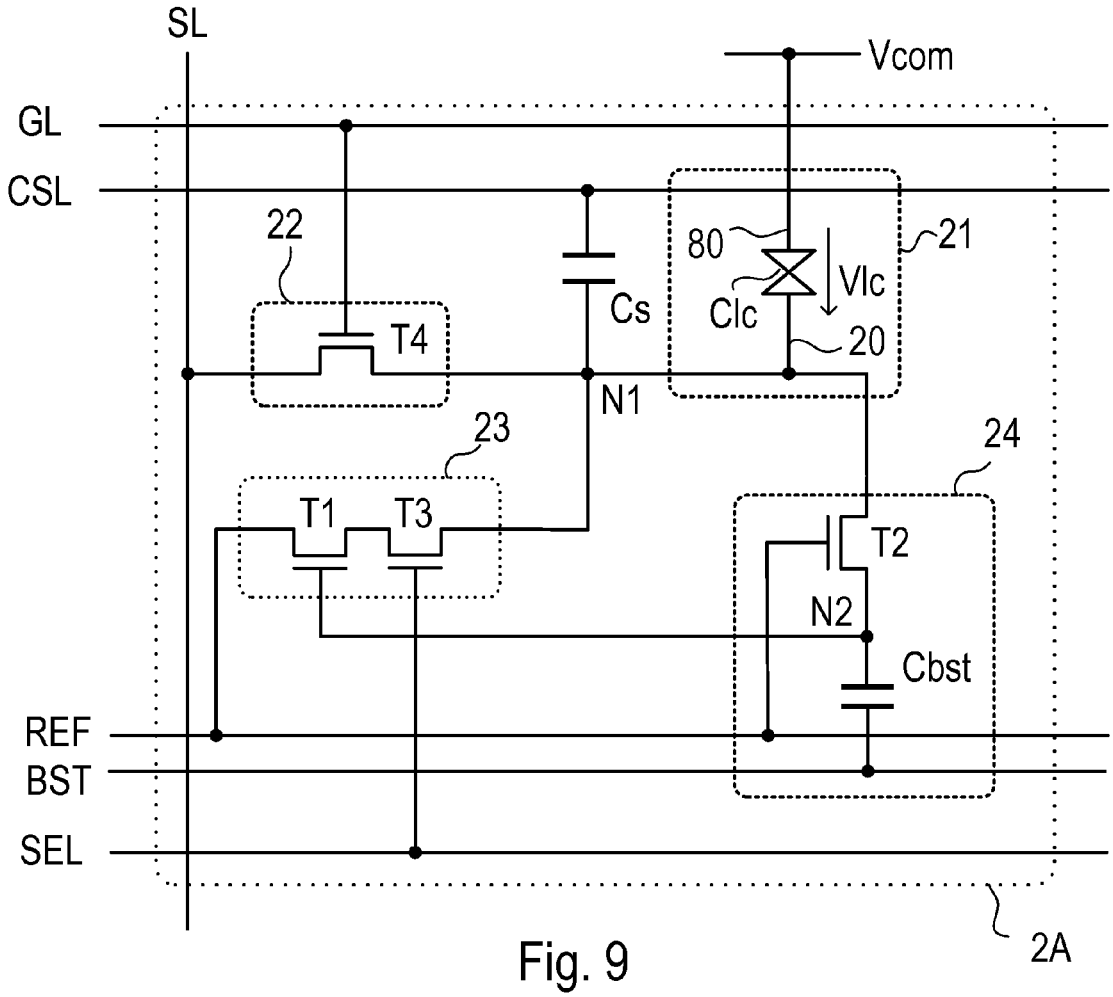
FIG. 9 is a circuit diagram showing another circuit configuration of the first type belonging to the group X of the pixel circuit of the present invention.
Figure 10:
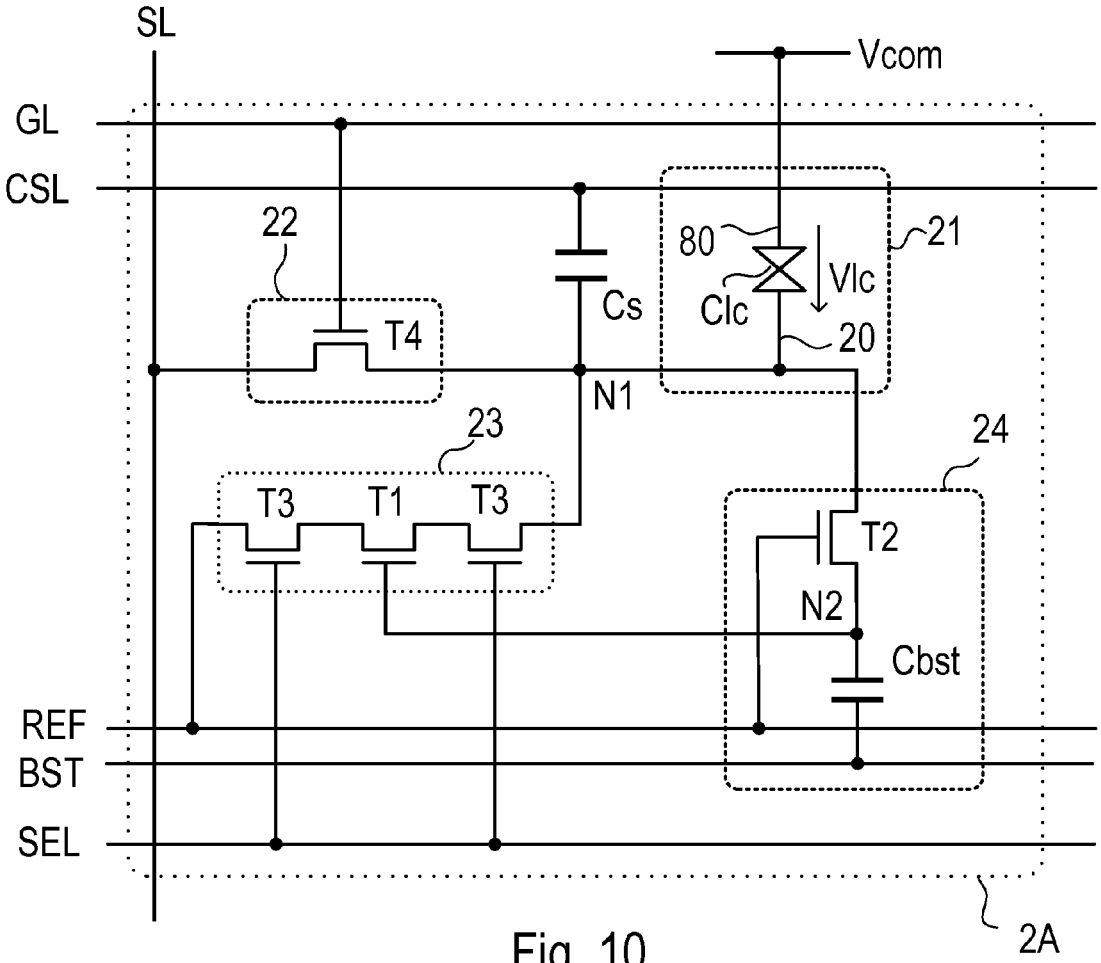
FIG. 10 is a circuit diagram showing still another circuit configuration of the first type belonging to the group X of the pixel circuit of the present invention.

In FIG. 8, the second switch circuit 23 is configured by a series circuit of the transistor T1 and the transistor T3. As an example, a configuration in which the first terminal of the transistor T1 is connected to the internal node N1, the second terminal of the transistor T1 is connected to the first terminal of the transistor T3, and the second terminal of the transistor T3 is connected to the source line SL is shown. However, the arrangements of the transistor T1 and the transistor T3 of the series circuit may be replaced with each other, and a circuit configuration in which the transistor T1 is interposed between the two transistors T3 may be used. The two modified circuit configurations are shown in FIG. 9 and FIG. 10.

Figure 11:
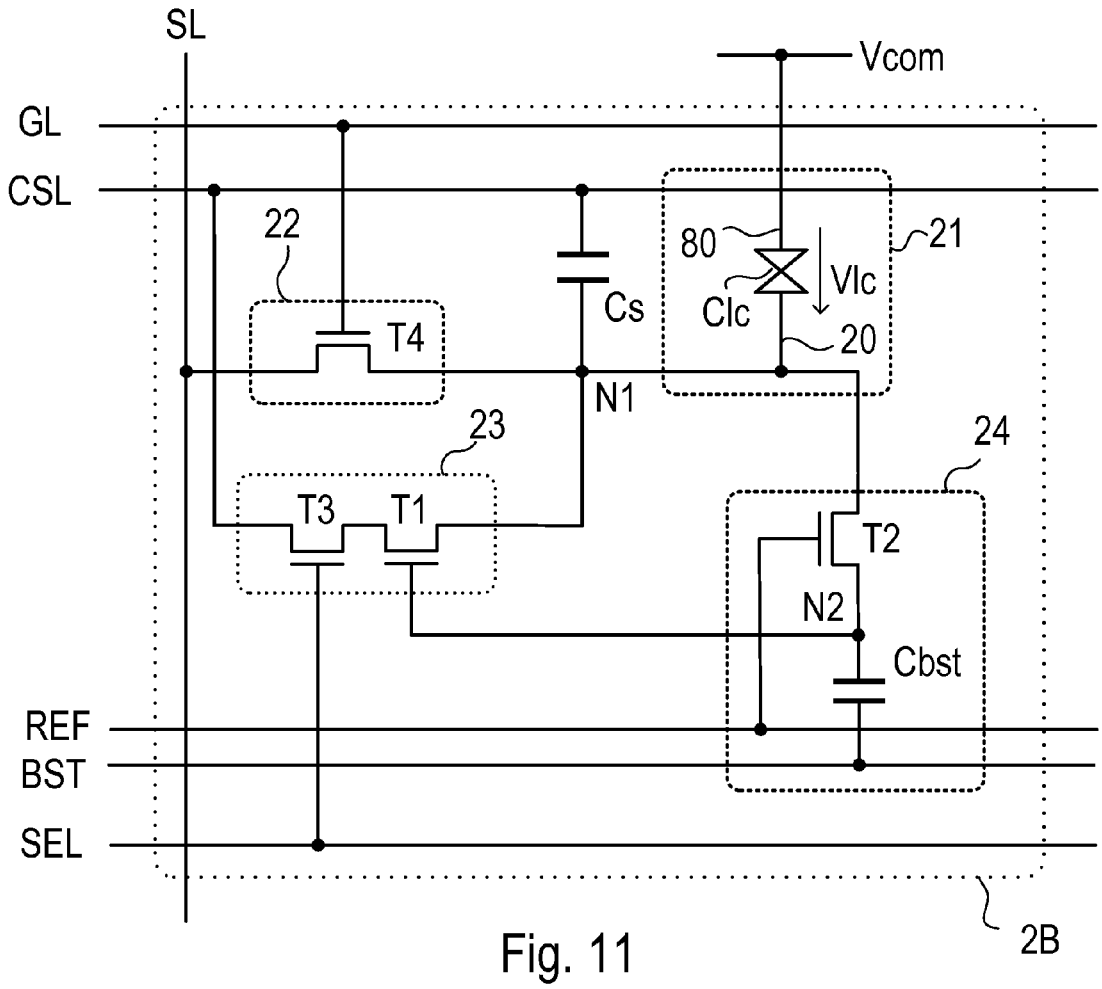
FIG. 11 is a circuit diagram showing a circuit configuration of a second type belonging to the group X of the pixel circuit of the present invention.

In the pixel circuit 2B of the second type shown in FIG. 11, the first switch circuit 22 is configured by only the transistor T4, and the voltage supply line VSL is common to the auxiliary capacitive line CSL. The auxiliary capacitive line CSL extends in a horizontal direction (row direction) in parallel with, for example, the gate line GL. However, the auxiliary capacitive line CSL may extend in a vertical direction (column direction) in parallel with the source line SL.

Figure 12:
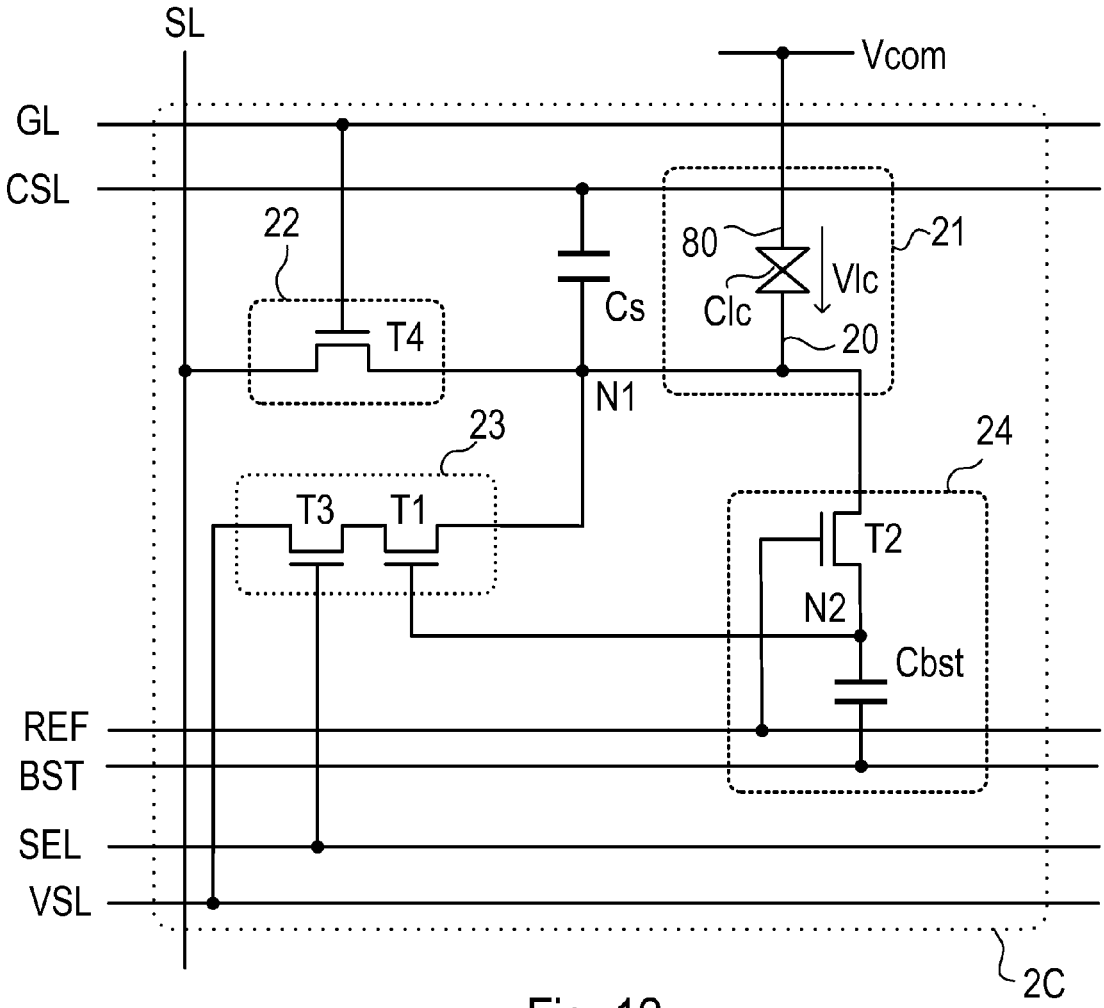
FIG. 12 is a circuit diagram showing a circuit configuration of a third type belonging to the group X of the pixel circuit of the present invention.

In the pixel circuit 2C of the third type shown in FIG. 12, the first switch circuit 22 is configured by only the transistor T4, and the voltage supply line VSL is configured by an independent signal line. In FIG. 12, the voltage supply line VSL extends in a horizontal direction (row direction) in parallel with, for example, the gate line GL. However, the voltage supply line VSL may extend in a vertical direction (column direction) in parallel with the source line SL.

Even in the second and third types, as in the first type, a modified circuit depending on the configuration of the second switch circuit 23 can be realized.

Figure 13:
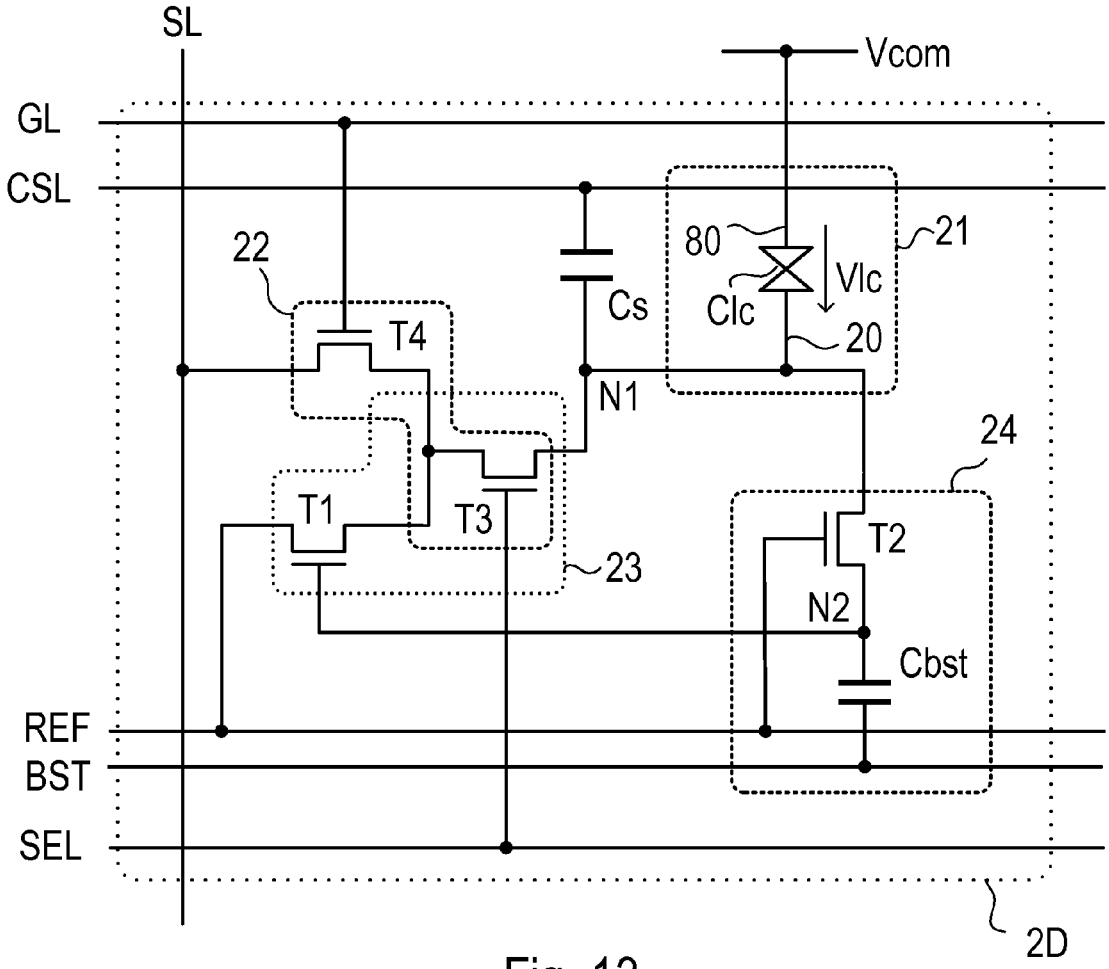
FIG. 13 is a circuit diagram showing a circuit configuration of a fourth type belonging to the group X of the pixel circuit of the present invention.

The pixel circuit 2D of the fourth type shown in FIG. 13 is common to the pixel circuit 2A of the first type shown in FIG. 8 except that the first switch circuit 22 is configured by a series circuit of the transistor T4 and another transistor element.

In FIG. 13, as the transistor element except for the transistor T4 configuring the first switch circuit 22, a transistor in the second switch circuit 23 is also used. More specifically, the first switch circuit 22 is configured by a series circuit of the transistor T4 and the transistor T3, and the second switch circuit 23 is configured by a series circuit of the transistor T1 and the transistor T3. The first terminal of the transistor T3 is connected to the internal node N1, the second terminal of the transistor T3 is connected to the first terminal of the transistor T1 and the first terminal of the transistor T4, the second terminal of the transistor T4 is connected to the source line SL, and the second terminal of the transistor T1 is connected to the voltage supply line VSL.

More specifically, in the pixel circuit 2D of the fourth type, the conducting state of the first switch circuit 22 is controlled by, in addition to the gate line GL, the selecting line SEL.

Figure 14:
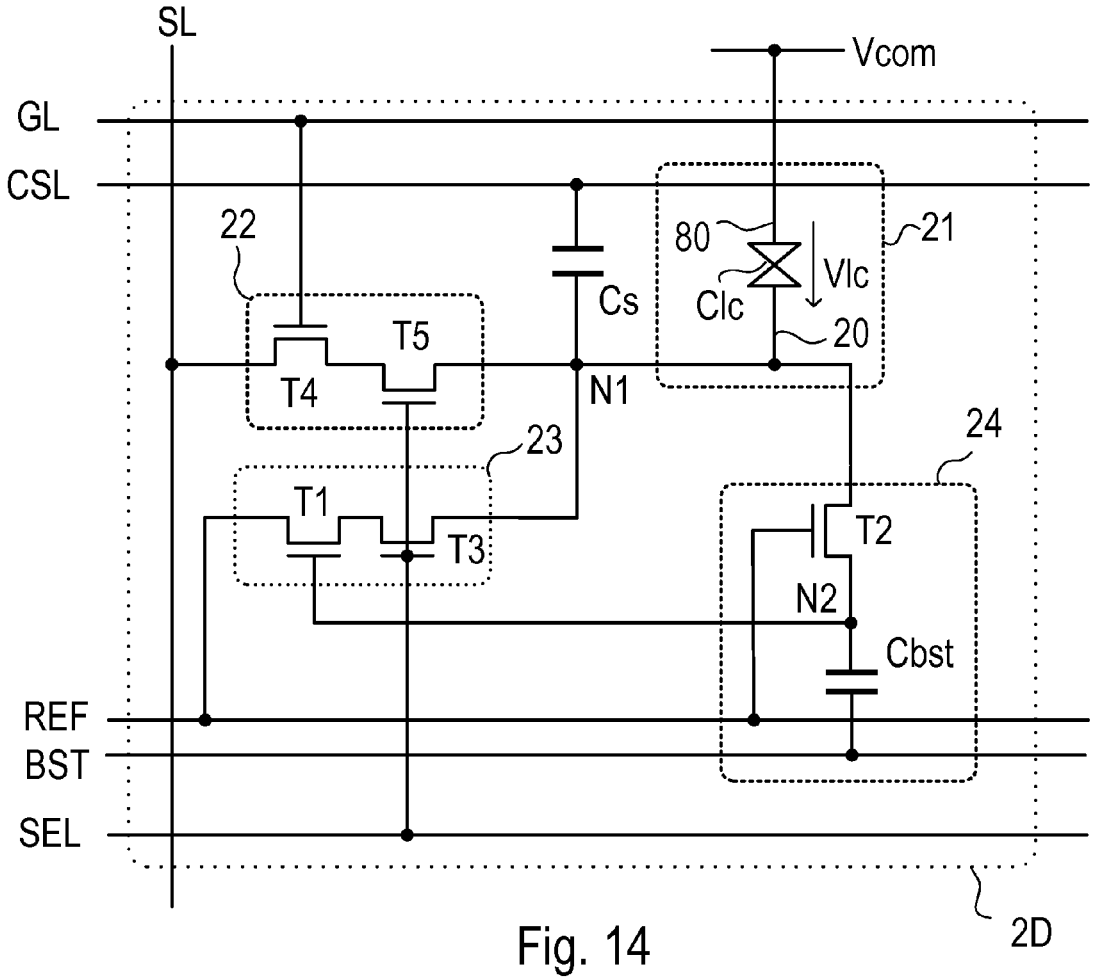
FIG. 14 is a circuit diagram showing another circuit configuration of the fourth type belonging to the group X of the pixel circuit of the present invention.

As a modification of the fourth type, as shown in FIG. 14, a configuration using, as the transistor element except for the transistor T4 configuring the first switch circuit 22, the transistor T5 having the control terminal connected to the control terminal of the transistor T3 in the second switch circuit 23 can also be realized. The transistor T5 corresponds to a "fifth transistor element".

In the pixel circuit 2D shown in FIG. 14, since the control terminals of the transistor T5 and the transistor T3 are connected to each other, the transistor T5 is on/off-controlled by the selecting line SEL like the transistor T3. The configuration is common to the configuration in FIG. 13 because the transistor elements except for the transistor T4 configuring the first switch circuit 22 is on/off-controlled by the selecting line SEL.

In the fourth type, since the transistor T3 is shared by the first switch circuit 22 and the second switch circuit 23, unlike the configuration shown in FIG. 9, the arrangements of the transistors T1 and T3 in the second switch circuit 23 cannot be replaced with each other. On the other hand, as shown in FIG. 10, the transistor T1 can be sandwiched by the transistors T3. A modification obtained in this case is shown in FIG. 15.

Figure 16:
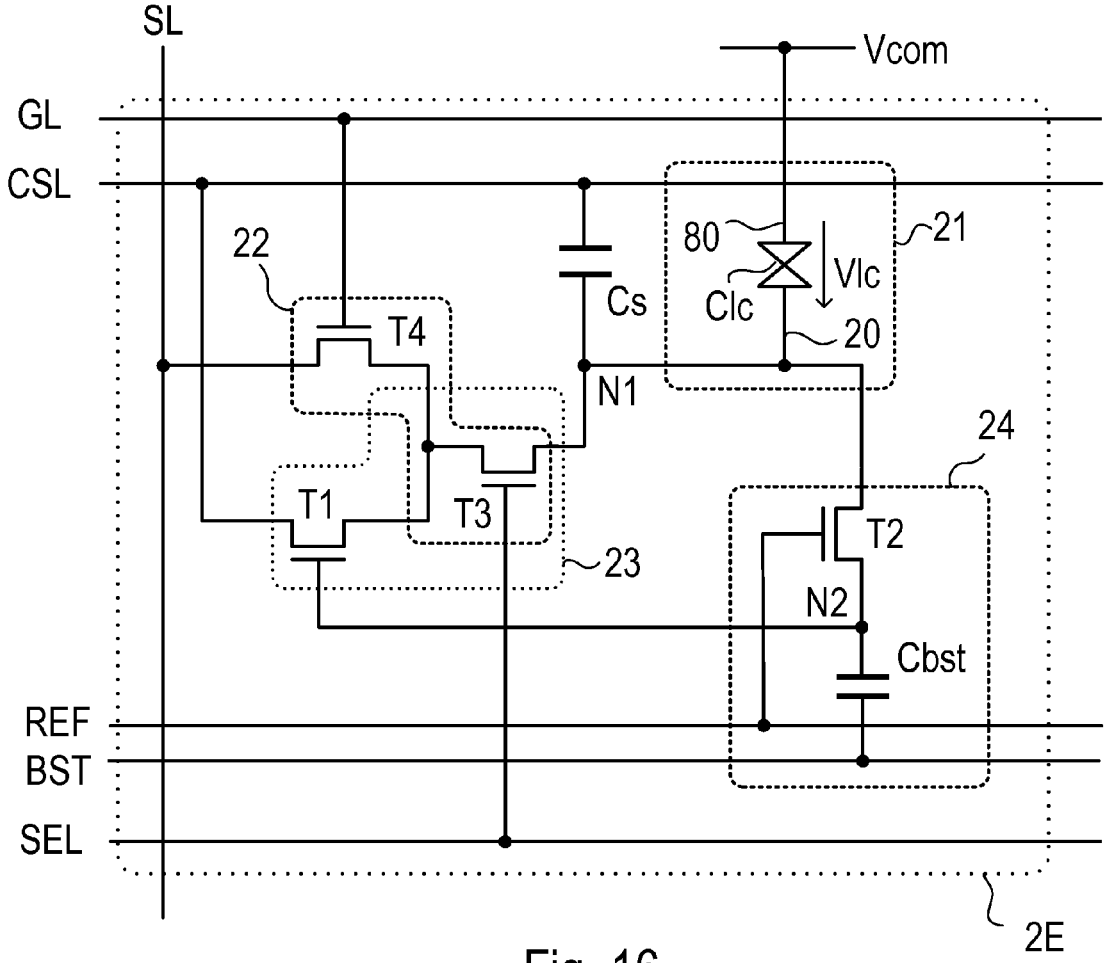
FIG. 16 is a circuit diagram showing a circuit configuration of a fifth type belonging to the group X of the pixel circuit of the present invention.

The configuration of the pixel circuit 2E of the fifth type shown in FIG. 16 is the same as that of the pixel circuit 2B of the second type shown in FIG. 11 except that the first switch circuit 22 is configured by a series circuit of the transistor T4 and another transistor element.

Figure 17:
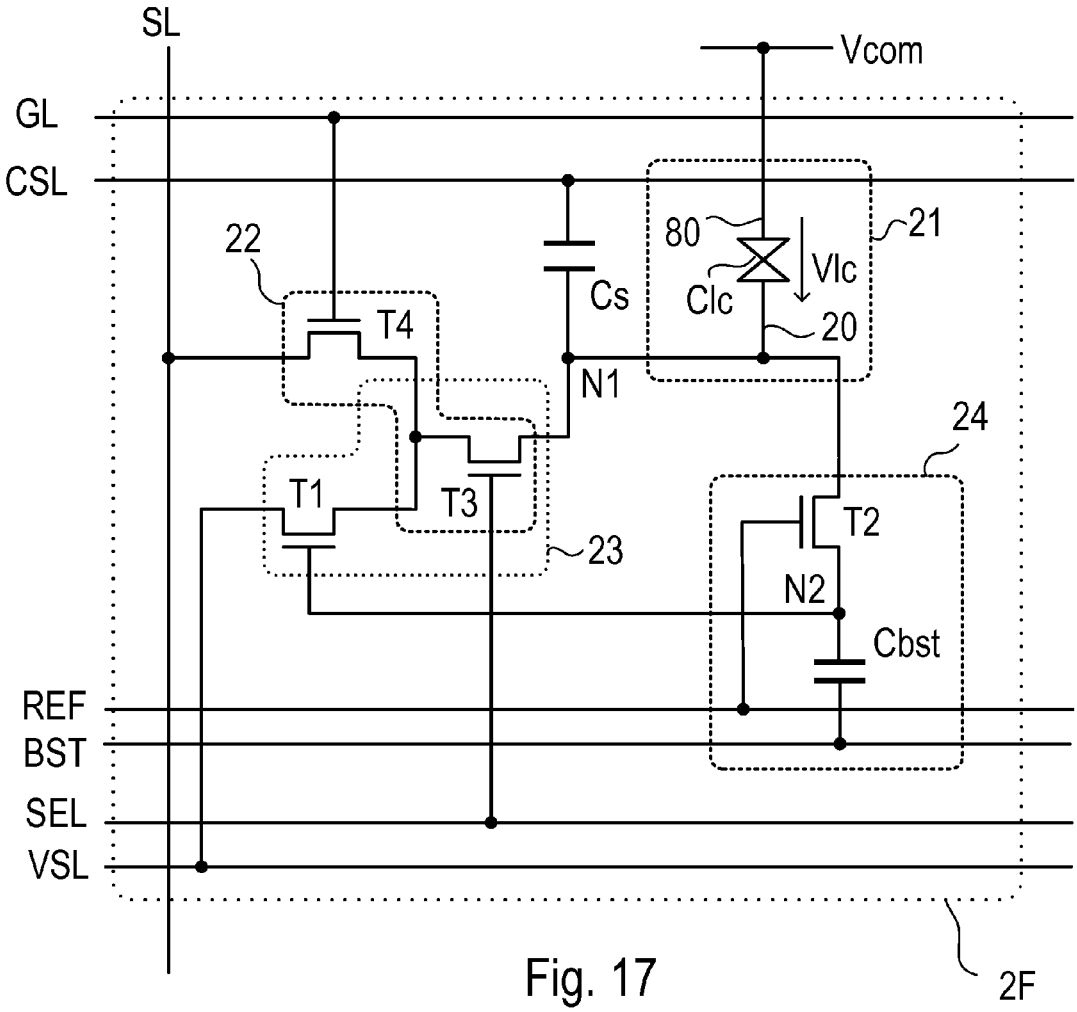
FIG. 17 is a circuit diagram showing a circuit configuration of a sixth type belonging to the group X of the pixel circuit of the present invention.

The pixel circuit 2F of the sixth type shown in FIG. 17 is common to the pixel circuit 2C of the third type shown in FIG. 12 except that the first switch circuit 22 is configured by a series circuit of the transistor T4 and another transistor element.

Figure 15:
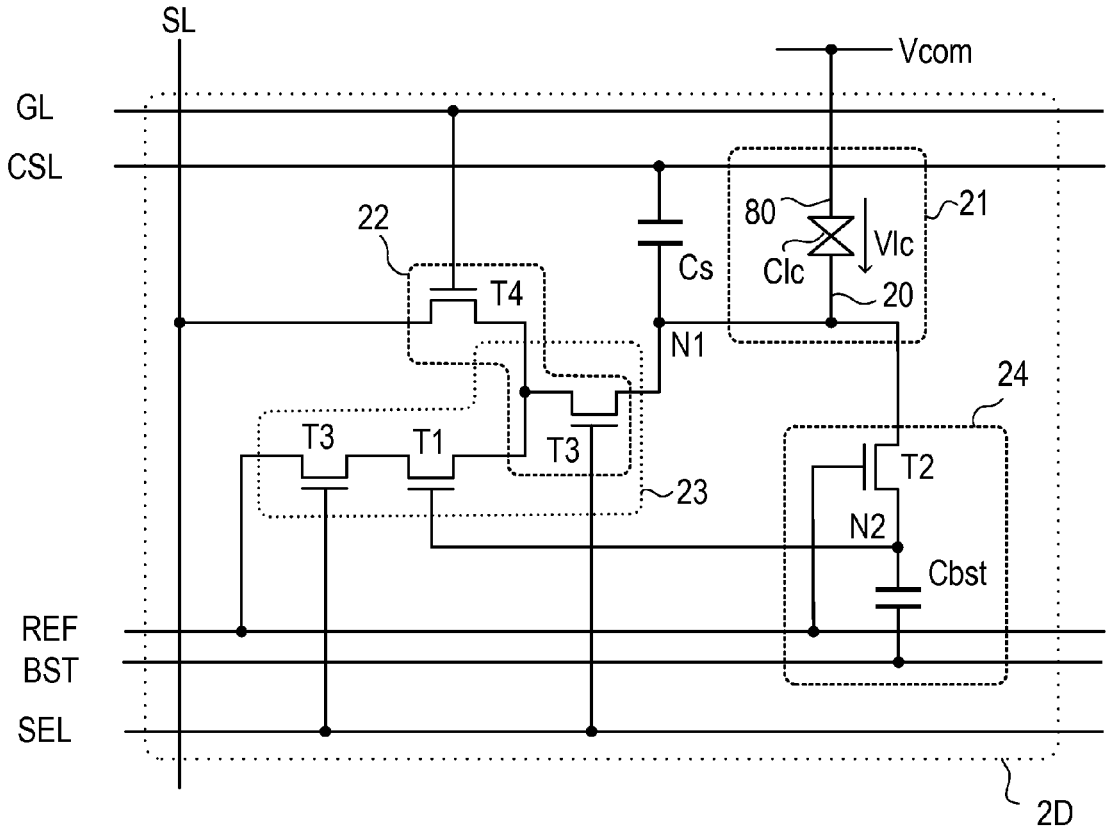
FIG. 15 is a circuit diagram showing still another circuit configuration of the fourth type belonging to the group X of the pixel circuit of the present invention.

Also in the fifth type and the sixth type, a modified circuit of the fourth type as shown in FIG. 15 can be realized.

<2. Group Y>

A pixel circuit in which the selecting line SEL is connected to the second terminal of the boost capacitor element Cbst and that belongs to the group Y will be described below.

As described above, the pixel circuits belonging to the first to sixth types of the group Y are different from the pixel circuits belonging to the first to sixth types of the group X in only that and the selecting line SEL is also used as the boost line BST by connecting the selecting line SEL to the control terminal of the transistor T3. Circuit diagrams of the pixel circuits 2*a* to 2*f* are shown in FIGS. 18 to 23.

In order to discriminate the pixel circuits between the groups X and Y, the reference symbols 2*a* to 2*f* of the pixel circuits of the group Y are expressed by using lower-case alphabets.

Second Embodiment

In the second embodiment, self-refresh actions performed by the pixel circuits of the first to sixth types of the groups X and Y will be described below with reference to the drawings.

The self-refresh action is an action in an always-on display mode, and is an action in which the first switch circuit 22, the second switch circuit 23, and the control circuit 24 are operated by a predetermined sequence to recover a potential (or a potential of the internal node N1) of the pixel electrode 20 to a potential programmed by an immediately previous programming action for the plurality of pixel circuits 2 at the same time in a lump. The self-refresh action is an action being unique to the present invention and performed by the pixel circuits described above. The self-refresh action can achieve a very low power consumption in comparison with an "external refresh action" that performs a normal programming action as in the conventional technique to recover the potential of the pixel electrode 20. The "the same time" in the "at the same time in a lump" is "the same time" having a time range of a series of self-refresh actions.

In the conventional technique, the programming action is performed to perform an action (external polarity inverting action) that inverts only a polarity of a liquid crystal voltage Vcl applied across the pixel electrode 20 and the counter electrode 80 while maintaining an absolute value of the liquid crystal voltage Vcl. When the external polarity inverting action is performed, the polarity is inverted, and the absolute value of the liquid crystal voltage Vcl is updated to an absolute value in a state at the time of an immediately previous programming action. More specifically, polarity inversion and refreshing are simultaneously performed. For this reason, although a refresh action is not normally executed to update only the absolute value of the liquid crystal voltage Vcl without inverting the polarity in the programming action, in terms of comparison with the self-refresh action, such a refresh action is called an "external refresh action" in the following explanation for descriptive convenience.

Even though the refresh action is executed by the external polarity inverting action, the programming action is still performed. More specifically, in comparison with the conventional method, a very low power consumption can also be achieved by the self-refresh action according to the embodiment.

Voltages are applied to all the gate lines GL, the source lines SL, the selecting lines SEL, the reference lines REF, the auxiliary capacitive lines CSL, the boost lines BST, and the counter electrode 80 that are connected to the pixel circuits 2 targeted by the self-refresh action at the same timing. When the voltage supply lines VSL are arranged as independent signal lines, voltage application to the voltage supply lines VSL is also performed at the same timing. At the same timing, the same voltage is applied to all the gate lines GL, the same voltage is applied to all the reference lines REF, the same voltage is applied to all the auxiliary capacitive lines CSL, and the same voltage is applied to all the boost lines BST. When the voltage supply lines VSL are arranged as independent signal lines, the same voltage is applied to all the voltage supply lines VSL. The timing control of the voltage applications is performed by the display control circuit 11, and the voltage applications are performed by the display control circuit 11, the counter electrode drive circuit 12, the source driver 13, and the gate driver 14, respectively.

In the always-on display mode according to the embodiment, since two-tone (binary) pixel data is held in units of pixel circuits, a pixel voltage V20 held in the pixel electrode 20 (internal node N1) exhibits two voltage states including a first voltage state and a second voltage state. In the embodiment, like the counter voltage Vcom described above, the first voltage state and the second voltage state will be explained as a high level (5 V) and a low level (0 V), respectively.

In a state immediately previous to the execution of the self-refresh action, it is supposed that a pixel in which a pixel electrode 20 is programmed with a high-level voltage and a pixel in which a pixel electrode is programmed with a low-level voltage are mixed. However, according to the self-refresh action of the embodiment, even though the pixel electrode 20 is programmed with any one of high-level and low-level voltages, a voltage applying process based on the same sequence is performed to make it possible to execute a refresh action to all the pixel circuits. This will be described below with reference to a timing chart and a circuit diagram.

A case in which a high-level voltage is programmed in the internal node N1 by an immediately previous programming action and recovered is called a "case A", and a case in which a low-level voltage is programmed in the internal node N1 by the previous programming action and recovered is called a "case B".

<1. Group X>

A self-refresh action for a pixel circuit in which the boost line BST is connected to the second terminal of the boost capacitor element Cbst and that belongs to the group X will be described first.

(First Type)

Figure 24:
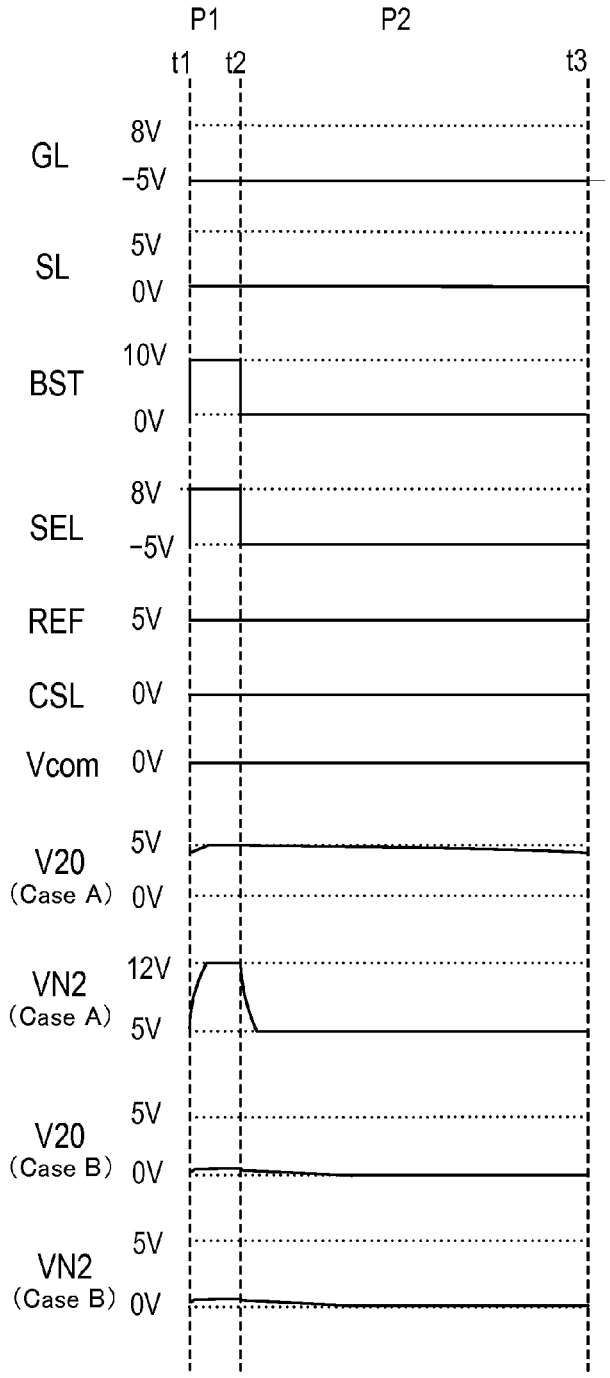
FIG. 24 is a timing chart of a self-refresh action performed by the pixel circuit of the first type of the group X.

FIG. 24 shows a timing chart of a self-refresh action in the pixel circuit 2A of the first type. As shown in FIG. 24, the self-refresh action is exploded into two phases P1 and P2. Start times of the phases are represented by t1 and t2, respectively. FIG. 24 shows voltage waveforms of all the gate lines GL, the source lines SL, the selecting lines SEL, the reference lines REF, the auxiliary capacitive lines CSL, and the boost lines BST that are connected to the pixel circuits 2A targeted by the self-refresh action, and a voltage waveform of the counter voltage Vcom. In the embodiment, all the pixel circuits of the pixel circuit array are targeted by the self-refresh action.

Furthermore, in FIG. 24, voltage waveforms of pixel voltages V20 of the internal nodes N1 in the case A and the case B and a voltage VN2 of the output node N2, and on/off states in the phases of the transistors T1 to T4 are shown.

It is assumed that, at a point of time before time t1, high-level programming is performed in the case A and low-level programming is performed in the case B.

When a time has elapsed after the programming action is executed, the pixel voltage V20 varies with generation of leakage currents of the transistors in the pixel circuit. In the case A, the pixel voltage V20 is 5 V immediately after the programming action. However, the value decreases to a value lower than the initial value with time. Similarly, in the case B, the pixel voltage V20 is 0 V immediately after the programming action. However, the value increases to a value larger than the initial value with time. This is shown in the figure such that the pixel voltage V20 in the case A exhibits a voltage slightly lower than 5 V at a point of time t1, and the pixel voltage V20 in the case B exhibits a voltage slightly higher than 0 V.

Voltage levels applied to the lines in units of phases will be described below.

<<Phase P1>>

In a phase P1 started from time t1, a voltage is applied to a gate line GL1 such that the transistor T4 is completely turned off. The voltage is set to −5 V here.

A voltage (5 V) corresponding to the first voltage state is applied to the reference line REF. The voltage is a voltage value such that the transistor T2 is set to a non-conducting state when the voltage state of the internal node N1 is at a high level (case A) and the transistor T2 is set to a conducting state when the voltage state is at a low level (case B).

A voltage (0 V) corresponding to the second voltage state is applied to the source line SL.

A voltage is applied to the selecting line SEL such that the transistor T3 is completely turned on. The voltage is set to 8 V here.

The counter voltage Vcom applied to the counter electrode 80 and a voltage applied to the auxiliary capacitive line CSL are set to 0 V. The above description means that the voltage is not limited to 0 V but still kept at a voltage value obtained at a point of time before time t1.

As will be described later in the fifth embodiment, since the transistor T2 is set in a conducting state in the programming action, the nodes N1 and N2 are set to high-level potential (5 V) in the case A in which high-level programming is performed, and the nodes N1 and N2 are set to low-level potential (0 V) in the case B in which low-level programming is performed.

Upon completion of the programming action, the transistor T2 is set to a non-conducting state. However, since the node N1 is disconnected from the source line SL, the potentials of the nodes N1 and N2 are still held. More specifically, the potentials of the nodes N1 and N2 immediately before time t1 are approximately 5 V in the case A and are approximately 0 V in the case B. The "approximately" is a description given in consideration of a variation in potential by generation of a leakage current.

When a voltage of 5 V is applied to the reference line REF at time t1, the nodes N1 and N2 are approximately 5 V in the case A. For this reason, a voltage Vgs between the gate and the source of the transistor T2 approximately becomes 0 V and is lower than a threshold voltage of 2 V, so that the transistor T2 is set to a non-conducting state. In contrast to this, in the case B, since the nodes N1 and N2 configuring the drain or the source of the transistor T2 are approximately set to 0 V, the voltage Vgs between the gate and the source of the transistor T2 approximately becomes 5 V and is higher than a threshold voltage of 2 V, so that the transistor T2 is set to a conducting state.

Strictly speaking, in the case A, the transistor T2 need not be completely in a non-conducting state, and electricity need only be prevented from being conducted from the node N2 to the node N1.

To the boost line BST, a high-level voltage is applied such that the transistor T1 is set to a conducting state when the voltage state of the node N1 is a high level (case A) and set to a non-conducting state when the voltage state is a low level (case B).

The boost line BST is connected to one terminal of the boost capacitor element Cbst. For this reason, when a high-voltage level is applied to the boost line BST, the potential of the other terminal of the boost capacitor element Cbst, i.e., the potential of the output node N2 is raised. In this manner, it will be called "boost raising" that the voltage applied to the boost line BST is increased to raise the potential of the output node N2.

As described above, in the case A, the transistor T2 is in a non-conducting state at time t1. For this reason, a variation in potential of the node N2 caused by boost raising is determined by a ratio of a boost capacitance Cbst to a full capacitance parasitic in the node N2. As an example, when the ratio is 0.7, a voltage of one electrode of a boost capacitor element increases by ΔVbst, and a voltage of the other electrode, i.e., the node N2, consequently increases by about 0.7ΔVbst.

In the case A, since the pixel voltage V20 approximately exhibits 5 V at time t1, the transistor T1 is set to a conducting state when a high potential higher than the pixel voltages V20 by the threshold voltage of 2 V is applied to the gate of the transistor T1, i.e., the output node N2. In the embodiment, a voltage applied to the boost line BST at time t1 is set to 10 V. In this case, the output node N2 consequently increases by 7 V. At a point of time immediately before time t1, since the node N2 exhibits a potential (5 V) almost equal to that of the node N1, the node N2 exhibits about 12 V by boost raising. Thus, since a potential difference that is equal to or higher than a threshold voltage is generated between the gate and the node N1 in the transistor T1, the transistor T1 is set to a conducting state.

On the other hand, in the case B, the transistor T2 is in a conducting state at time t1. More specifically, unlike in the case A, the output node N2 and the internal node N1 are electrically connected to each other. In this case, a variation in potential of the output node N2 caused by boost raising is influenced by, in addition to a boost capacitance Cbst and a full parasitic capacitance of the node N2, a full parasitic capacitance of the internal node N1.

One terminal of the auxiliary capacitor element Cs and one terminal of the liquid crystal capacitor element Clc are connected to the internal node N1, a full capacitance Cp being parasitic in the internal node N1 is approximately expressed by a sum of the liquid crystal capacitance Clc and the auxiliary capacitance Cs as described above. The boost capacitance Cbst has a value that is considerably smaller than that of a liquid crystal capacitance Cp. Therefore, a ratio of the boost capacitance to the total of capacitances is very low, for example, a value of 0.01 or less. In this case, when a potential of one electrode of the boost capacitor element increases by ΔVbst, a potential of the other electrode, i.e., the output node N2 increases by only about 0.01ΔVbst at most. More specifically, in the case B, ΔVbst=10 V is satisfied, a potential VN2 of the output node N2 rarely increases.

In the case B, since low-level programming is performed in the immediately previous programming action, the output node N2 exhibits about 0 V immediately before time t1. Therefore, even though boost raising is performed at time t1, a potential enough to set the transistor T1 to a conducting state is not given to the gate of the transistor T1. More specifically, unlike in the case A, the transistor T1 is still in a non-conducting state.

In the case B, a potential of the output node N2 immediately before time t1 is not necessarily 0 V, and it only has to be at least a potential that does not set T1 to a conducting state. Similarly, in the case A, a potential of the node N1 immediately before time t1 is not necessarily 5 V, and it only has to be a potential that sets the transistor T1 to a conducting state by performing boost raising when the transistor T2 is in a non-conducting state may be used.

In the case A, boost raising is performed to set the transistor T1 to a conducting state. Since a high-level voltage is applied to the selecting line SEL to set the transistor T3 to a conducting state, the second switch circuit 23 is set to a conducting state. Thus, the high-level voltage in the first voltage state applied to the reference line REF is applied to the internal node N1 through the second switch circuit 23. In this manner, the potential of the internal node N1, i.e., the pixel voltage V20 returns to the first voltage state. This is shown in FIG. 24 such that the value of the pixel voltage V20 returns to 5 V when a short period of time has elapsed from time t1.

On the other hand, in the case B, since the transistor T1 is still in a non-conducting state even after boost raising, the second switch circuit 23 is in a non-conducting state. Thus, the high-level voltage applied to the source line SL is not given to the node N1 through the second switch circuit 23. More specifically, the potential of the node N1 still exhibits a value at a level almost equal to that at time t1, i.e., approximately 0 V.

As described above, in the phase P1, a refresh action of the pixel voltage V20 (case A) programmed in the first voltage state is performed.

<<Phase P2>>

In a phase P2 started from time t2, voltages applied to the gate line GL, the source line SL, the reference line REF, and the auxiliary capacitive line CSL and the counter voltage Vcom are set to the same values as those in the phase 1.

A voltage that sets the transistor T3 to a non-conducting state is applied to the selecting line SEL. The voltage is set to −5 V here. In this manner, the second switch circuit 23 is set to a non-conducting state.

A voltage applied to the boost line BST is decreased to a voltage in a state before boost raising is performed. The voltage is set to 0 V. When the voltage of the boost line BST decreases, a potential of the node N1 is pushed down.

Also in the phase P2, the transistor T2 is in a conducting state in the case B. For this reason, even though the voltage of the boost line BST changes, the potential of the node N2 is rarely influenced. More specifically, the potential is maintained at about 0 V. The node N1 exhibits the same potential as that of the node N2.

In the phase P2, the same voltage state is maintained for a time considerably longer than that in the phase P1. Meanwhile, a low-level voltage (0 V) is applied to the source line SL. For this reason, due to generation of a leakage current in this period, the pixel voltage V20 in the case B changes to be close to 0 V with time. More specifically, at a point of time immediately before time t1, even though a potential of the pixel voltage V20 in the case B is higher than 0 V, the potential changes to be close to 0 V in the period of the phase P2.

On the other hand, in the case A, the potential of the pixel voltage V20 returns to 5 V by the phase P1. However, due to the presence of a leakage current thereafter, the potential gradually decreases with time.

As described above, in the phase P2, an action that causes the pixel voltage V20 (case B) programmed in the second voltage state to be gradually close to 0 V is performed. A so-called refresh action of the pixel voltage V20 programmed in the second voltage state is performed.

Thereafter, the phases P1 and P2 are repeated to make it possible to return the pixel voltages V20 in both the cases A and B to those in the immediately previous programming state.

As in the conventional technique, when a refresh action is to be performed by programming performed by voltage application through the source line SL, the gate lines GL need to be horizontally scanned one by one. For this reason, high-level voltages the number of which is the number (n) of gate lines need to be applied to the gate lines GL. Since a potential having the same level as a potential level programmed in the immediately previous programming action needs to be applied to the source lines SL, the source driver 13 needs to be driven n times at most.

In contrast to this, according to this embodiment, by simply applying pulse voltages to the selecting line SEL and the boost line BST once while applying a constant voltage (5 V) to the reference line REF, and thereafter maintaining a low-level potential, the potentials of the pixel electrodes 20 can be returned to a potential state in the programming action with respect to all the pixels. More specifically, in a 1-frame period, in order to return the potentials of the pixel electrodes 20 of the pixels, it is only necessary to change the voltages applied to the lines once. Meanwhile, a low-level voltage need only be applied to all the gate lines GL.

Thus, according to the self-refresh action of the embodiment, in comparison with a normal external refresh action, the number of times of voltage application to the gate lines GL and the number of times of voltage application to the source lines SL can be considerably reduced. Furthermore, the way of controlling the voltage application can also be simplified. For this reason, power consumptions of the gate driver 14 and the source driver 13 can be considerably reduced.

The self-refresh action of the embodiment will be concluded as follows. First, the first switch circuit 22 is in a non-conducting state in the phases P1 to P2. In the phase P1, the second switch circuit 23 is set to a conducting state in the case A, and a high-level voltage corresponding to the first voltage state is given from the reference line REF also serving as the voltage supply line VSL to the internal node N1. On the other hand, in the case B, the second switch circuit 23 is in a non-conducting state not to give the high-level voltage to the internal node N1. In the phase P2, the second switch circuit 23 is in a non-conducting state in both the cases A and B to prevent an applied voltage to the reference line REF also serving as the voltage supply line VSL from being supplied to the internal node N1.

(Second Type)

Figure 25:
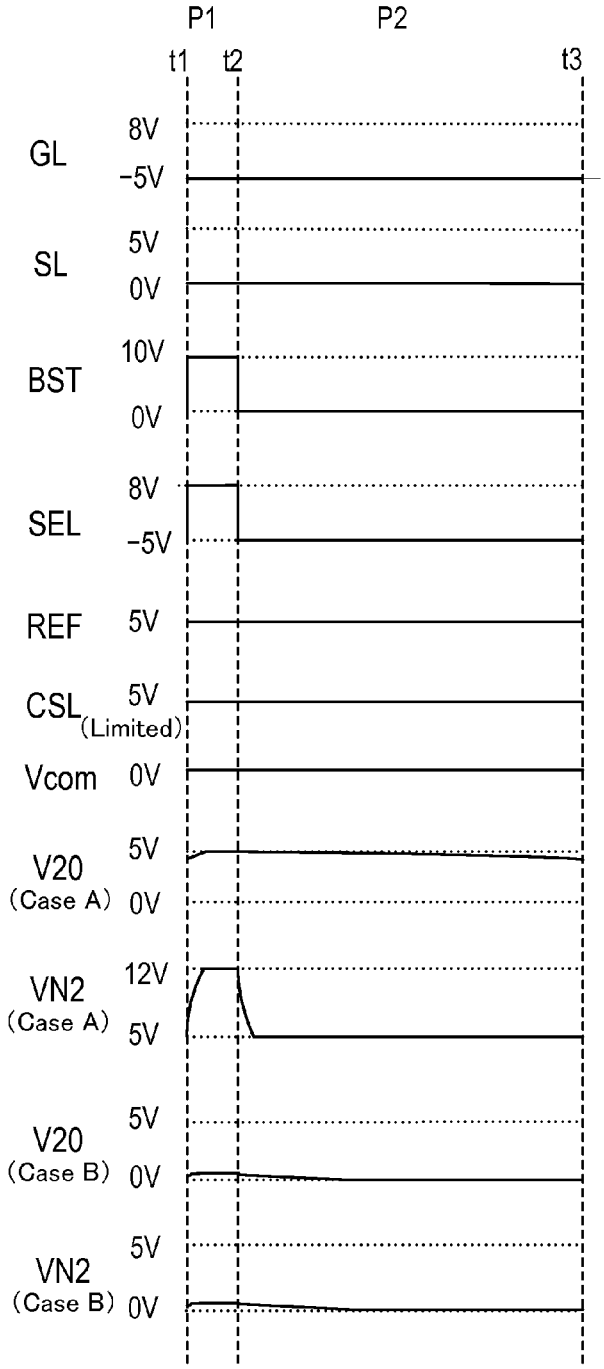
FIG. 25 is a timing chart of a self-refresh action performed by the pixel circuit of the second type of the group X.

The pixel circuit 2B of the second type shown in FIG. 11 has a configuration in which the voltage supply line VSL is common to the auxiliary capacitive line CSL. For this reason, the second type is different from the first type in that a high-level voltage (5 V) in the first voltage state is applied to the auxiliary capacitive line CSL in the phase P1. FIG. 25 shows a timing chart of a self-refresh action state in the pixel circuit of the second type.

In the second type, as will be described later, in a programming action in an always-on display mode, a voltage applied to the auxiliary capacitive line CSL is fixed to any one of the first voltage state (5 V) and the second voltage state (0 V). In the type, a self-refresh action can be executed when a voltage of 5 V is applied to the auxiliary capacitive line CSL in programming. At this time, also in the self-refresh action, an applied voltage (5 V) to the auxiliary capacitive line CSL is fixed. The other configurations are the same as those in the first type shown in FIG. 24. In FIG. 25, "5 V (limited)" is expressed in a column for the application of the auxiliary capacitive line CSL to clearly show that 0 V cannot be employed as an applied voltage to the auxiliary capacitive line CSL.

In the configuration described above, in the phase P1, since the second switch circuit 23 is set to a conducting state in the case A, a voltage (5 V) in the first voltage state is given from the auxiliary capacitive line CSL to the internal node N1 through the second switch circuit 23 to perform a refresh action. In the case B, since the second switch circuit 23 is in a non-conducting state, a low-level voltage of the internal node N1 is maintained.

(Third Type)

Figure 26:
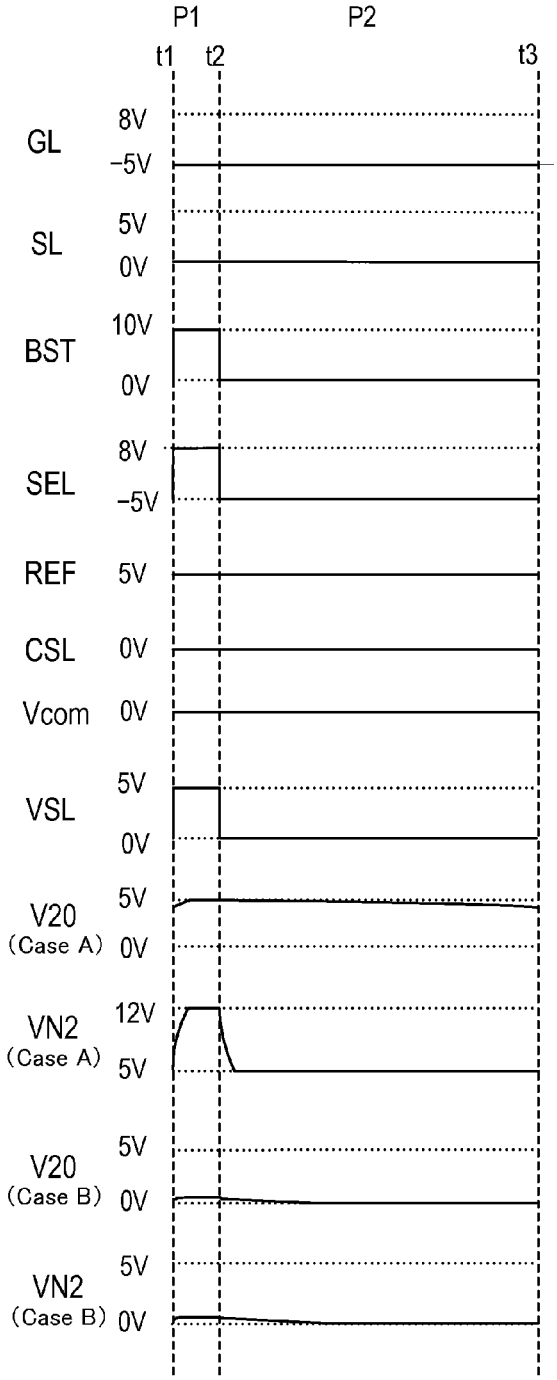
FIG. 26 is a timing chart of a self-refresh action performed by the pixel circuit of the third type of the group X.

The pixel circuit 2C of the third type shown in FIG. 12 has a configuration in which the voltage supply line VSL is not common to another signal line and is independently arranged. For this reason, the third type is different from the first type in that a high-level voltage (5 V) in the first voltage state is applied to the voltage supply line VSL in the phase P1 and a low-level voltage (0 V) in the second voltage state is applied in the phase P2. FIG. 26 shows a timing chart of a self-refresh action state in the pixel circuit of the third type.

In the configuration described above, in the phase P1, since the second switch circuit 23 is set to a conducting state in the case A, a voltage (5 V) in the first voltage state is given from the voltage supply line VSL to the internal node N1 through the second switch circuit 23 to perform a refresh action. In the case B, since the second switch circuit 23 is in a non-conducting state, a low-level voltage of the internal node N1 is maintained.

In the phase P2, since the second switch circuit 23 is in a non-conducting state, the voltage supply line VSL need not be necessarily decreased to the second voltage state (0 V), and the first voltage state (5 V) may be continuously maintained.

(Fourth Type)

The pixel circuit 2D of the fourth type shown in FIG. 13 is common to the pixel circuit 2A of the first type with respect to a point at which the reference line REF also serves as the voltage supply line VSL.

As described above, in the phase P1, the first switch circuit 22 is in a non-conducting state, and the second switch circuit 23 needs to be set to a conducting state in only the case A. In the pixel circuit 2D of the fourth type, since the second switch circuit 23 is configured by a series circuit of the transistors T1 and T3, the transistor T3 needs to be set in an on state in the phase P1.

The transistor T3 also configures one element of the first switch circuit 22. However, since the transistor T4 is in a non-conducting state in the phase P1 to make it possible to set the first switch circuit 22 to a non-conducting state, a problem is not posed. This can also be applied to a modification of the pixel circuit of the fourth type shown in FIG. 14.

Based on the above circumstances, the pixel circuit 2D of the fourth type can execute a self-refresh action by the same voltage applying method as that in the pixel circuit 2A of the first type shown in the timing chart of FIG. 24.

(Fifth Type)

The pixel circuit 2E of the fifth type shown in FIG. 16 is common to the pixel circuit 2B of the second type with respect to a point at which the auxiliary capacitive line CSL also serves as the voltage supply line VSL. A different point between the pixel circuits of the second type and the fifth type is the same as a different point between the pixel circuits of the first type and the fourth type.

Thus, according to the same theory as that in the fourth type, the pixel circuit 2E of the fifth type can execute a self-refresh action by the same voltage applying method as that in the pixel circuit 2B of the second type shown in the timing chart of FIG. 25.

(Sixth Type)

The pixel circuit 2F of the sixth type shown in FIG. 17 is common to the pixel circuit 2C of the third type with respect to a point at which the voltage supply line VSL is configured by an independent signal line. A different point between the pixel circuits of the third type and the sixth type is the same as a different point between the pixel circuits of the first type and the fourth type.

Thus, according to the same theory as that in the fourth type, the pixel circuit 2F of the sixth type can execute a self-refresh action by the same voltage applying method as that in the pixel circuit 2C of the third type shown in the timing chart of FIG. 26.

<2. Group Y>

A self-refresh action in each pixel circuit in which the selecting line SEL is connected to the second terminal of the boost capacitor element Cbst and that belongs to the group Y will be described below.

As is apparent from the timing chart of the self-refresh action in each of the pixel circuits of the group X as shown in FIGS. 24 to 26, in any case, voltage pulses are applied to the selecting line SEL and the boost line BST at the same timing. A voltage that sets the transistor T3 to a conducting state in the phase P1 and sets the transistor T3 to a non-conducting state in the phase P2 may be applied to the selecting line SEL.

Figure 27:
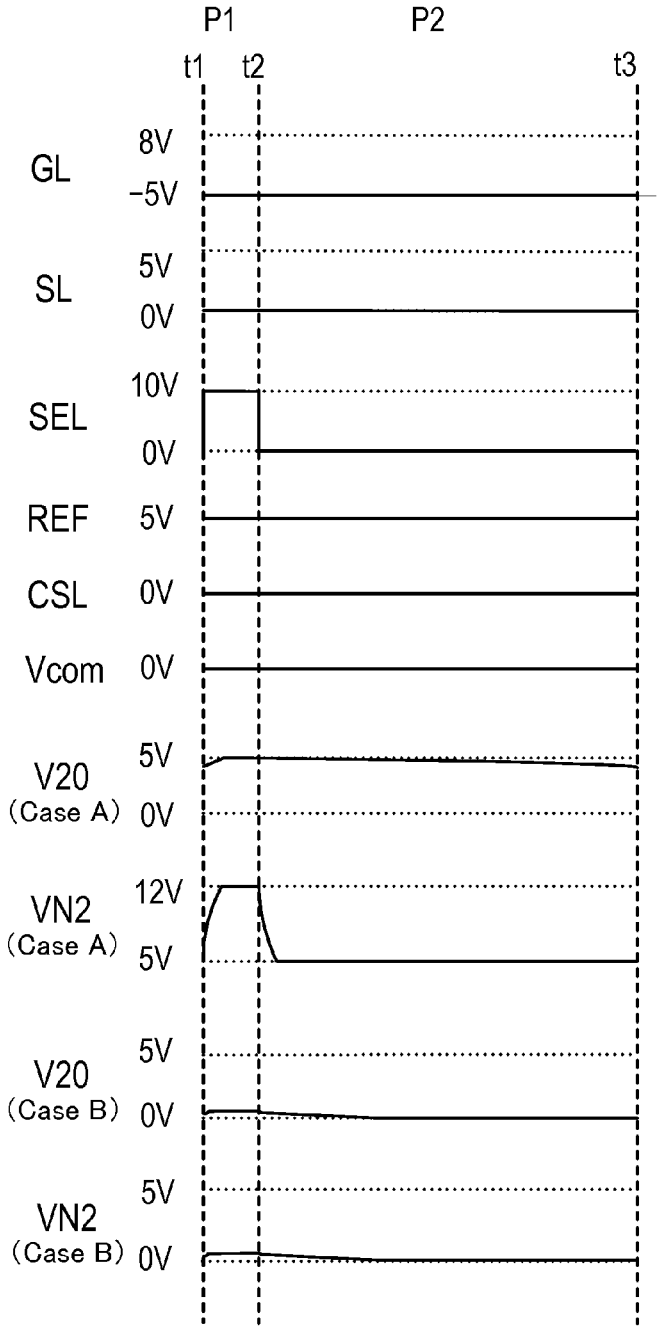
FIG. 27 is a timing chart of self-refresh actions performed by the pixel circuits of the first and fourth types of the group Y.
Figure 28:
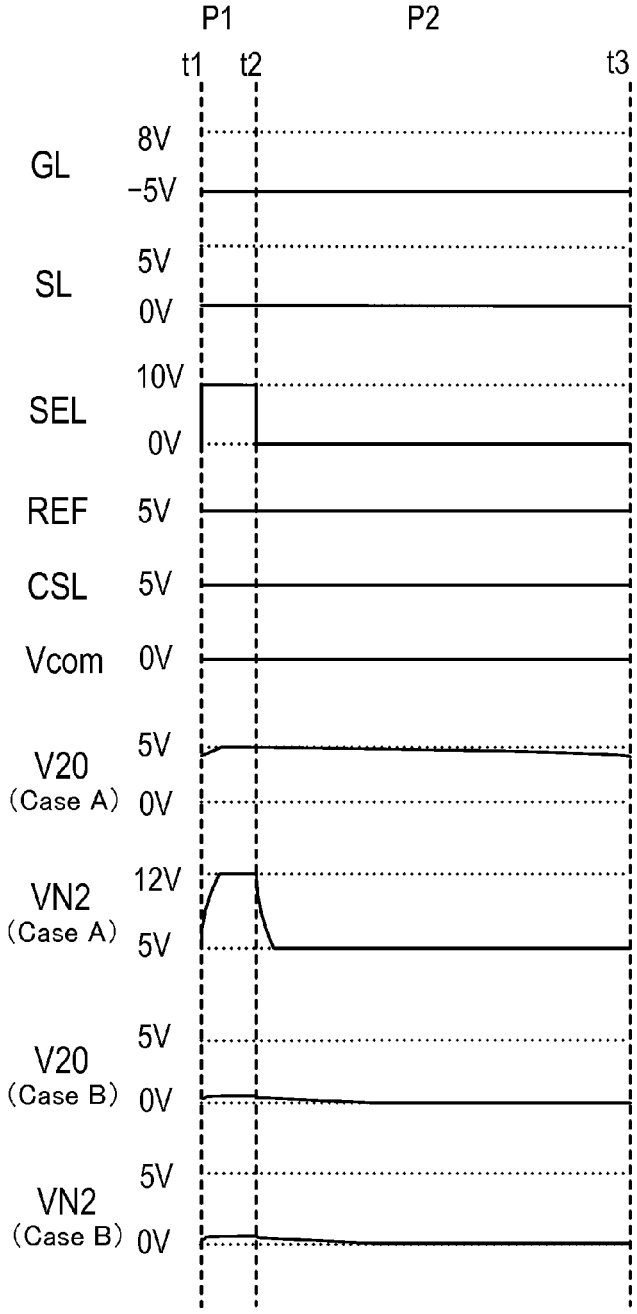
FIG. 28 is a timing chart of self-refresh actions performed by the pixel circuits of the second and fifth types of the group Y.
Figure 29:
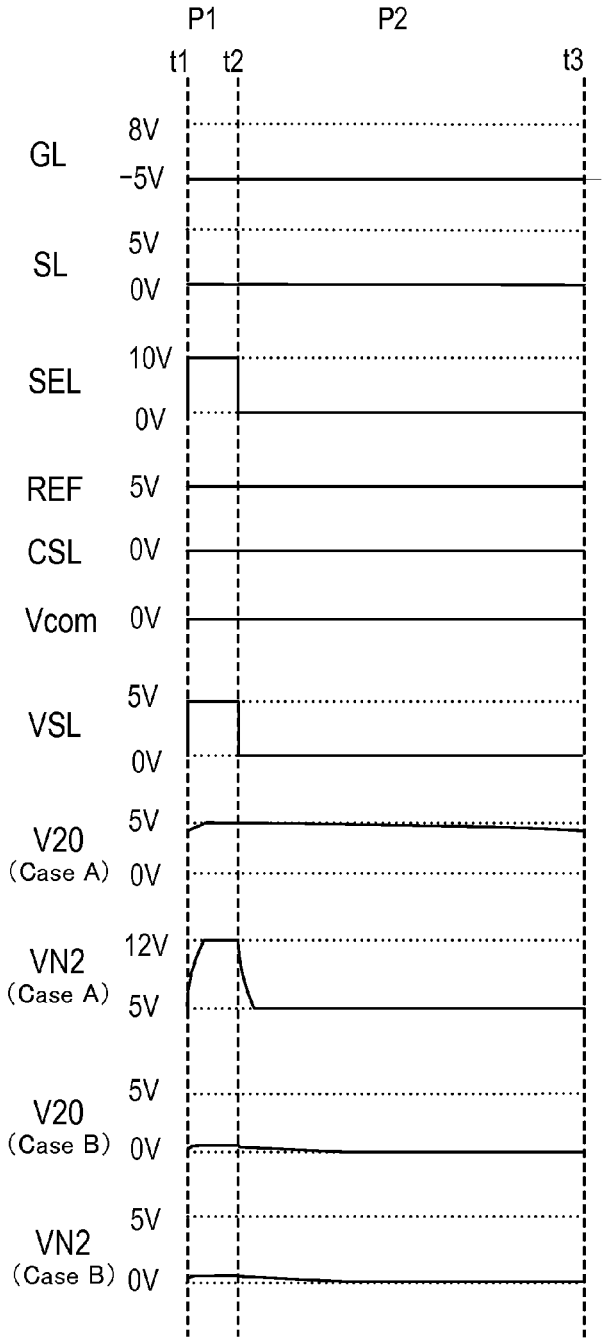
FIG. 29 is a timing chart of self-refresh actions performed by the pixel circuits of the third and sixth types of the group Y.

Thus, in the pixel circuits of the first to sixth types belonging to the group Y, with respect to the actions shown in the timing charts of the pixel circuits of the first to sixth types belonging to the group X, an applied voltage of the boost line BST is applied to the selecting line SEL to make it possible to realize a self-refresh action by the same principle as that in the group X. More specifically, the timing chart in the first or fourth type is shown in FIG. 27, the timing chart in the second or fifth type is shown in FIG. 28, and the timing chart in the third or sixth type is shown in FIG. 29. Since an operational principle is the same as that in the group X, an explanation thereof will be omitted.

In FIGS. 27 to 29, of voltages applied to the SEL, a low-level voltage value may be set within a range in which the low-level voltage is given to the gate of the transistor T3 to make it possible to completely turn off the transistor T3. A high-level voltage value may be set within a range in which the high-level voltage is given to the gate of the transistor T3 to make it possible to turn on the transistor T3 one terminal of which +5 V is applied to and to turn on the transistor T1 by raising the potential of the output node N2 in the case A.

Third Embodiment

In the third embodiment, self-polarity-inverting actions performed by the pixel circuits of the first to sixth types of the groups X and Y will be described below with reference to the drawings.

The self-polarity-inverting action is an action in an always-on display mode, and is an action in which the first switch circuit 22, the second switch circuit 23, and the control circuit 24 are operated by a predetermined sequence to invert the polarity of liquid crystal voltage Vlc applied across the pixel electrode 20 and the counter electrode 80 for the plurality of pixel circuits 2 at the same time in a lump while keeping the absolute value of the liquid crystal voltage Vlc. The self-polarity-inverting action is an action unique to the present invention performed by the pixel circuits to make it possible to realize a very low power consumption contrary to a conventional "external polarity inverting action". The "the same time" in the "at the same time in a lump" is "the same time" having a time range of a series of self-polarity-inverting actions.

Voltages are applied to all the gate lines GL, the source lines SL, the selecting lines SEL, the reference lines REF, the auxiliary capacitive lines CSL, the boost lines BST, and the counter electrode 80 that are connected to the pixel circuits 2 targeted by the self-polarity-inverting action at the same timing. When the voltage supply lines VSL are arranged as independent signal lines, voltage application to the voltage supply lines VSL is also performed at the same timing. At the same timing, the same voltage is applied to all the gate lines GL, the same voltage is applied to all the reference lines REF, the same voltage is applied to all the auxiliary capacitive lines CSL, and the same voltage is applied to all the boost lines BST. When the voltage supply lines VSL are arranged as independent signal lines, the same voltage is applied to all the voltage supply lines VSL. The timing control of the voltage applications is performed by the display control circuit 11, and the voltage applications are performed by the display control circuit 11, the counter electrode drive circuit 12, the source driver 13, and the gate driver 14, respectively.

The liquid crystal voltage Vlc is expressed by the following numerical expression 2 using a counter voltage Vcom of the counter electrode 80 and the pixel voltage V20 held by the pixel electrode 20.

$$Vlc = V20 - Vcom \quad \text{(Numerical Expression 2)}$$

The always-on display mode of the embodiment, as in the second embodiment, will be described such that the pixel voltage V20 exhibits two voltage states including the first voltage state and the second voltage state, the first voltage state and the second voltage state being set at a high level (5 V) and a low level (0 V), respectively. At this time, liquid crystal voltage Vlc is +5 V or −5 V when the pixel voltage V20 is different from the counter voltage Vcom, and is 0 V when the pixel voltage V20 and the counter voltage Vcom are the same voltages.

More specifically, by the self-polarity-inverting action, the pixel circuit 2 having liquid crystal voltage Vlc=+5 V has liquid crystal voltage Vlc=−5 V, the pixel circuit 2 having liquid crystal voltage Vlc=−5 V has liquid crystal voltage Vlc=+5 V, and the pixel circuit 2 having liquid crystal voltage Vlc=0 V maintains liquid crystal voltage Vlc=0 V.

More specifically, by the self-polarity-inverting action, the counter voltage Vcom and the pixel voltage V20 transition from a high level (5 V) to a low level (0 V) or from the low level (0 V) to the high level (5 V). A case in which the counter voltage Vcom transitions from the low level (0 V) to the high level (5 V) will be described below. In this case, a case in which the pixel electrode 20 is programmed in a high-level state before self-polarity-inverting action is defined as a "case A", and a case in which the pixel electrode 20 is programmed in a low level state is defined as a "case B". At this time, in the case A, the pixel voltage V20 transitions from a high level to a low level by the self-polarity-inverting action. In the case B, the pixel voltage V20 transitions from a low level to a high level.

<1. Group X>

A self-polarity-inverting action for a pixel circuit in which the boost line BST is connected to the second terminal of the boost capacitor element Cbst and that belongs to the group X will be described first.

(First Type)

Figure 30:
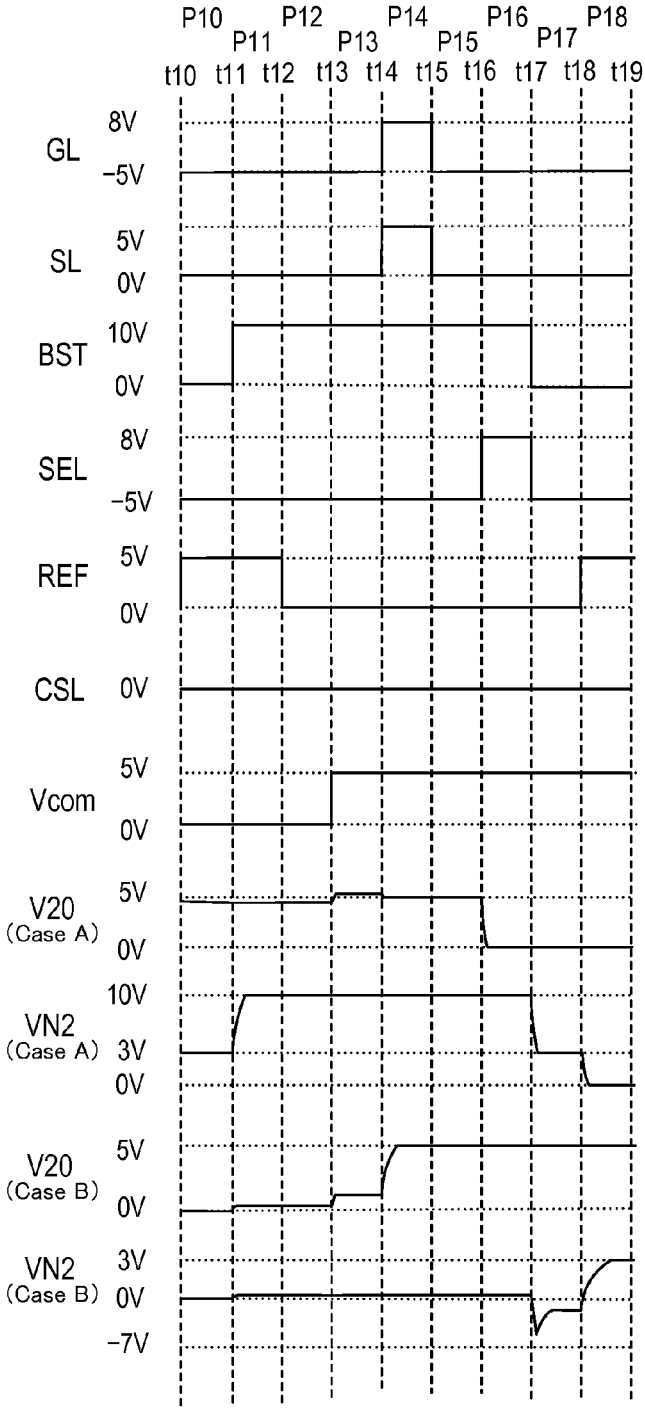
FIG. 30 is a timing chart of a self-polarity-inverting action performed by the pixel circuit of the first type of the group X.

FIG. 30 shows a timing chart of a self-polarity-inverting action of the first type. As shown in FIG. 30, the self-polarity-inverting action is exploded into nine phases P10 to P18. Start times of the phases are represented by t10, t11, . . . , t18, respectively. FIG. 30 shows voltage waveforms of all the gate lines GL, the source lines SL, the selecting lines SEL, the reference lines REF, the auxiliary capacitive lines CSL, and the boost lines BST that are connected to the pixel circuits 2A targeted by the self-polarity-inverting action, and a voltage waveform of the counter voltage Vcom. In the embodiment, all the pixel circuits of the pixel circuit array are targeted by the self-polarity-inverting action.

Furthermore, in FIG. 30, voltage waveforms of pixel voltages V20 of the nodes N1 in the case A and the case B and a voltage VN2 of the output node N2, and on/off states in the phases of the transistors T1 to T4 are shown.

<<Phase P10>>

In the phase P10 started from time t10, initial state setting for the self-polarity-inverting action is performed.

A voltage is applied to the gate line GL such that the transistor T4 is completely turned off. The voltage is set to −5 V here. A voltage (0 V) corresponding to the second voltage state is applied to the source line SL.

A voltage is applied to the selecting line SEL such that the transistor T3 is completely turned off. The voltage is set to −5 V here. A voltage of 0 V is applied to the boost line BST.

The counter voltage Vcom applied to the counter electrode 80 and a voltage applied to the auxiliary capacitive line CSL are set to 0 V. This embodiment means that the voltage applied to the auxiliary capacitive line CSL is fixed to 0 V but is not limited to 0 V. A voltage value given in the programming action state may be maintained without being changed. The counter voltage Vcom changes into 5 V to perform polarity inversion in the subsequent phases.

To the reference line REF, a voltage is applied such that the transistor T2 is set to a non-conducting state when a voltage state of the node N1 is a high level (case A) and the transistor T2 is set to a conducting state when the voltage state is a low level (case B). The voltage is set to −5 V here.

The reason a negative voltage of −5 V is used as a voltage value applied to the gate line GL to completely set the transistor T4 to an off state is that the pixel voltage V20 may transition to a negative voltage with a change in voltage of the counter voltage Vcom while keeping the liquid crystal voltage Vlc, and, in such a state, it is necessary to prevent the first switch circuit 22 which is in the non-conducting state from being unnecessarily set to a conducting state. In the always-on display mode, since the voltage of the source line SL is in the first voltage state (5 V) or the second voltage state (0 V), even though the voltage of the internal node N1 is a negative voltage, the transistor T1 of the second switch circuit 23 functions as a reverse-bias diode. For this reason, the voltage of the selecting line SEL does not always have to be controlled to a negative voltage like the gate line GL to turn off the transistor T3.

<<Phase P11>>

In the phase P11 started from time t11, a high-level voltage is applied such that the transistor T1 exhibits a conducting state by raising the potential of the node N2 in the case A. The voltage is set to 10 V here. In the case B, since the transistor T2 is set to a conducting state, even though the potential of the node N2 is rarely increased by boost raising, and the transistor T1 is still kept in a non-conducting state. In the case B, since the nodes N1 and N2 are electrically connected to each other, both the nodes exhibit the same potential.

In the phase P10, when the potential of the node N2 in the case A is at a level at which the transistor T1 can be set to a conducting state, a high-level voltage applying action to the boost line BST does not always have to be performed. The case will be described in detail in the fourth embodiment.

<<Phase P12>>

In a phase P12 started from time t12, a voltage of the reference line REF is set in the second voltage state (0 V), and the transistor T2 is set to a non-conducting state regardless of the cases A and B. In this manner, the output node N2 is blocked from the internal node N1 regardless of the cases A and B. In the case A, the potential VN2 of the output node N2 exhibits a high level by boost raising in the phase P11. On the other hand, in the case B, the potential VN2 of the output node N2 exhibits a low-level potential (approximately 0 V) without being influenced by boost raising. Since the transistor T2 is set to a non-conducting state, even though the potential of the node N1 changes, the potential of the node N2 is kept.

<<Phase P13>>

In a phase P13 started from time t13, the counter voltage Vcom shifts to a high level (5 V).

In this manner, the potential of the counter electrode 80 increases, and a potential of the other electrode of the liquid crystal capacitor element Clc, i.e., a potential of the pixel electrode 20 partially increases. A variation in potential at this time is determined by a ratio of the liquid crystal capacitance Clc to a full parasitic capacitance being parasitic in the node N1. The liquid crystal capacitance Clc and the auxiliary capacitance Cs are sufficiently larger than other parasitic capacity. Actually, the variation in potential is determined by a ratio of the liquid crystal capacitance Clc to a total capacity of the liquid crystal capacitance Clc and the auxiliary capacitance Cs. As an example, the ratio is set to 0.2. In this case, when the variation in potential of the counter electrode 80 is ΔVcom, the potential of the pixel electrode 20 increases by 0.2ΔVcom. Since ΔVcom=5 V is satisfied, at a point of time t13, a potential V20 of the pixel electrode 20 increases by about 1 V in each of the cases A and B. At a point of time in the phase P13, since the second switch circuit 23 is set to a non-conducting state in both the cases A and B, the potential V20 of the internal node N1 is maintained at the potential after increasing by about 1 V.

<<Phase P14>>

In a phase P14 started from time t14, a high-level voltage is applied to the gate line GL to set the transistor T4 to a conducting state. The voltage is set to 8 V here. The first switch circuit 22 is set to a conducting state by the phase P14.

The first voltage state (5 V) is applied to the source line SL.

In this manner, a voltage of 5 V applied to the source line SL is given to the internal node N1 through the first switch circuit 22 in both the cases A and B. More specifically, the pixel voltage V20 is set to a first voltage state in the phase P13 regardless of the cases A and B.

At this time, the liquid crystal voltage Vlc exhibits ±0 V in both the cases A and B. Immediately before time t10, the absolute value of the liquid crystal voltage Vlc is 5 V in the case A, and is 0 V in the case B. More specifically, in the phase P14, the absolute value of the liquid crystal voltage Vlc in the case A largely changes from the value at time t10. For this reason, theoretically, after the point of time, a displayed image changes. However, a period until polarity inversion is finally completed is shortened to make a time for a temporary change of the display state short, a variation in average value of the liquid crystal voltage Vlc becomes so small that the variation cannot be visually sensed by a human being. For example, when the period of each of the phases is set to about 30 μsec, the temporary change of the display state is visually neglected by a human being without a problem.

<<Phase P15>>

In a phase P15 started from time t15, a low-level voltage is applied to the gate line GL again to set the transistor T4 to a conducting state. In this manner, the first switch circuit 22 is set to a non-conducting state.

An applied voltage to the source line SL shifts to the second voltage state (0 V).

At this time, when the transistor T4 is completely turned off, the first voltage state (5 V) of the internal node N1 varies by capacitive coupling between the gate of the transistor T4 and the internal node N1. In this case, a voltage of the auxiliary capacitive line CSL may be adjusted, and the variation in voltage of the internal node N1 may be compensated for by capacitive coupling through a second capacitor element C2. The same applies to other types to which the self-polarity-inverting action can be executed.

<<Phase P16>>

In a phase P16 started from time t16, a high-level voltage (8 V) is applied to the selecting line SEL to completely turn on the transistor T3.

In the case A, the potential VN2 of the node N2 is at a high level, the transistor T1 is set to a conducting state. For this reason, the second switch circuit 23 is set to a conducting state. In the phase P16, 0 V is applied to the reference line REF. In this manner, a current flowing from the internal node N1 exhibiting a high-level potential to the reference line REF through the second switch circuit 23 is generated, and the node N1 has the same potential as that of the reference line REF exhibiting the second voltage state. More specifically, the pixel voltage V20 decreases to 0 V.

On the other hand, in the case B, since the potential VN2 of the node N2 is at a low level, and the transistor T1 is in a non-conducting state. For this reason, even though the transistor T3 is in an on state, the second switch circuit 23 is still in a non-conducting state. Therefore, the node N1 is not electrically connected to the reference line REF, and, as in the case A, a current flowing from the node N1 to the source line SL is not generated. Thereafter, the pixel voltage V20 is continuously kept at 5 V.

At this time, −5 V is applied to the liquid crystal voltage Vlc in the case A, and ±0 V is applied to the liquid crystal voltage Vlc in the case B. Therefore, upon completion of polarity inversion, thereafter, the displayed image returns to the image that is displayed immediately before the self-polarity-inverting action is started. After a phase P16, since the absolute value of the Vlc does not change, the displayed image does not change.

At this point of time, the pixel voltage V20 in the case A exhibits the second voltage state, and the pixel voltage V20 in the case B exhibits the first voltage state. However, the former is realized by giving an applied voltage to the reference line REF to the internal node N1 in the phase P16, and the latter is realized by giving an applied voltage of the source line SL to the internal node N1 in the phase P14. More specifically, if the potential V20 of the internal node N1 correctly exhibits the first voltage state or the second voltage state at a point of time before the self-polarity-inverting action is started due to the presence of a leakage current, at a point of time in the phase P16, the above described voltage states are realized. Based on the circumstances, it can also be said that the pixel voltage V20 in the case A is "refreshed" to the second voltage state and the pixel voltage V20 in the case B is "refreshed" to the first voltage state.

<<Phase P17>>

In the phase P17 started from time t17, the applied voltage to the boost line BST returns to a low-level voltage (0 V), and a low-level voltage is applied to the selecting line SEL to set the transistor T3 to a non-conducting state. In this manner, the second switch circuit 23 is set to a non-conducting state in both the cases A and B. The first switch circuit 22 is continuously in a non-conducting state.

Thus, the potential V20 of the internal node N1 in both the cases A and B is kept at a voltage value obtained immediately before time t17 is started.

Since 0 V is applied to the reference line REF, the transistor T2 is in a non-conducting state. For this reason, the potential of the output node N2 is decreased by voltage drop of the boost line BST.

In the case A, at a point of time in the phase P16, the potential VN2 of the output node N2 is about 10 V. For this reason, in the phase P17, the potential decreases by about 7 V to exhibit about 3 V.

On the other hand, in the case B, at the point of time in the phase P16, the potential VN2 of the output node N2 is about 0 V. Therefore, as in the case A, the VN2 begins to decrease toward about −7 V that is lower than 0 V by 7 V. However, at this time, since the gate potential of the transistor T2 is 0 V, when an absolute value of a negative potential of the output node N2 is larger than a threshold voltage Vth of the transistor T2, the transistor T2 is set to a conducting state in a direction from the internal node N1 to the output node N2. As a result, thereafter, the potential VN2 of the output node N2 begins to increase. The potential VN2 increases to a value at which the transistor T2 is cut off, i.e., to a value that is lower than the gate potential by the threshold voltage Vth, and then stops. In the embodiment, since the threshold voltage Vth of the transistor T2 is 2 V, the VN2 increases to about −2 V and stops.

<<Phase P18>>

In a phase P18 started from time t18, a voltage of the reference line REF is returned to 5 V in the phase P10.

In the case A, immediately before time t18, since a potential of the internal node N1 serving as the source of the transistor T2 is 0 V, a potential difference Vgs with the gate of the transistor T2 is the threshold voltage Vth or more. For this reason, the transistor T2 is set to a conducting state in a direction from the output node N2 to the internal node N1. Since a parasitic capacitance of the internal node N1 is larger than that of the output node N2, the potential VN2 of the output node N2 is attracted by the potential V20 of the internal node N1 to decrease toward 0 V. On the other hand, the potential of the internal node N1 rarely changes, and is still kept at 0 V.

Also in the case B, immediately before time t18, since a potential of the output node N2 serving as the source of the transistor T2 is −2 V, a potential difference Vgs with the gate of the transistor T2 is the threshold voltage Vth or more. For this reason, the transistor T2 is set to a conducting state in a direction from the internal node N1 to the output node N2. In this manner, the potential VN2 of the output node N2 increases to a value at which the transistor T2 is cut off, i.e., to a value that is lower than the gate potential (5 V) by the threshold voltage Vth, and then stops. In the embodiment, since the threshold voltage Vth is 2 V, the value VN2 increases to about 3 V and stops. The value corresponds to the value VN2 at time t10 in the case A.

Since the second switch circuit 23 is still in a non-conducting state in both the cases A and B, the applied voltage to the reference line REF does not influence the potential V20 of the internal node N1.

In a conventional external polarity inverting action, since the gate lines GL need to be scanned in a vertical direction one by one, a high-level voltage needs to be applied to the gate lines GL the number of which is the number (n) of gate lines. Furthermore, the source line SL also needs to be charged and discharged n times at most. In contrast to this, according to the method of this embodiment, when the voltage application steps according to the phases P10 to P18 are commonly performed to all the pixels, the polarity of the liquid crystal voltage Vlc can be inverted while switching the counter voltage Vcom between a high level and a low level. Therefore, since the numbers of times of voltage application to the gate line GL and voltage application to the source line SL can be considerably reduced, power consumptions of the gate driver 14 and the source driver 13 can be considerably reduced.

In FIG. 30, the case in which the counter voltage Vcom transitions from the low level (0 V) to the high level (5 V) is explained. However, when the counter voltage Vcom transitions from the high level (5 V) to the low level (0 V), the transition timing is the same as described above. When the phase P13 starts (t13), the transition is performed.

At this time, at a point of time before polarity inversion, the liquid crystal voltage Vlc is ±0 V in the case A, and is −5 V in the case B. In the case A, the pixel voltage V20 is set to the second voltage state (0 V) at a point of time in the phase P16, and the liquid crystal voltage Vlc returns to ±0 V. In the case B, the pixel voltage V20 is forcibly set to the first voltage state in the phase P14, and the liquid crystal voltage Vlc becomes +5 V. More specifically, the voltage changes from −5 V to +5 V, and polarity inversion is executed.

The self-polarity-inverting action according to the embodiment will be concluded as follows.

First, the first switch circuit 22 is in a non-conducting state in the phases P10 to P13. In the phase P11, when the transistor T2 is set to a non-conducting state in only the case A, a high-level voltage is applied to the boost line BST to considerably increase the potential of the internal node N2 only in the case A, and the transistor T1 is set in an on state.

After the counter voltage Vcom is inverted from a low level to a high level in the phase P13, the first switch circuit 22 is set to a conducting state in a state in which the source line SL is set to the first voltage state in the phase P14. In this manner, the internal node N1 is set to the first voltage state (5 V) in both the cases A and B.

Thereafter, after the first switch circuit 22 is set to a non-conducting state in the phase P15, a high-level voltage is applied to the selecting line SEL in phase P16 to set the transistor T3 in an on state. In this manner, in only the case A in which the transistor T1 exhibits an on state, the second switch circuit 23 is set to a conducting state, the internal node N1 is attracted by the potential of the reference line REF exhibiting the second voltage state (0 V) and becomes 0 V. In the case B, at the point of time, both the first switch circuit 22 and the second switch circuit 23 are in a non-conducting state. For this reason, the internal node N1 is kept in the first voltage state (5 V).

In the phase P17, the transistor T3 is set to a non-conducting state again. In the phase P18, the conducting state of the transistor T2 is returned to that at a point of time in the phase P10.

The first switch circuit 22 is set to a conducting state only during the phase P14, and the first switch circuit 22 is not set to a conducting state in other phases. For this reason, the source line SL may be maintained in the first voltage state (5 V) throughout the phases. The same applies to the other types.

Inversion of the counter voltage Vcom in the phase P13 need only be performed before high-level voltage application to the gate line GL in the phase P14 is ended. After fall time t12 of an application voltage to the reference line REF, the counter voltage Vcom can be inverted before fall time t15 of an applied voltage to the gate line GL. The same applies to other types to which the self-polarity-inverting action can be executed.

(Second Type)

In the second type of the pixel circuit 2B shown in FIG. 11, as will be described later, in a programming action in an always-on display mode, a voltage applied to the auxiliary capacitive line CSL is fixed to any one of the first voltage state (5 V) and the second voltage state (0 V). In the type, a self-polarity-inverting action can be executed in the case where a voltage of 0 V is applied to the auxiliary capacitive line CSL in programming.

As described in the first type, in the self-polarity-inverting action, after a voltage of 5 V in the first voltage state is given from the source line SL to the nodes N1 through the first switch circuit 22 in both the cases A and B, in only the case A, a voltage of 0 V in the second voltage state is given from the reference line REF also serving as the voltage supply line VSL to the node N1 through the second switch circuit 23.

Based on the circumstances, in the second type, in only the case A, the voltage of 0 V in the second state may be given from the auxiliary capacitive line CSL also serving as the voltage supply line VSL to the internal node N1 through the second switch circuit 23. For this purpose, 0 V needs to be applied to the auxiliary capacitive line CSL.

Since a voltage may be given to the reference line REF such that the transistor T2 is set to a conducting state in only the case B in the phase P10 and set to a non-conducting state in the case A, the same voltage of 5 V as that in the first type may be given. In this manner, a high-level voltage is given to the boost line BST in the phase P11 to perform boost raising to considerably push up the potential of the output node N2 only in the case A to make it possible to set the transistor T1 to a conducting state.

Figure 31:
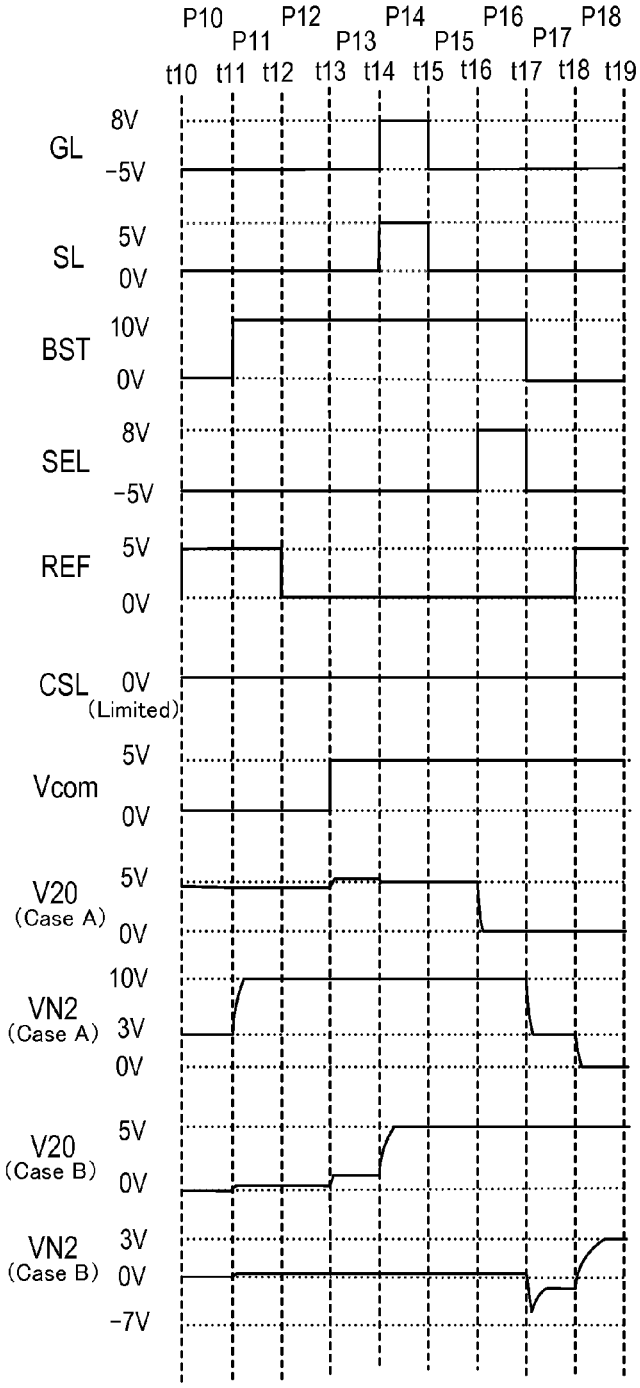
FIG. 31 is a timing chart of a self-polarity-inverting action performed by the pixel circuit of the second type of the group X.

Based on the circumstances, the following can be understood. That is, in the second type, except that an applied voltage to the auxiliary capacitive line CSL is limited to 0 V, by the same voltage applying method as that in the phases P10 to P18 described in the first type, the self-polarity-inverting action can be executed. Thus, a timing chart of the self-polarity-inverting action in the pixel circuit of the second type shown in FIG. 31 is the same as that in the first type shown in FIG. 30 except that the applied voltage to the auxiliary capacitive line CSL is limited to 0 V. In FIG. 31, "0 V (limited)" is expressed in a column for the applied voltage of the auxiliary capacitive line CSL to clearly show that 5 V cannot be employed as an applied voltage to the auxiliary capacitive line CSL.

Also in this type, in order to compensate for a variation of the voltage state of the internal node N1 at a point of time in the phase P15, voltage adjustment for the auxiliary capacitive line CSL can be performed. However, in this type, since the auxiliary capacitive line CSL also serves as the voltage supply line VSL, in the phase P14 in which a high-level voltage is applied to the gate line GL, a voltage of the auxiliary capacitive line CSL is dislocated in a reverse direction by an adjusted voltage in advance, 0 V (second voltage state) may be set at the start (t15) of the phase P15.

(Third Type)

In the pixel circuit 2C of the third type shown in FIG. 12, the voltage supply line VSL is arranged as an independent signal line. For this reason, after a voltage of 5 V in the first voltage state is given from the source line SL to the nodes N1 through the first switch circuit 22 in both the cases A and B, in only the case A, a voltage of 0 V in the second voltage state is given from the voltage supply line VSL to the node N1 through the second switch circuit 23 to make it possible to realize a self-polarity-inverting action.

Figure 32:
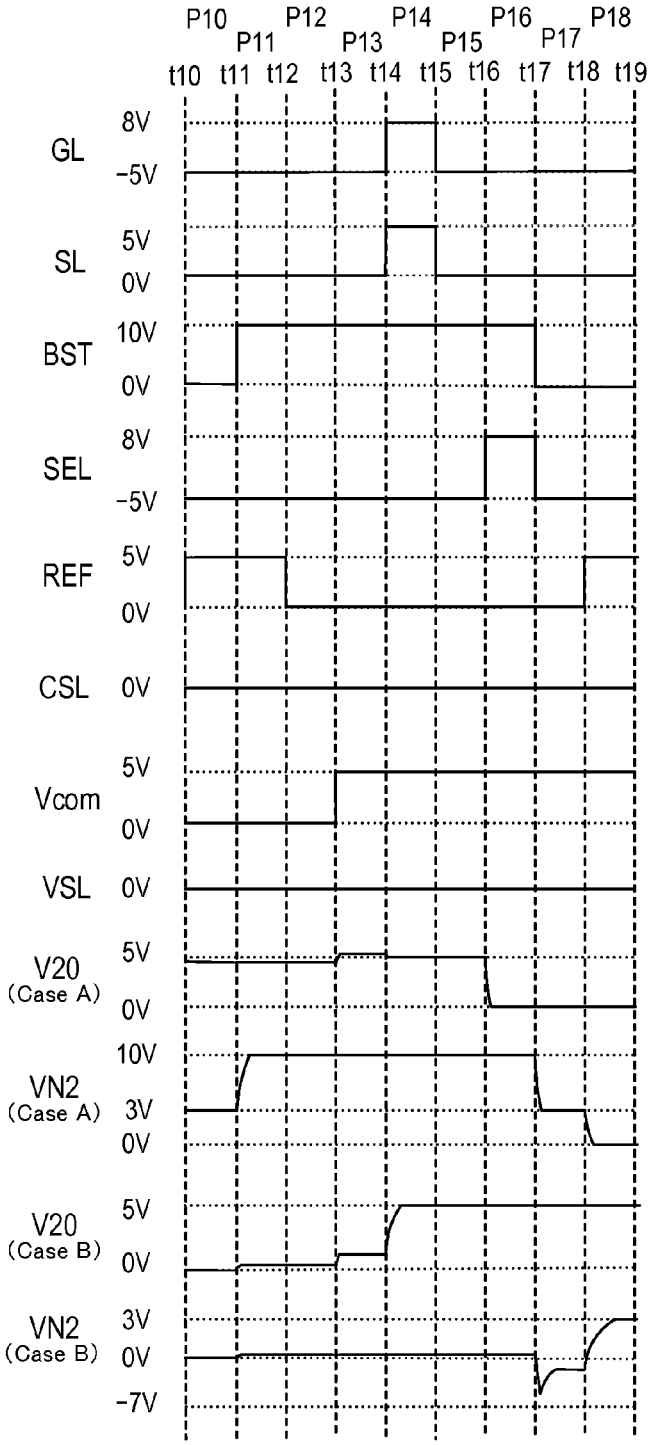
FIG. 32 is a timing chart of a self-polarity-inverting action performed by the pixel circuit of the third type of the group X.

Thus, it can be understood that, in the phase P16 of the first type, when a voltage in the second voltage state (0 V) is applied to the voltage supply line VSL, the self-polarity-inverting action can be executed by the same voltage applying method as that in the phases P10 to P18 described in the first type. FIG. 32 is a timing chart of a self-polarity-inverting action of the pixel circuit of the third type. FIG. 32 shows the case in which 0 V is applied to the auxiliary capacitive line CSL. However, when 5 V is applied to the auxiliary capacitive line CSL in an immediately previous programming action, 5 V may be continuously applied even in the self-polarity-inverting action state. In FIG. 32, the voltage supply line VSL is set to the second voltage state (0 V) throughout the phases P10 to P18. However, the voltage supply line VSL may be set to the second voltage state in at least the phase P16.

(Fourth Type)

In the pixel circuit 2D of the fourth type shown in FIG. 13, as in the first type, the reference line REF also serves as the voltage supply line VSL. However, the pixel circuit 2D is different from the pixel circuit 2A of the first type in that the first switch circuit 22 and the second switch circuit 23 share the transistor T3.

As described in the first type, in the self-polarity-inverting action, after a voltage of 5 V in the first voltage state is given from the source line SL to the nodes N1 through the first switch circuit 22 in both the cases A and B, in only the case A, a voltage of 0 V in the second voltage state needs to be given from the reference line REF also serving as the voltage supply line VSL to the node N1 through the second switch circuit 23. In this case, in the fourth type, in both cases in which the first switch circuit 22 is set to a conducting state, and in which the second switch circuit 23 is set to a conducting state, the transistor T3 needs to be turned on. More specifically, in the timing chart of the first type shown in FIG. 30, a high-level voltage needs to be applied to the selecting line SEL in the phase P14 to set the transistor T3 to a conducting state.

At this time, since the transistor T1 is in a non-conducting state in the case B, the second switch circuit 23 is in a non-conducting state, and a voltage of 5 V in the first voltage state is applied from the source line SL to the node N1 through the first switch circuit 22 without a problem. However, in the case A, since the transistor T1 is in a conducting state, the second switch circuit 23 is set to a conducting state. In this manner, the voltage in the first voltage state (5 V) is given from the source line SL to the internal node N1 through the first switch circuit 22, and the voltage in the second voltage state (0 V) is given from the reference line REF to the internal node N1 through the second switch circuit 23. In this manner, both the voltages interferes with each other, and the potential of the internal node N1 cannot be set to the first voltage state (5 V).

In order to cope with the problem, at a point of time in the phase P14, when an application voltage to the reference line REF is increased to the first voltage state (5 V) to give 5 V from the source line SL and the reference line REF, the potential of the internal node N1 can be set to 5 V in both the cases A and B. However, in this case, the transistor T2 is turned on from the node N1 to the node N2 in the case B, the potential of the node N2 increases to the voltage (3 V) which is lower than the gate potential (5 V) by a threshold voltage. In this manner, in the phase P16, when a voltage (0 V) in the second voltage state is applied to the reference line REF, the transistor T1 is set to a conducting state in both the cases A and B. As a result, the voltage of the internal node N1 decreases to 0 V in both the cases. Thus, the method cannot be employed either.

As described above, by the method according to this embodiment, the self-polarity-inverting action cannot be performed to the pixel circuit of the fourth type.

(Fifth Type)

In the pixel circuit 2E of the fifth type shown in FIG. 16, as in the second type, the auxiliary capacitive line CSL also serves as the voltage supply line VSL. On the other hand, the pixel circuit 2E is different from the pixel circuit 2B of the second type in that the first switch circuit 22 and the second switch circuit 23 share the transistor T3.

In the pixel circuit 2E of the fifth type, in the phase P14, after a voltage of 5 V in the first voltage state is given from the source line SL to the node N1 through the first switch circuit 22 in both the cases A and B, in the phase P16, in only the case A, a voltage of 0 V in the second voltage state needs to be given from the auxiliary capacitive line CSL serving as the voltage supply line VSL to the node N1 through the second switch circuit 23. In this case, in the fifth type, in both cases in which the first switch circuit 22 is set to a conducting state, and in which the second switch circuit 23 is set to a conducting state, the transistor T3 needs to be turned on. More specifically, in the timing chart of the second type shown in FIG. 31, a high-level voltage needs to be applied to the selecting line SEL in the phase P14 to set the transistor T3 to a conducting state.

However, in this case, the same problem as in the fourth type occurs. More specifically, in the case A, since the transistor T1 is in a conducting state, the second switch circuit 23 is set to a conducting state in the phase P14. In this manner, the voltage in the first voltage state (5 V) is given from the source line SL to the internal node N1 through the first switch circuit 22, and the voltage in the second voltage state (0 V) is given from the auxiliary capacitive line CSL to the internal node N1 through the second switch circuit 23. In this manner, both the voltages interferes with each other, and the potential of the internal node N1 cannot be set to the first voltage state (5 V). In addition, since the potential of the internal node N1 varies, an applied voltage of the auxiliary capacitive line CSL cannot be increased to 5 V.

As described above, by the method according to this embodiment, the self-polarity-inverting action cannot be performed to the pixel circuit of the fifth type.

(Sixth Type)

In the pixel circuit 2F of the sixth type shown in FIG. 17, as in the third type, the voltage supply line VSL is configured by an independent signal line. On the other hand, the pixel circuit 2F is different from the pixel circuit 2C of the third type in that the first switch circuit 22 and the second switch circuit 23 share the transistor T3.

In the pixel circuit 2F of the sixth type, in the phase P14, after a voltage of 5 V in the first voltage state is given from the source line SL to the node N1 through the first switch circuit 22 in both the cases A and B, in the phase P16, in only the case A, a voltage of 0 V in the second voltage state needs to be given from the voltage supply line VSL to the node N1 through the second switch circuit 23. In this case, in the sixth type, in both cases in which the first switch circuit 22 is set to a conducting state, and in which the second switch circuit 23 is set to a conducting state, the transistor T3 needs to be turned on. More specifically, in the timing chart of the third type shown in FIG. 32, a high-level voltage needs to be applied to the selecting line SEL in the phase P14 to set the transistor T3 to a conducting state.

At this time, in the case A, both the first switch circuit 22 and the second switch circuit 23 are set to a conducting state in the phase P14. However, in this type, unlike in the fourth or fifth type, the voltage can be freely controlled because the voltage supply line VSL is an independent signal line. Thus, in the phase P14, when the voltage of 5 V in the first voltage state is applied to the voltage supply line VSL, the potential V20 of the internal node N1 can also be set to the first voltage state in the case A.

Subsequently to the phase P15, when 0 V in the second voltage state is given to the voltage supply line VSL, in only the case A in which the second switch circuit 23 is set to a conducting state, the potential V20 of the internal node N1 decreases to 0 V, 5 V is continuously maintained in the case B in which the second switch circuit 23 is in a non-conducting state.

Figure 33:
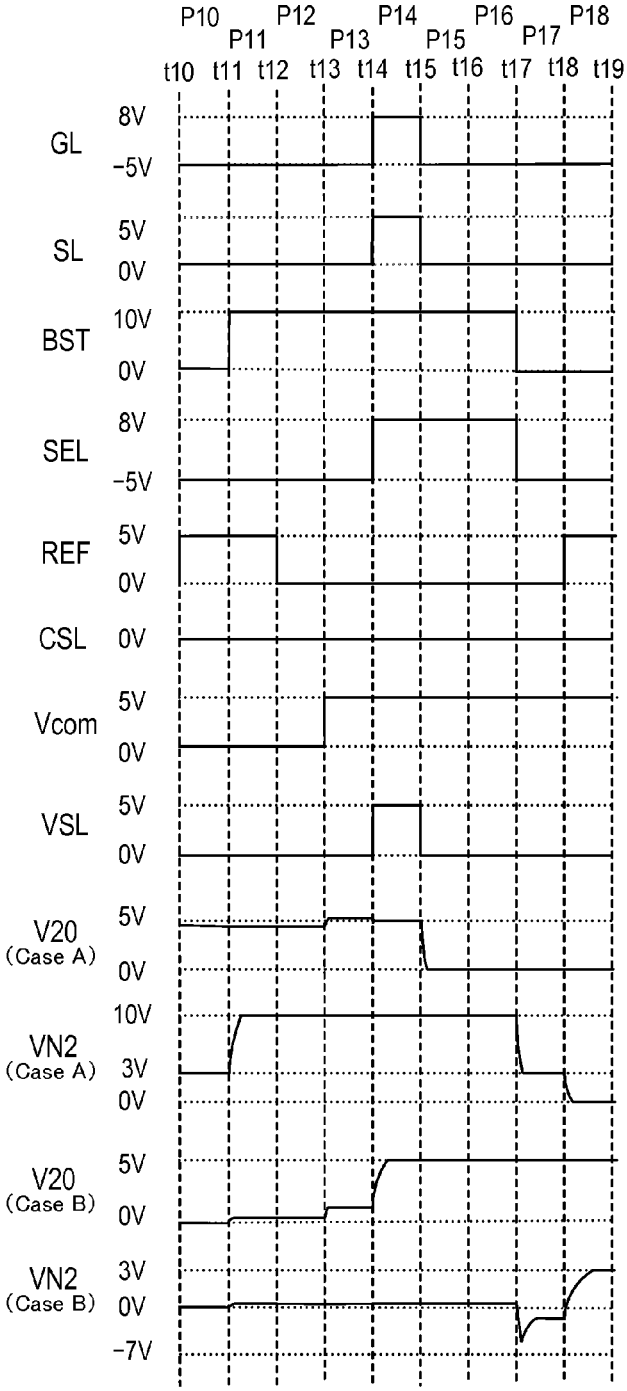
FIG. 33 is a timing chart of a self-polarity-inverting action performed by the pixel circuit of the sixth type of the group X.

When the above description is summarized, in the pixel circuit of the sixth type, the voltage supply line VSL is set to the first voltage state (5 V) in the phase P14. Thereafter, the voltage supply line VSL is set to the second voltage state (0 V) in the phase P15, and other signal lines are set to the same voltage in the timing chart of the third type to make it possible to execute the self-polarity-inverting action. A timing chart of the pixel circuit of the sixth type is shown in FIG. 33.

<2. Group Y>

A self-polarity-inverting action for each pixel circuit in which the selecting line SEL is connected to the second terminal of the boost capacitor element Cbst and that belongs to the group Y will be described below.

(First Type)

Figure 18:
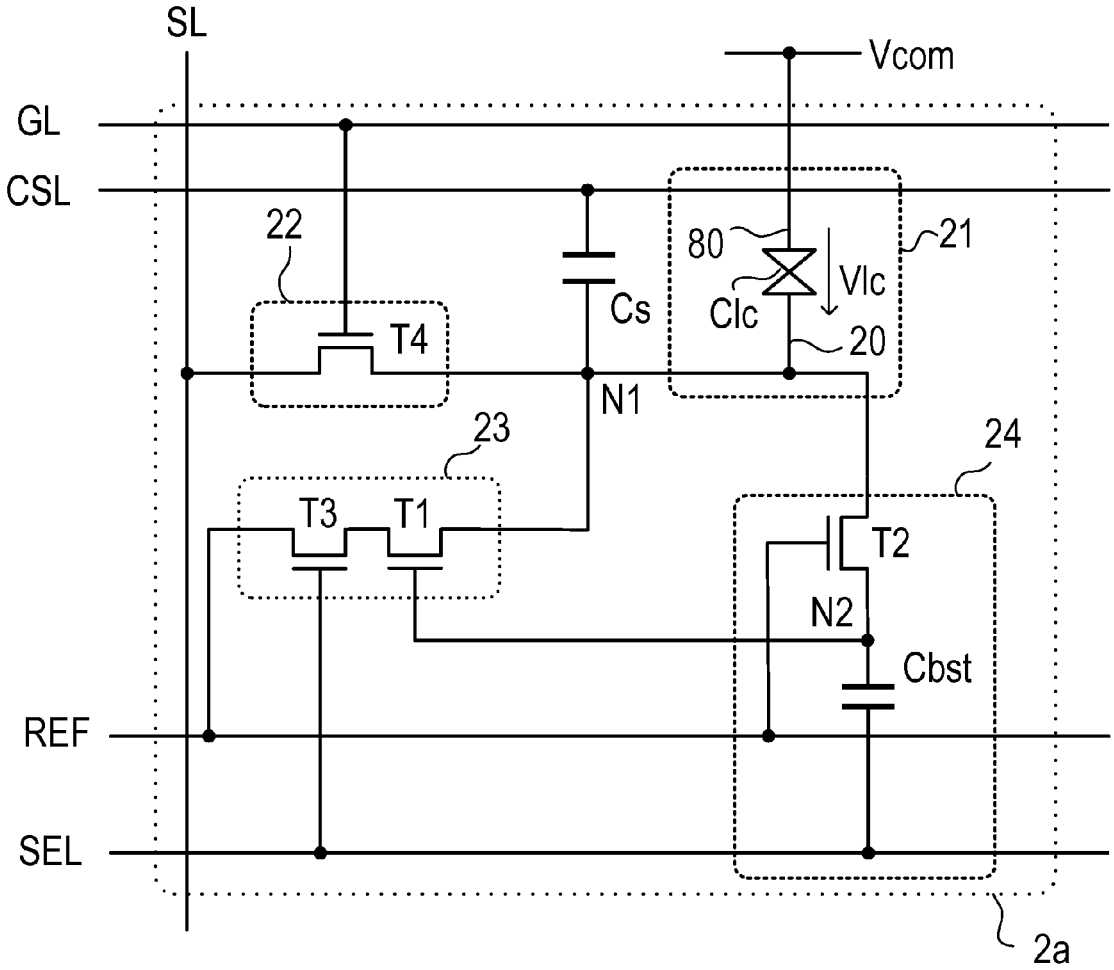
FIG. 18 is a circuit diagram showing a circuit configuration of a first type belonging to a group Y of the pixel circuit of the present invention.

When a pixel circuit 2*a* shown in FIG. 18 is compared with the pixel circuit 2A shown in FIG. 8, the selecting line SEL and the boost line BST are common to each other. In this case, referring to the timing chart of the self-polarity-inverting action in the pixel circuit 2A of the group X shown in FIG. 30, rising timings of voltage pulses of the selecting line SEL and the boost line BST are different from each other. Therefore, the timing chart in FIG. 30 cannot be applied to the pixel circuit 2*a* of the group Y without being changed. An explanation will be arbitrarily made with reference to the timing chart in FIG. 30.

In the phase P11, the output node N1 in the case A needs to be pushed up. For this reason, a high-level voltage (10 V) needs to be applied to the selecting line SEL. In the case A, at this time, the second switch circuit 23 is set to a conducting state. Since the transistor T1 is in an off state in the case B, the second switch circuit 23 is in a non-conducting state.

Thereafter, when the applied voltage of the reference line REF is decreased to the second voltage state (0 V) in the phase P12 to turn off the transistor T2, and, subsequently, the output node N2 is electrically disconnected from the internal node N1. For this reason, until the applied voltage of the reference line REF is increased again, the applied voltage of the selecting line SEL needs to be maintained at a high level (10 V). This is because, if the applied voltage of the selecting line SEL is decreased, the potential of the output node N2 is decreased, and the potential is meaninglessly pushed up in the phase P11. In other words, until the applied voltage of the reference line REF is increased again, the second switch circuit 23 continues the conducting state in the case A.

In this case, in the phase P14, the potential of the internal node N1 needs to be shifted to the first voltage state in both the cases A and B. However, at this time, 0 V is still continuously applied to the reference line REF. For this reason, the voltage in the first voltage state (5 V) is given from the source line SL to the internal node N1 through the first switch circuit 22, and the voltage in the second voltage state (0 V) is given from the reference line REF to the internal node N1 through the second switch circuit 23. In this manner, both the voltages interferes with each other, and the potential of the internal node N1 cannot be set to the first voltage state (5 V).

At this time, the reference line REF cannot be set to 5 V as is explained in the fourth type of the group X.

As described above, by the method according to this embodiment, the self-polarity-inverting action cannot be performed to the pixel circuit 2*a* of the first type of the group Y.

(Second Type)

Figure 19:
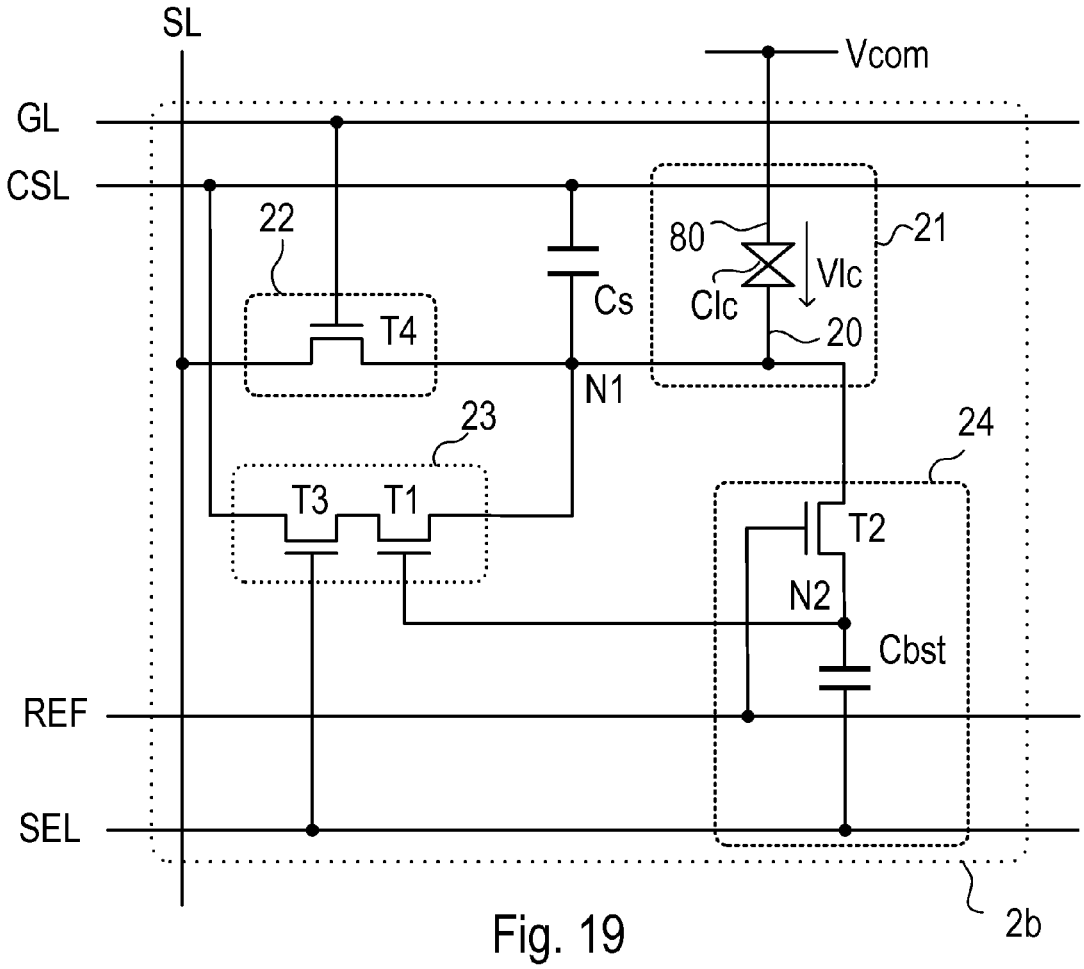
FIG. 19 is a circuit diagram showing a circuit configuration of a second type belonging to the group Y of the pixel circuit of the present invention.

When a pixel circuit 2*b* shown in FIG. 19 is compared with the pixel circuit 2B shown in FIG. 11, the selecting line SEL and the boost line BST are common to each other. In this case, referring to the timing chart of the self-polarity-inverting action in the pixel circuit 2B of the group X shown in FIG. 31, rising timings of voltage pulses of the selecting line SEL and the boost line BST are different from each other. Therefore, the timing chart in FIG. 31 cannot be applied to the pixel circuit 2*b* of the group Y without being changed. An explanation will be arbitrarily made with reference to the timing chart in FIG. 31.

After the high-level voltage (10 V) is applied to the selecting line SEL in the phase P11, until the voltage of the reference line REF is increased again, the applied voltage of the selecting line SEL needs to be maintained at a high level as in the first type of the group Y.

On the other hand, as shown in FIG. 31, since the pixel circuit 2B of the second type of the group X needs to supply a voltage in the second voltage state (0 V) from the auxiliary capacitive line CSL also serving as the voltage supply line VSL to the internal node N1, 0 V needs to be continuously applied to the auxiliary capacitive line CSL. This point is not different from that in the pixel circuit 2*b* of the group Y.

More specifically, in the phase P14, even though 5 V in the first voltage state is applied to the source line SL in a state where the first switch circuit 22 is in a conducting state in order to shift the potential of the internal node N1 to the first voltage state in both the cases A and B, 0 V is applied to the auxiliary capacitive line CSL. For this reason, the voltage in the first voltage state (5 V) is given from the source line SL to the internal node N1 through the first switch circuit 22, and the voltage in the second voltage state (0 V) is given from the reference line REF to the internal node N1 through the second switch circuit 23. In this manner, both the voltages interferes with each other, and the potential of the internal node N1 cannot be set to the first voltage state (5 V).

The voltage of the auxiliary capacitive line CSL cannot be changed as is explained in the fifth type of the group X.

As described above, by the method according to this embodiment, the self-polarity-inverting action cannot be performed to the pixel circuit 2*b* of the second type of the group Y.

(Third Type)

Figure 20:
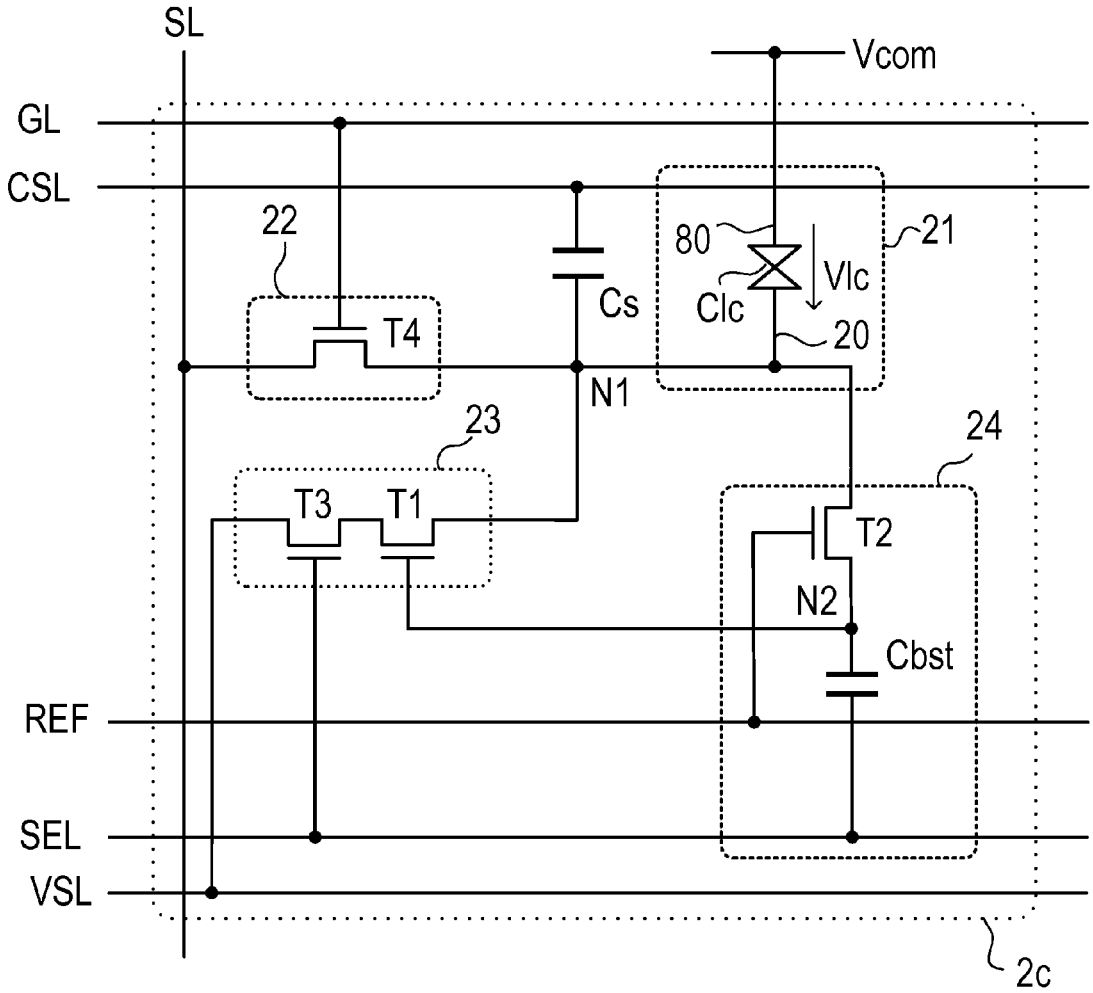
FIG. 20 is a circuit diagram showing a circuit configuration of a third type belonging to the group Y of the pixel circuit of the present invention.
Figure 21:
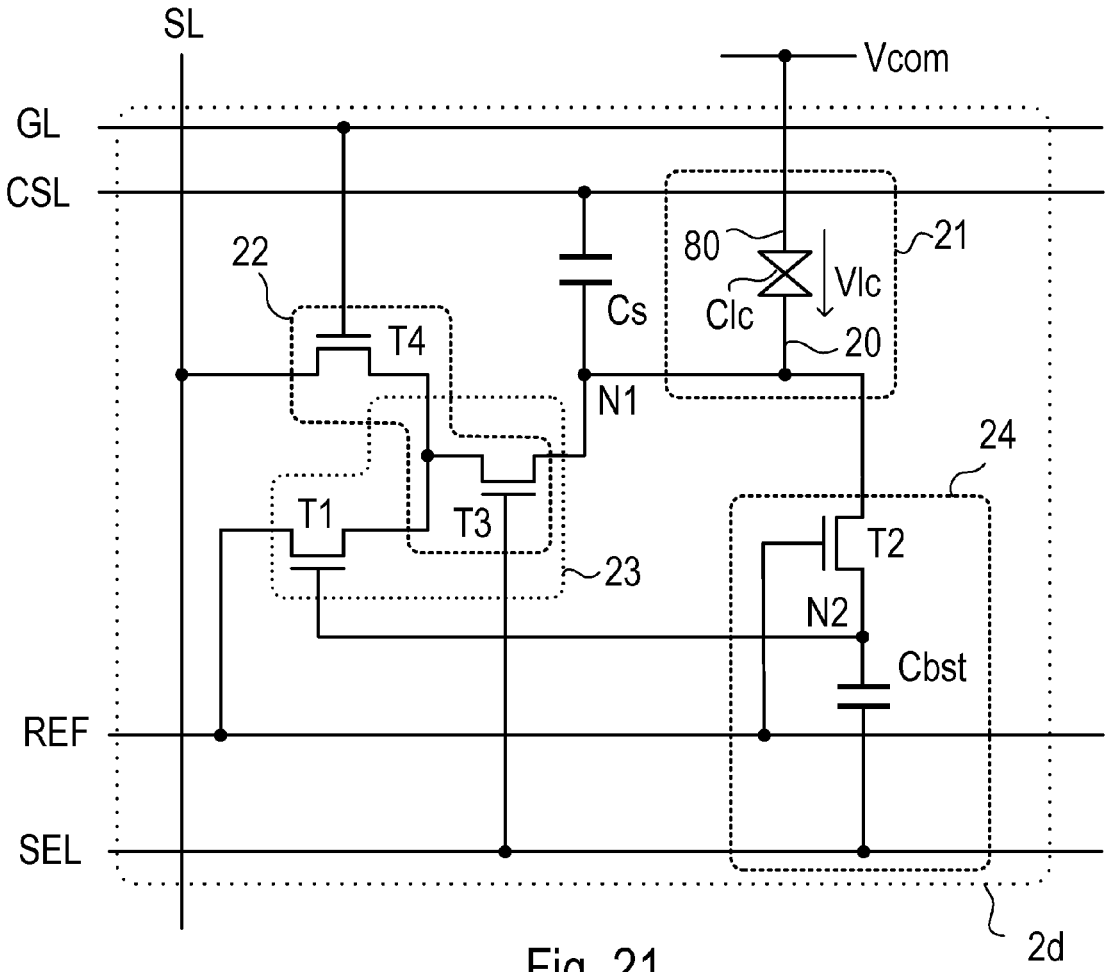
FIG. 21 is a circuit diagram showing a circuit configuration of a fourth type belonging to the group Y of the pixel circuit of the present invention.
Figure 22:
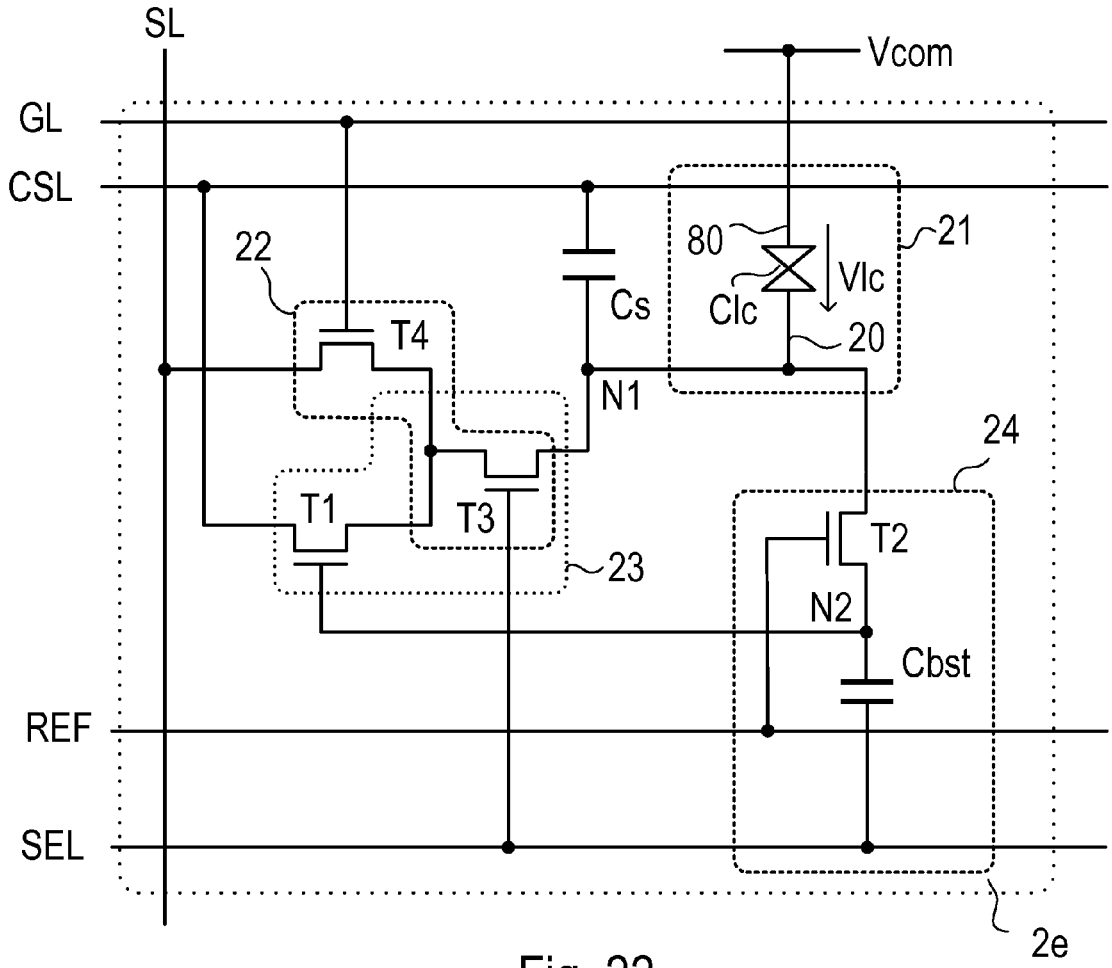
FIG. 22 is a circuit diagram showing a circuit configuration of a fifth type belonging to the group Y of the pixel circuit of the present invention.

When a pixel circuit 2*c* shown in FIG. 20 is compared with the pixel circuit 2C shown in FIG. 12, the selecting line SEL and the boost line BST are common to each other. In this case, referring to the timing chart of the self-polarity-inverting action in the pixel circuit 2C of the group X shown in FIG. 32, rising timings of voltage pulses of the selecting line SEL and the boost line BST are different from each other. Therefore, the timing chart in FIG. 32 cannot be applied to the pixel circuit 2*c* of the group Y without being changed. An explanation will be arbitrarily made with reference to the timing chart in FIG. 32.

After the high-level voltage (10 V) is applied to the selecting line SEL in the phase P11, until the voltage of the reference line REF is increased again, the applied voltage of the selecting line SEL needs to be maintained at a high level as in the first type of the group Y. That is, meanwhile, the second switch circuit 23 in the case A continues to be in the conducting state.

On the other hand, as shown in FIG. 32, the pixel circuit 2C of the third type of the group X needs to supply a voltage in the second voltage state (0 V) from the voltage supply line VSL to the internal node N1. This point is not different from that in the pixel circuit 2*c* of the group Y.

Incidentally, in the pixel circuit 2*c*, since the voltage supply line VSL is an independent signal line, the voltage value can be controlled without being influenced by a potential of another signal line. Thus, in the phase P14, in order to set the potential of the internal node N1 to the first voltage state in both the cases A and B, in the period, the power supply line VSL may also be set to the first voltage state. Thereafter, in order to shift the internal node N1 to the second voltage state in only the case A, the voltage supply line VSL is decreased to the second voltage state. Control contents of the voltage supply line VSL are the same as those of the pixel circuit 2F of the sixth type of the group X (see FIG. 33).

Figure 34:
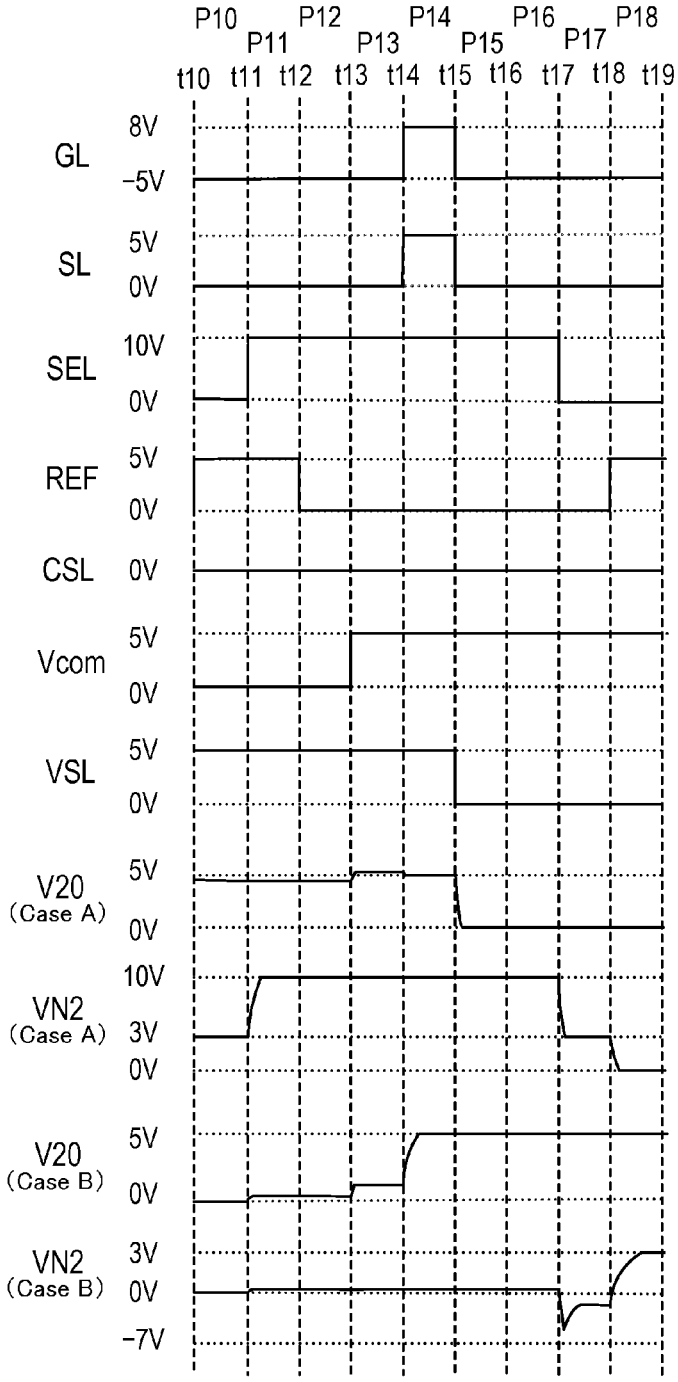
FIG. 34 is a timing chart of a self-polarity-inverting action performed by the pixel circuit of the third type of the group Y.

Under the control, self-polarity inversion can be executed to the pixel circuit 2*c* of the third type of the group Y as in the pixel circuit 2C of the third type of the group X. A timing chart obtained at this time is shown in FIG. 34. As the applied voltage of the selecting line SEL in FIG. 34, 0 V is used in a low-level state, and 10 V is used in a high-level state. However, the applied voltage is not limited to the values. That is, of voltages applied to the SEL, a low-level voltage value may be set within a range in which the low-level voltage is given to the gate of the transistor T3 to make it possible to completely turn off the transistor T3. A high-level voltage value may be set within a range in which the high-level voltage is given to the gate of the transistor to make it possible to turn on the transistor one terminal of which +5 V is applied to and to turn on the transistor T1 by raising the potential of the output node N2 in the case A.

(Fourth to Fifth Types)

As described above, the pixel circuit 2D of the fourth type and the pixel circuit 2E of the fifth type that belong to the group X cannot execute the self-polarity-inverting action of this embodiment. In the group Y, the selecting line SEL and the boost line BST are common to each other unlike each circuit configuration of the group X, and a configuration is restricted more than that of the group X. Therefore, in the same type, when a pixel circuit belonging to the group X cannot execute a self-polarity-inverting action, the self-polarity-inverting action cannot be executed with respect to the pixel circuit belonging to the group Y as a matter of course.

(Sixth Type)

Figure 23:
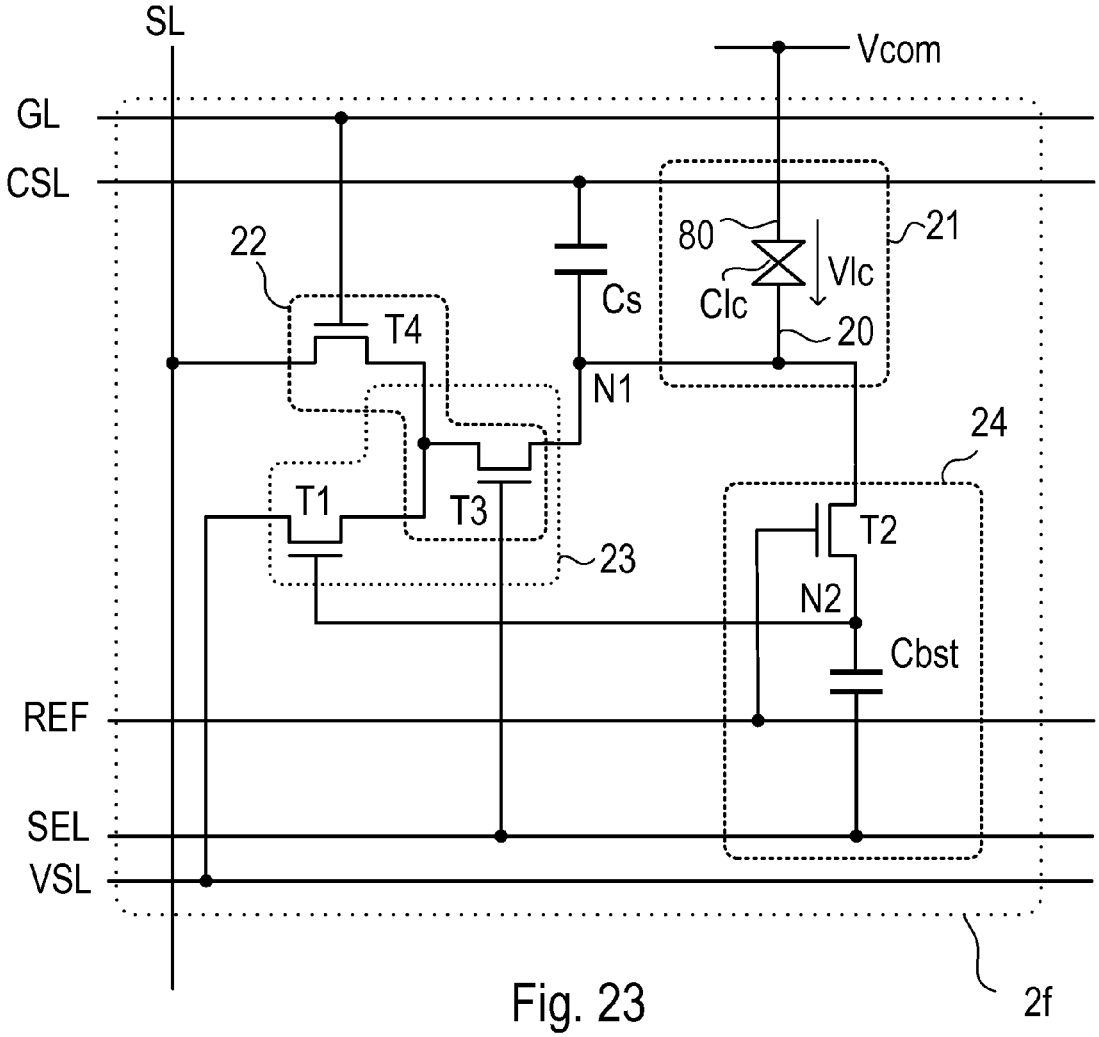
FIG. 23 is a circuit diagram showing a circuit configuration of a sixth type belonging to the group Y of the pixel circuit of the present invention.

When a pixel circuit 2*f* shown in FIG. 23 is compared with the pixel circuit 2F shown in FIG. 17, the selecting line SEL and the boost line BST are common to each other. In this case, referring to the timing chart of the self-polarity-inverting action in the pixel circuit 2F of the group X shown in FIG. 33, rising timings of voltage pulses of the selecting line SEL and the boost line BST are different from each other. Therefore, the timing chart in FIG. 33 cannot be applied to the pixel circuit 2*f* of the group Y without being changed. An explanation will be arbitrarily made with reference to the timing chart in FIG. 33.

After the high-level voltage (10 V) is applied to the selecting line SEL in the phase P11, until the voltage of the reference line REF is increased again, the applied voltage of the selecting line SEL needs to be maintained at a high level as in the first type of the group Y. That is, meanwhile, the second switch circuit 23 in the case A continues to be in the conducting state.

On the other hand, as shown in FIG. 33, the pixel circuit 2F of the sixth type of the group X needs to supply a voltage in the second voltage state (0 V) from the voltage supply line VSL to the internal node N1. This point is not different from that in the pixel circuit 2*f* of the group Y.

The pixel circuit 2*f*, like the pixel circuit 2F, can control the voltage value of the voltage supply line VSL without any influence from a potential of other signal lines because the voltage supply line VSL is an independent signal line. More specifically, as in the timing chart shown in FIG. 33, in the phase P14, in order to set the potential of the internal node N1 to the first voltage state in both the cases A and B, in this period, the voltage supply line VSL may also be set to the first voltage state. Thereafter, when the voltage supply line VSL is decreased to the second voltage state, in only the case A in which the second switch circuit 23 is in a conducting state, the internal node N1 decreases to the second voltage state (0 V).

Under the control, self-polarity inversion can be executed to the pixel circuit 2*f* of the sixth type of the group Y as in the pixel circuit 2F of the sixth type of the group X. Since the timing chart of the self-polarity-inverting action of the present type is completely the same as the timing chart of the third type of the group Y shown in FIG. 34, the timing chart is not shown.

Fourth Embodiment

In the fourth embodiment, a case in which self-polarity inversion is performed on the basis of a sequence different from that in the third embodiment will be described with reference to the accompanying drawings. Constituent elements that control voltage application to each signal line are the same as those in the third embodiment.

As in the third embodiment, voltages are applied to all the gate lines GL, the source lines SL, the selecting lines SEL, the reference lines REF, the auxiliary capacitive lines CSL, the boost lines BST, and the counter electrode 80 that are connected to the pixel circuits 2 targeted by the self-polarity-inverting action at the same timing. At the same timing, the same voltage is applied to all the gate lines GL, the same voltage is applied to all the reference lines REF, the same voltage is applied to all the auxiliary capacitive lines CSL, and the same voltage is applied to all the boost lines BST.

<1. Group X>

A self-polarity-inverting action for a pixel circuit in which the boost line BST is connected to the second terminal of the boost capacitor element Cbst and that belongs to the group X will be described first.

(First Type)

Figure 35:
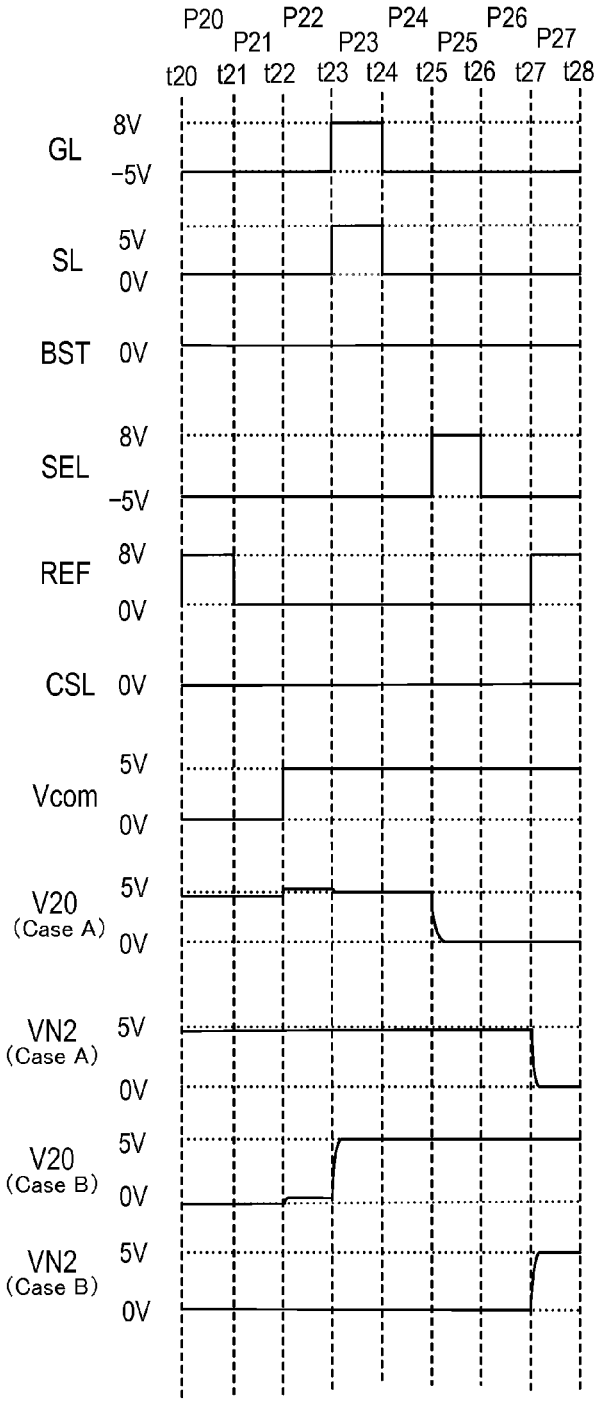
FIG. 35 is another timing chart of the self-polarity-inverting action performed by the pixel circuit of the first type of the group X.

A timing chart of a self-polarity-inverting action according to the method of the embodiment in the pixel circuit 2A of the first type shown in FIG. 8 is shown in FIG. 35. As shown in FIG. 35, the self-polarity-inverting action is exploded into eight phases P20 to P27. Start times of the phases are represented by t20, t21, . . . , t27, respectively. FIG. 35 shows voltage waveforms of all the gate lines GL, the source lines SL, the selecting lines SEL, the reference lines REF, the auxiliary capacitive lines CSL, and the boost lines BST that are connected to the pixel circuits 2A targeted by the self-polarity-inverting action, and a voltage waveform of the counter voltage Vcom. In the embodiment, all the pixel circuits of the pixel circuit array are targeted by the self-polarity-inverting action.

<<Phase P20>>

In a phase P20 started from time t20, an initial state setting operation before the self-polarity-inverting action is started is performed.

Application voltages to the gate line GL, the source line SL, the selecting line SEL, the boost line BST, and the auxiliary capacitive line CSL and the counter voltage Vcom are the same as those in the phase P10 in the third embodiment.

A voltage value that sets the transistor T2 to a conducting state is applied to the reference line REF regardless of a voltage state of the internal node N1. The voltage is necessarily higher than the voltage in the phase P10 in the third embodiment. The voltage is set to 8 V here. In this manner, the transistor T2 exhibits a conducting state in both the cases A and B.

In this manner, in both the cases A and B, the nodes N1 and N2 exhibit the same potential. Both the nodes exhibit the first voltage state in the case A, and both the nodes exhibit the second voltage state in the case B. At this time, the transistor T1 exhibits a cut-off state.

<<Phase P21>>

In the phase P21 started from time t21, the reference line REF is set at a low level (0 V), and the transistor T2 is turned off in both the cases A and B. In this manner, the output node N2 is blocked from the internal node N1 in both the cases A and B.

<<Phase P22>>

In a phase P22 started from time t22, the counter voltage Vcom shifts to a high level (5 V). In this manner, as in the phase P13, the potential V20 of the pixel electrode 20 increases by about 1 V in each of the cases A and B. On the other hand, the output node N2 is not influenced by an increase in counter voltage Vcom because the transistor T2 is in an off state, and an immediately previous potential is kept. During a period from time t22 (when the phase P22 is started) to a point immediately before t25 (when the phase P25 is started), an absolute value of the liquid crystal voltage Vlc is different from that obtained at a point of time t20, and, theoretically, after the point of time, a displayed image changes. However, a period until polarity inversion is finally completed is shortened to make a time for a temporary change of the display state short, and a variation in average value of the liquid crystal voltage Vlc becomes so small that the variation cannot be visually sensed by a human being. After time t25, the absolute value of the liquid crystal voltage Vlc is the same as that obtained immediately before time t21 in both the cases A and B.

<<Phase P23>>

In a phase P23 started from time t23, a high-level voltage is applied to the gate line GL to set the transistor T4 to a conducting state. The voltage is set to 8 V here. In this manner, in the pixel circuit 2A, the first switch circuit 22 is set to a conducting state.

An application voltage to the source line SL shifts to the first voltage state (5 V). In this manner, the potential V20 of the internal node N1 is shifted to the first voltage state regardless of the cases A and B. Since the transistor T2 is in a non-conducting state, the potential VN2 of the node N2 is still kept in the state in the phase P22.

<<Phase P24>>

In a phase P24 started from time t24, a low-level voltage is applied to the gate line GL again to set the transistor T4 to a non-conducting state. In this manner, the first switch circuit 22 is set to a non-conducting state. An applied voltage to the source line SL shifts to the second voltage state (0 V). Since the first switch circuit 22 is in a non-conducting state, the potential of the internal node N1 is kept at the value in the phase P23.

At this time, when the transistor T4 is completely turned off, the first voltage state (5 V) of the internal node N1 varies by capacitive coupling between the gate of the transistor T4 and the internal node N1. In this case, a voltage of the auxiliary capacitive line CSL may be adjusted, and the variation in voltage of the internal node N1 may be compensated for by capacitive coupling through a second capacitor element C2. The same applies to other types to which the self-polarity-inverting action can be executed.

<<Phase P25>>

In a phase P25 started from time t25, a voltage is applied to the selecting line SEL such that the transistor T3 is completely turned on. The voltage is set to 8 V here.

At this time, in the case A, the potential VN2 of the output node N2 is about 5 V, and 0 V is applied to the source line SL. For this reason, the transistor T1 is turned on. More specifically, the second switch circuit 23 is set to a conducting state. Immediately before time t25, the potential V20 of the internal node N1 exhibits about 5 V, and 0 V is applied to the reference line REF. Thus, a current is generated from the internal node N1 to the reference line REF through the second switch circuit 23. In this manner, the potential V20 of the internal node N1 transitions to the second voltage state (0 V). On the other hand, in the case B, since the VN2 is about 0 V, the transistor T1 is still in an off state. That is, the second switch circuit 23 is in a non-conducting state, and the potential of the internal node N1 is kept at 5 V.

At this time, −5 V is applied to the liquid crystal voltage Vlc in the case A, and ±0 V is applied to the liquid crystal voltage Vlc in the case B. Therefore, polarity inversion has been completed. Thereafter, the displayed image returns to the image that is displayed immediately before the self-polarity-inverting action is started. After a phase P25, since the absolute value of the Vlc does not change, the displayed image does not change.

<<Phase P26>>

In a phase P26 started from time t26, an application voltage to the selecting line SEL returns to a low level (0 V) to set the transistor T3 to a non-conducting state. In this manner, the internal node N1 is electrically separated from the reference line REF.

<<Phase P27>>

In a phase P27 started from time t27, regardless of the cases A and B, a voltage is applied to reference line REF such that the transistor T2 is set to a conducting state. The voltage is set to 8 V here.

In this manner, in both the cases A and B, the nodes N1 and N2 are electrically connected to each other and have the same potential. Since a parasitic capacitance of the internal node N1 is larger than that of the output node N2, the potential of the output node N2 changes toward the potential of the internal node N1. In this manner, the potential V20 of the node N2 is set to the second voltage state (0 V) in the case A, and is set to the first voltage state (5 V) in the case B.

When a configuration that is shown in FIG. 9 and in which one terminal of the transistor T1 is directly connected to the source line SL is employed as the pixel circuit 2A of the first type, 5 V is applied to the node N2, and 0 V is applied to the source line SL. For this reason, since a potential difference that is equal to or larger than a threshold voltage is generated between the gate and the source of the transistor T1, the transistor T1 is set to a conducting state in the phase P20. This state is continued until the phase P24. After the phase P25, the same actions as those in the pixel circuit in FIG. 8 are performed.

In the method of this embodiment, the self-polarity-inverting action can be executed without raising the node N2 by applying a high-level voltage to the boost line BST.

The first switch circuit 22 is set to a conducting state only during the phase P23, and the first switch circuit 22 is not set to a conducting state in other phases. For this reason, the source line SL may be maintained in the first voltage state (5 V) throughout the phases. The same applies to the other types.

Inversion of the counter voltage Vcom in the phase P22 need only be performed before high-level voltage application to the gate line GL in the phase P23 is ended. After fall time t21 of an application voltage on the reference line REF, the counter voltage Vcom can be inverted before fall time t24 of an applied voltage on the gate line GL. The same applies to other types to which the self-polarity-inverting action can be executed.

(Second Type)

In the pixel circuit 2B of the second type shown in FIG. 11, when 0 V is applied to the auxiliary capacitive line CSL in programming, the self-polarity-inverting action can be executed as in the third embodiment.

As described in the first type, in the self-polarity-inverting action, after a voltage of 5 V in the first voltage state is given from the source line SL to the nodes N1 through the first switch circuit 22 in both the cases A and B, in only the case A, a voltage of 0 V in the second voltage state needs to be given from the reference line REF also serving as the voltage supply line VSL to the node N1 through the second switch circuit 23. In the second type, only in the case A, the voltage of 0 V in the second voltage state may be given from the auxiliary capacitive line CSL also serving as the voltage supply line VSL to the internal node N1 through the second switch circuit 23. For this purpose, 0 V needs to be applied to the auxiliary capacitive line CSL as in the third embodiment.

Figure 36:
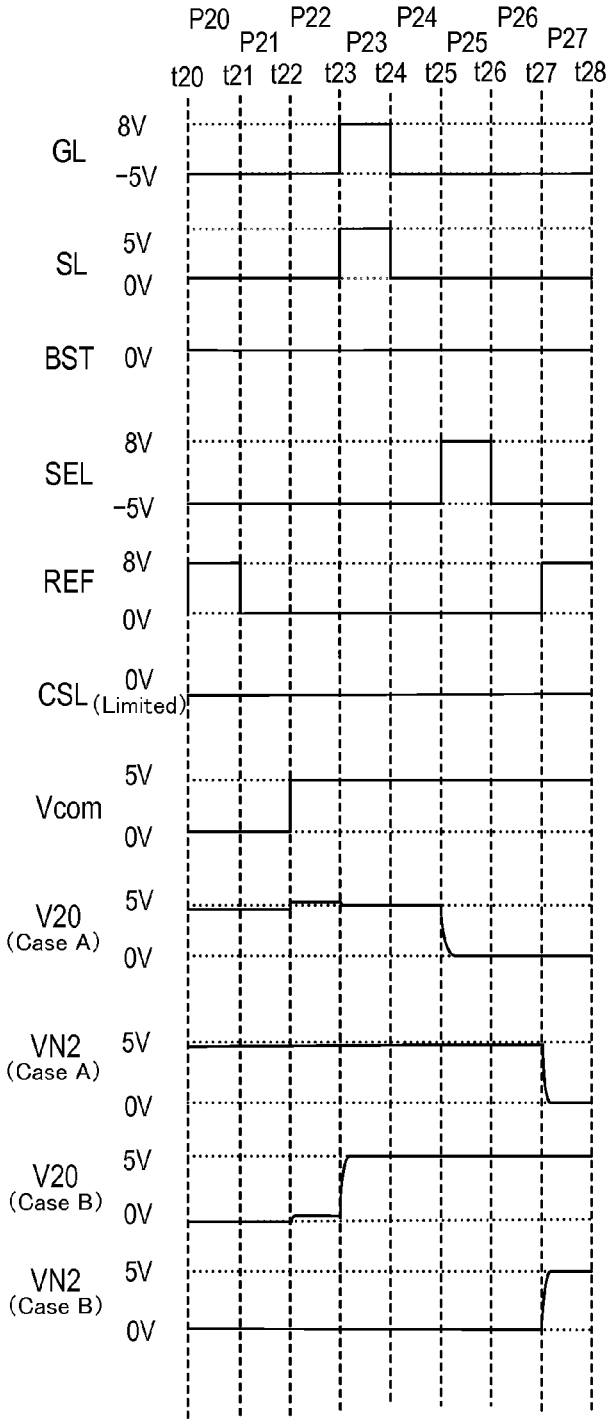
FIG. 36 is another timing chart of the self-polarity-inverting action performed by the pixel circuit of the second type of the group X.

Based on the above circumstances, in the second type, it can be understood that the self-polarity-inverting action can be executed by the same voltage applying method as that in the phases P20 to P27 described in the first type except that an applied voltage to the auxiliary capacitive line CSL is limited to 0 V. Thus, a timing chart of the self-polarity-inverting action in the pixel circuit of the second type shown in FIG. 36 is the same as that in the first type shown in FIG. 35 except that the applied voltage to the auxiliary capacitive line CSL is limited to 0 V. In FIG. 36, "0 V (limited)" is expressed in a column for the applied voltage of the auxiliary capacitive line CSL to clearly show that 5 V cannot be employed as an applied voltage to the auxiliary capacitive line CSL.

As in the third embodiment, in this type, when voltage adjustment is performed for the auxiliary capacitive line CSL to compensate for a variation in voltage state of the internal node N1 at a point of time in the phase P15, in the phase P23 in which a high-level voltage is applied to the gate line GL, the voltage of the auxiliary capacitive line CSL may be dislocated in a reverse direction by an adjusted voltage in advance and set to 0 V (the second voltage state) at the start (t24) of the phase P24.

(Third Type)

In the pixel circuit 2C of the third type shown in FIG. 12, the voltage supply line VSL is arranged as an independent signal line. For this reason, after a voltage of 5 V in the first voltage state is given from the source line SL to the nodes N1 through the first switch circuit 22 in both the cases A and B, in only the case A, a voltage of 0 V in the second voltage state is given from the voltage supply line VSL to the node N1 through the second switch circuit 23 to make it possible to realize a self-polarity-inverting action.

Figure 37:
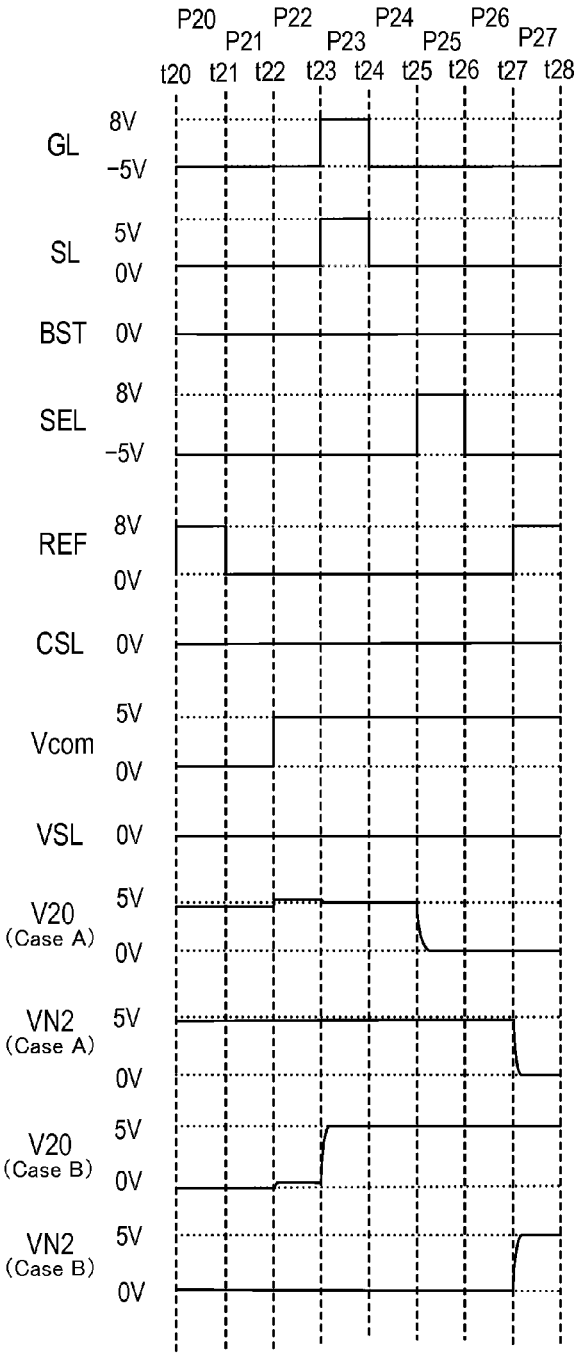
FIG. 37 is another timing chart of the self-polarity-inverting action performed by the pixel circuit of the third type of the group X.

Thus, it can be understood that, in the phase P25 of the first type, when a voltage in the second voltage state (0 V) is applied to the voltage supply line VSL, the self-polarity-inverting action can be executed by the same voltage applying method as that in the phases P20 to P27 described in the first type. FIG. 37 is a timing chart of a self-polarity-inverting action of the pixel circuit of the third type. FIG. 37 shows the case in which 0 V is applied to the auxiliary capacitive line CSL. However, when 5 V is applied to the auxiliary capacitive line CSL in an immediately previous programming action, 5 V may be continuously applied even in the self-polarity-inverting action. In FIG. 37, the voltage supply line VSL is set to the second voltage state (0 V) throughout the phases P20 to P27. However, the voltage supply line VSL may be set to the second voltage state in at least the phase P25.

In the present type, since the voltage supply line VSL is independent, even though the transistor T3 is in an on state in the phase P23, when +5 V is applied to the VSL at this time, the potential of the internal node N1 can be set in the first voltage state. Based on this, a rise timing of the selecting line SEL can be advanced as in the third embodiment. The case will be described below with reference to FIG. 38.

The selecting line SEL rises to 8 V before the reference line REF is dropped to 0 V. With the rising of the selecting line SEL, 5 V is applied to the voltage supply line VSL. At this time, the transistor T3 is turned on, and 5 V is applied to, of the terminals of the transistor T1, a terminal on the opposite side of the internal node N1. However, in the case B, since the potential of the output node N2 is about 0 V, the transistor T1 is in an off state. Even in the case A, since the potential of the output node N2 is about V, a voltage that is equal to or higher than the threshold voltage is not applied across the gate and the source, and the transistor T1 is still in an off state.

The reference line REF is set to 0 V in the phase P22 to set the transistor T2 to an off state. Thereafter, as in the above embodiment, after the counter voltage Vcom is shifted to a high level (phase P23), the gate line GL is set to a high level, and a high-level voltage in the first voltage state is applied to the source line SL (phase P24). In this manner, the potential V20 of the internal node N1 is set to the first voltage state in each of both the cases as described above. Thereafter, in the phase P25, the gate line GL is shifted to a low level, and an applied voltage to the source line SL is shifted to the second voltage state.

The voltage supply line VSL is shifted to the second voltage state (0 V) in the phase P25. At this time, since the selecting line SEL has been set at a high level, the same voltage state as in the phase P25 in the timing chart in FIG. 37 is obtained. More specifically, the transistor T1 is set to a conducting state in only the case A, and the potential of the internal node N1 decreases to the second voltage state. On the other hand, in the case B, since the potential of the output node N2 is low, the transistor T1 is still in a non-conducting state. For this reason, the potential of the internal node N1 is continuously maintained in the first voltage state.

Thereafter, the same voltage supply state as that in the timing chart in FIG. 37 need only be set. More specifically, after the selecting line SEL is shifted to a low level in the phase P26 to turn off the transistor T3, the reference line REF is shifted to a high level in the phase P27 to turn on the transistor T2. In this manner, the potential V20 of the internal node N1 appears at the output node N2.

In this manner, when the voltage supply line VSL is independently present as in the present type, when the internal node N1 is set to the first voltage state through the transistor T4, the voltage supply line VSL can be set to the first voltage state. Thus, the selecting line SEL can be shifted to a high level in a stage before the gate line GL is shifted to a high level.

(Fourth to Fifth Types)

For the same reason as that in the third embodiment, the self-polarity-inverting action according to the present embodiment cannot be executed to the pixel circuit 2D of the fourth type shown in FIG. 15 and the pixel circuit 2E of the fifth type shown in FIG. 16.

(Sixth Type)

In the pixel circuit 2F of the sixth type shown in FIG. 17, after a voltage of 5 V in the first voltage state is given from the source line SL to the node N1 through the first switch circuit 22 in each of both the cases A and B in the phase P23, in the phase P25, in only the case A, a voltage of 0 V in the second voltage state needs to be given from the voltage supply line VSL to the node N1 through the second switch circuit 23. In this case, in the sixth type, in both cases in which the first switch circuit 22 is set to a conducting state, and in which the second switch circuit 23 is set to a conducting state, the transistor T3 needs to be turned on. More specifically, in the timing chart of the third type shown in FIG. 37, a high-level voltage needs to be applied to the selecting line SEL in the phase P23 to set the transistor T3 to a conducting state.

At this time, in the case A, although the first switch circuit 22 and the second switch circuit 23 are set to a conducting state in the phase P23, when a voltage of 5 V in the first voltage state is applied to the voltage supply line VSL, the potential V20 of the internal node N1 can be set to the first voltage state even in the case A. Subsequently to the phase P25, when 0 V in the second voltage state is given to the voltage supply line VSL, in only the case A in which the second switch circuit 23 is in a conducting state, the potential V20 of the internal node N1 decreases to 0 V, 5 V is continuously maintained in the case B in which the second switch circuit 23 is in a non-conducting state.

When the above description is summarized, in the pixel circuit of the sixth type, the applied voltage of the voltage supply line VSL is set to the first voltage state (5 V) in the phase P23. Thereafter, the applied voltage of the voltage supply line VSL is set to the second voltage state (0 V) in the phase P25, and other signal lines are set to the same voltage in the timing chart of the third type to make it possible to execute the self-polarity-inverting action. A timing chart of the pixel circuit of the sixth type is shown in FIG. 39.

Figure 38:
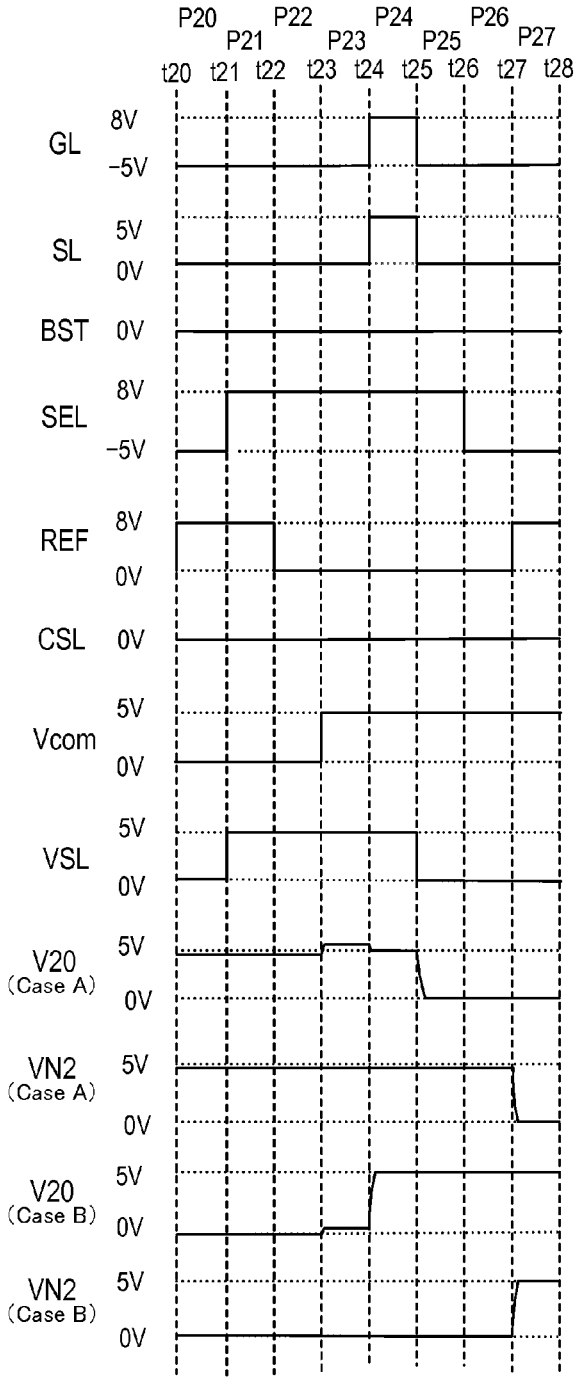
FIG. 38 is still another timing chart of the self-polarity-inverting action performed by the pixel circuit of the third type of the group X.
Figure 39:
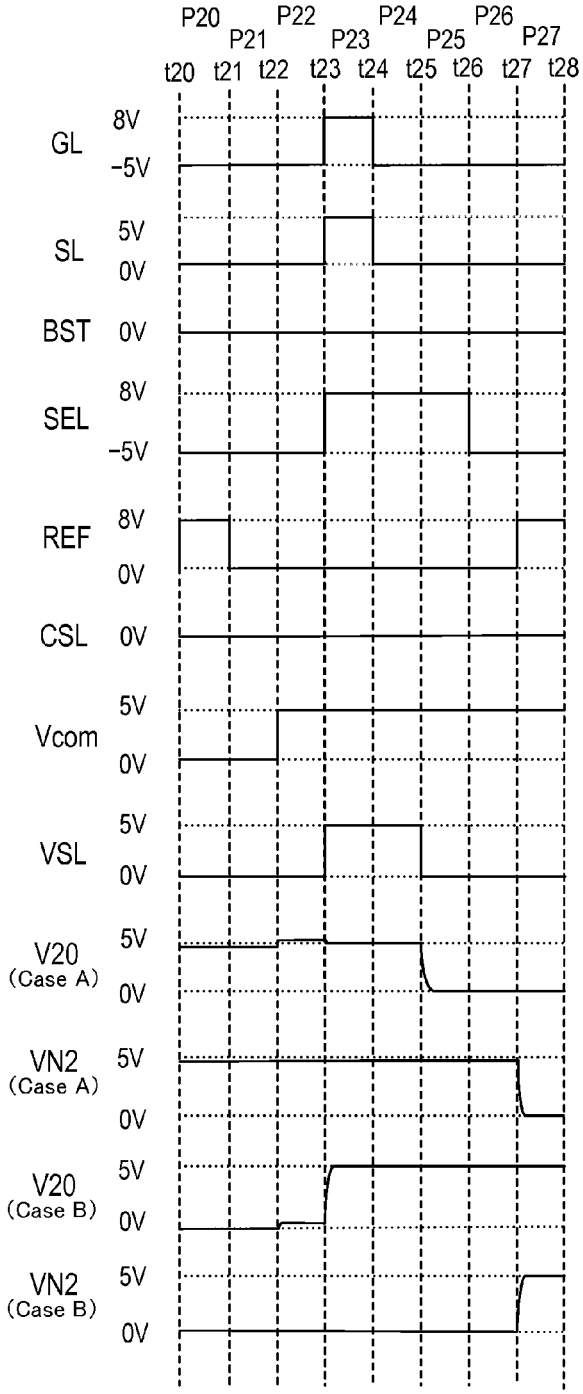
FIG. 39 is another timing chart of the self-polarity-inverting action performed by the pixel circuit of the sixth type of the group X.

Referring to FIG. 39, 8 V (high-level voltage) is applied to the selecting line SEL when the gate line GL is shifted to a high level, and the transistor T3 is set to a conducting state. Thus, it is understood that a self-polarity-inverting action can also be executed in the present type by the same voltage applying method as that of the third type shown in FIG. 38. Since a timing chart to be used is the same as that in FIG. 38, an explanation of the timing chart will be omitted.

<2. Group Y>

A self-polarity-inverting action for each pixel circuit in which the selecting line SEL is connected to the second terminal of the boost capacitor element Cbst and that belongs to the group Y will be described below.

(First, Second, Fourth, and Fifth Types)

An action of the pixel circuit 2*a* of the first type of the group Y shown in FIG. 18 will be described first with reference to the timing chart of the pixel circuit of the first type of the group X shown in FIG. 35. As described above, in the present embodiment, the selecting line SEL needs to be shifted to a high-level voltage at a point of time in the phase P25 to set the transistor T3 to a conducting state.

In this case, at the point of time in the phase P25, 0 V is applied to the reference line REF, and the transistor T2 is in a non-conducting state.

Thus, when the pixel circuit 2*a* of the first type of the group Y is set to the same voltage state as that in the phase P25, a potentials of the output node N2 is pushed up by an increase in voltage of the selecting line SEL in each of both the cases A and B. As a result, the transistor T1 exhibits an on state in each of both the cases, and the second switch circuit 23 is set to a conducting state.

Thus, the internal node N1 shifts to the second voltage state (0 V) in each of the cases A and B in the phase P25, and the self-polarity-inverting action is not executed.

The above explanation is also applied to the pixel circuits 2*b*, 2*d*, and 2*e* of the second, fourth, and fifth types. More specifically, in the method of the present embodiment, the self-polarity-inverting action cannot be executed to each of the pixel circuits of the first, second, fourth, and fifth types of the group Y.

(Third, Sixth Types)

Of the voltage applying methods in the pixel circuit 2*c* of the third type and the pixel circuit 2C of the third type of the group X, the method shown in FIG. 38 is used to make it possible to perform self-polarity inversion.

More specifically, after 8 V is applied to the reference line REF in the phase P20 to set the transistor T2 to a conducting state, a high-level voltage is applied to the selecting line SEL in the phase P21, and 5 V is applied to the voltage supply line VSL. In the pixel 2*c* of the present type, although the selecting line SEL is connected to one terminal of a first capacitor element Cbst, the transistor T2 is set to a conducting state in both the cases A and B. For this reason, even though a voltage level of the selecting line SEL rises, a potential of the output node N2 rarely rises. At this time, the transistor T3 is turned on, and 5 V is applied to, of the terminals of the transistor T1, a terminal on the opposite side of the internal node N1. However, in the case B, since the potential of the output node N2 is about 0 V, the transistor T1 is in an off state. Even in the case A, since the potential of the output node N2 is about 5 V, a voltage that is equal to or higher than the threshold voltage is not applied across the gate and the source, and the transistor T1 is still in an off state. In the case A, the transistor T1 may be set in an on state depending on the value of the threshold voltage. However, in this case, the internal node N1 is only self-refreshed into the first voltage state by applying the voltage in the first voltage state to the internal node N1 without any problem.

The reference line REF is set to 0 V in the phase P22 to set the transistor T2 to an off state. Thereafter, after the counter voltage Vcom is shifted to a high level (phase P23), the gate line GL is set to a high level, and a high-level voltage in the first voltage state is applied to the source line SL (phase P24). In this manner, the potential V20 of the internal node N1 is set to the first voltage state in each of both the cases as described above. Thereafter, in the phase P25, the gate line GL is shifted to a low level, and an applied voltage to the source line SL is shifted to the second voltage state.

The voltage supply line VSL is shifted to the second voltage state (0 V) in the phase P25. At this time, since the selecting line SEL has been at a high level, the transistor T1 is set to a conducting state only in the case A, and a potential of the internal node N1 decreases to the second voltage state. On the other hand, in the case B, since the potential of the output node N2 is low, the transistor T1 is still in a non-conducting state. For this reason, the potential of the internal node N1 is continuously maintained in the first voltage state.

Thereafter, the reference line REF is set at a high level, and the reference line REF is shifted to a high level to turn on the transistor T2 in the phase P26. In this manner, the potential V20 of the internal node N1 appears at the output node N2.

After the transistor T2 is turned on in the phase P26, the selecting line SEL is shifted to a low level in the phase P27. In this manner, the node N2 is slightly influenced by a variation in potential. When voltage application is performed by the above procedures, the self-polarity-inverting action is executed. A timing chart obtained at this time is shown in FIG. 40.

Figure 40:
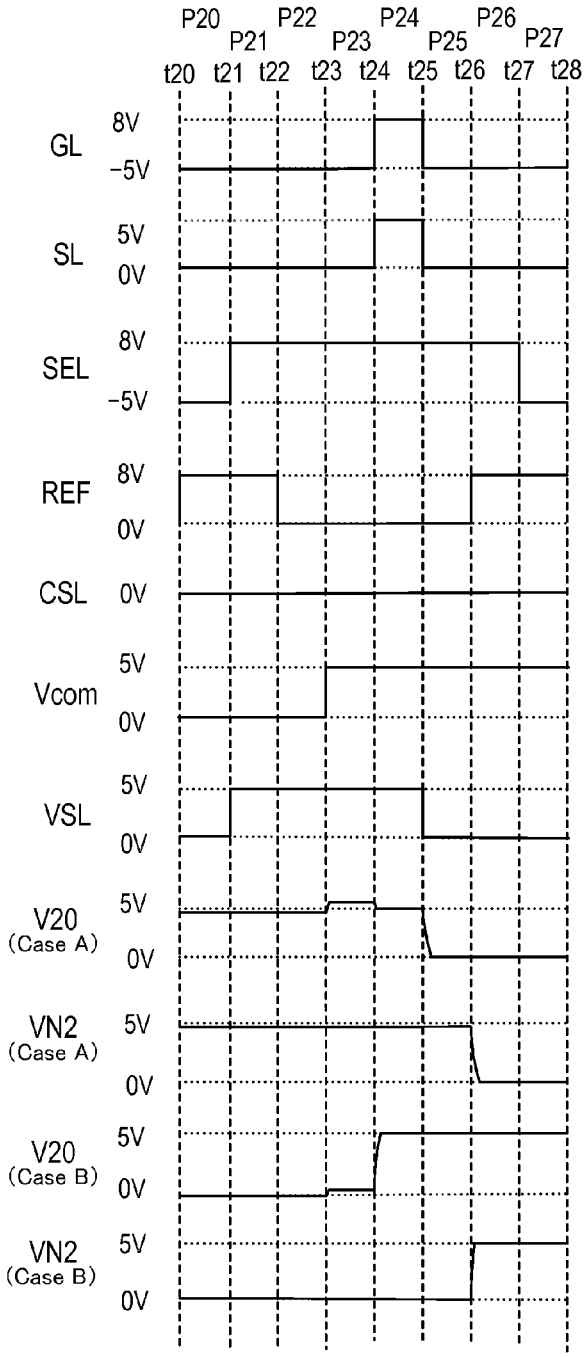
FIG. 40 is another timing chart of the self-polarity-inverting action performed by the pixel circuit of the third type of the group Y.

Referring to FIG. 40, 8 V (high-level voltage) is applied to the selecting line SEL when the gate line GL is shifted to a high level, and the transistor T3 is set to a conducting state. Thus, it is understood that a self-polarity-inverting action can be executed by the same voltage applying method to the pixel circuit 2*f* of the sixth type. Since a timing chart to be used is the same as that in FIG. 40, an explanation of the timing chart will be omitted.

Fifth Embodiment

In the fifth embodiment, a programming action in an always-on display mode will be described in units of types with reference to the accompanying drawings.

In the programming action in the always-on display mode, pixel data of one frame is divided in units of display lines in a horizontal direction (row direction), and a binary voltage corresponding to each pixel data of one display line, i.e., a high-level voltage (5 V) or a low-level voltage (0 V) is applied to the source lines SL of the columns for each horizontal period. A selected raw voltage of 8 V is applied to the gate line GL of a selected display line (selected row) to set the first switch circuits 22 of all the pixel circuits 2 of the selected row to a conducting state, and voltages of the source lines SL of the columns are transferred to the internal node N1 of each of the pixel circuits 2 of the selected row.

A non-selected row voltage of −5 V is applied to the gate lines GL of display lines (non-selected rows) except for the selected display lines to set the first switch circuits 22 of all the pixel circuits 2 of the non-selected row to a non-conducting state. Timing control of a voltage application of each signal line in a programming action (will be described later) is performed by the display control circuit 11, and each voltage application is performed by the display control circuit 11, the counter electrode drive circuit 12, the source driver 13, and the gate driver 14.

<1. Group X>

A programming action in the always-on display mode for each pixel circuit in which the boost line BST is connected to the control terminal of the transistor T3 and that belongs to the group X will be described first.

(First Type)

Figure 41:
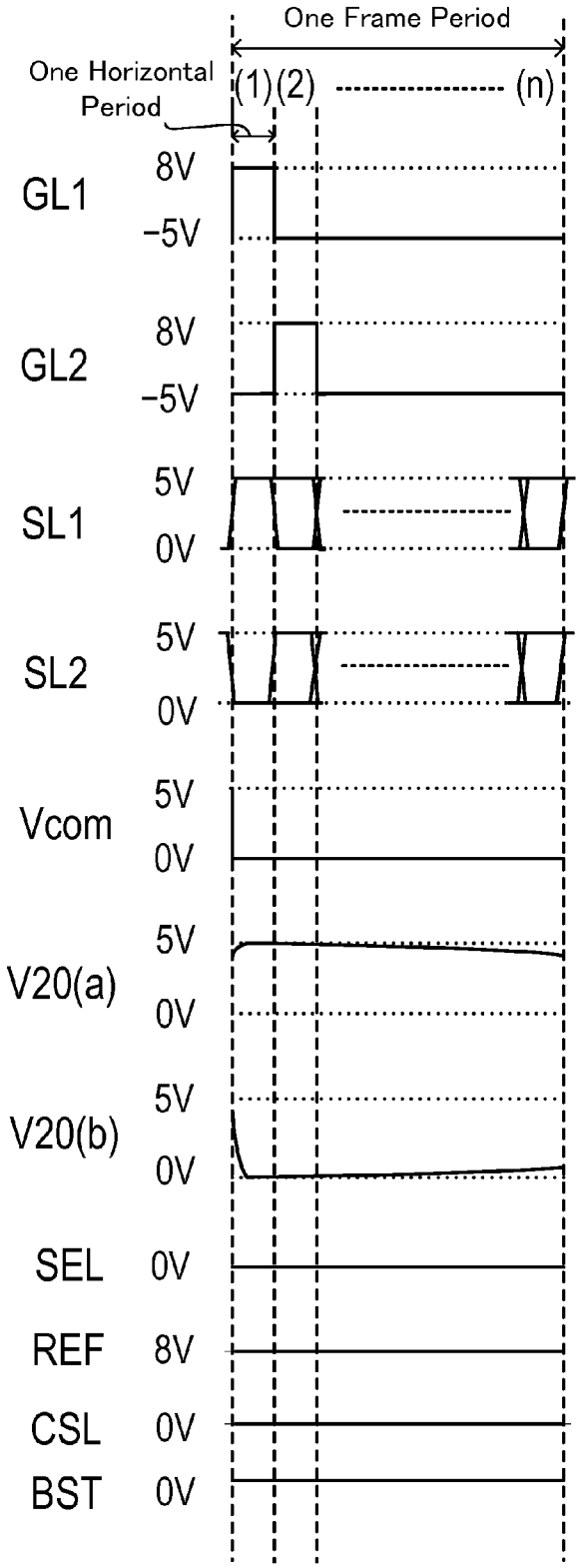
FIG. 41 is a timing chart of a programming action in an always-on display mode performed by the pixel circuit of the first type of the group X.

FIG. 41 is a timing chart of a programming action using the pixel circuit 2A of the first type (FIG. 8). FIG. 41 shows voltage waveforms of two gate lines GL1 and GL2, two source lines SL1 and SL2, the selecting line SEL, the reference line REF, the auxiliary capacitive line CSL, and the boost line BST in a 1-frame period and a voltage waveform of the counter voltage Vcom. Furthermore, in FIG. 41, voltage waveforms of the pixel voltages V20 of the internal nodes N1 of the two pixel circuits 2A are additionally shown. One of the two pixel circuits 2A is a pixel circuit 2A(a) selected by the gate line GL1 and the source line SL1, and the other is a pixel circuit 2A(b) selected by the gate line GL1 and the source line SL2. The pixel circuits are discriminated from each other by adding (a) and (b) to the backs of the pixel voltages V20 in FIG. 41.

A 1-frame period is divided into horizontal periods the number of which is the number of gate lines GL, and gate lines GL1 to GLn to be selected are sequentially allocated to the horizontal periods, respectively. FIG. 41 shows changes in voltage of the two gate lines GL1 and GL2 in the first two horizontal periods. In the first horizontal period, a selected-row voltage of 8 V is applied to the gate line GL1, and a non-selected row voltage of −5 V is applied to the gate line GL2. In the second horizontal period, the selected-row voltage of 8 V is applied to the gate line GL2, and the non-selected row voltage of −5 V is applied to the gate line GL1. In the subsequent horizontal periods, the non-selected row voltage of −5 V is applied to both the gate lines GL1 and GL2.

Voltages (5 V, 0 V) corresponding to pixel data of a display line corresponding to each horizontal period are applied to the source lines SL of the respective columns. In FIG. 41, the two source lines SL1 and SL2 are shown as typical source lines SL. In the example shown in FIG. 41, to explain a change of the pixel voltage V20, voltages of the two source lines SL1 and SL2 of the first horizontal period are separately set to 5 V and 0 V, respectively.

In the pixel circuit 2A of the first type, since the first switch circuit 22 is configured by only the transistor T4, connection/disconnection control of the first switch circuit 22 is sufficiently performed by on/off-controlling only the transistor T4. Furthermore, the second switch circuit 23 need not be set to a conducting state in the programming action, and, in order to prevent the second switch circuit 23 from being set to a conducting state in the pixel circuit 2A of a non-selected row, in a 1-frame period, a non-selected voltage of 0 V (may be −5 V) is applied to the selecting line SEL connected to all the pixel circuits 2A. The same voltage as that of the selecting line SEL is also applied to the boost line BST.

In order to always set the transistor T2 to an on-state regardless of a voltage state of the internal node N, 8 V higher than a high-level voltage (5 V) by a threshold voltage (about 2 V) or more is applied to the reference line REF in a 1-frame period. In this manner, the output node N2 and the internal node N1 are electrically connected to each other, and an auxiliary capacitor element Cs connected to the internal node N1 can be used to keep the pixel voltage V20 to stabilize the pixel voltage V20. The auxiliary capacitive line CSL is fixed to a predetermined fixed voltage (for example, 0 V). Although the counter AC drive is performed on the counter voltage Vcom, the counter voltage Vcom is fixed to 0 V or 5 V in a 1-frame period. In FIG. 41, the counter voltage Vcom is fixed to 0 V.

(Second and Third Types)

Referring to the timing chart of the programming action in the pixel circuit 2A of the first type shown in FIG. 41, a low-level voltage is always applied to the selecting line SEL throughout a 1-frame period. That is, the second switch circuit 23 is always in a non-conducting state.

Therefore, also in the pixel circuit 2B of the second type in which one terminal of the second switch circuit 23 is connected to the auxiliary capacitive line CSL or in the third type in which one terminal of the second switch circuit 23 is connected to the voltage supply line VSL, the programming action can be performed by the voltage application as that in the timing chart of the first type. In the third type, an applied voltage to the voltage supply line VSL may be set to 0 V.

In the third type, when 5 V (first voltage type) is applied to the voltage supply line VSL, even though 0 V is not applied to the selecting line SEL and the transistor T3 is not turned off, since the voltage of the control terminal of the transistor T1 is equal to that of the internal node N1, the transistor T1 in a diode connection state is set to a reverse bias state (off state) and the second switch circuit 23 is set to a non-conducting state.

(Fourth Type)

In the pixel circuit 2D of the fourth type shown in FIG. 13, the first switch circuit 22 is configured by a series circuit of the transistor T4 and the transistor T3, not only the transistor T4 but also the transistors T3 need to be set to a conducting state in programming. With respect to this point, a sequence is different from that in the pixel circuit of the first type.

Figure 42:
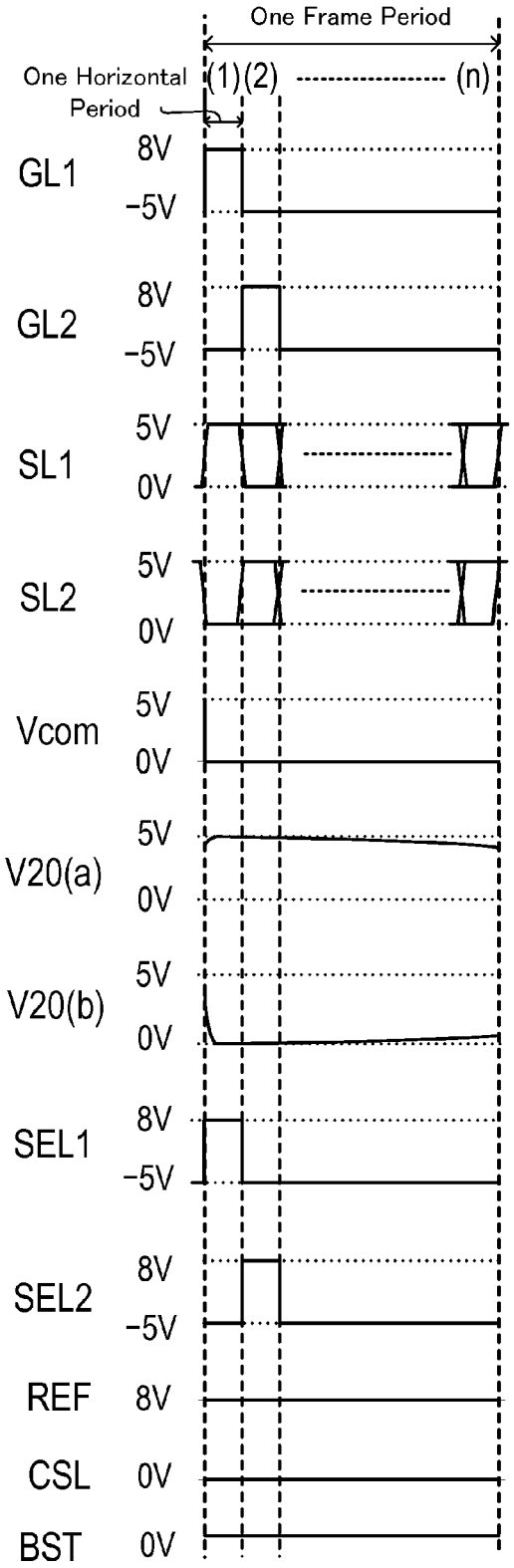
FIG. 42 is a timing chart of a programming action in an always-on display mode performed by the pixel circuit of the fourth type of the group X.

FIG. 42 is a timing chart of a programming action using the pixel circuit 2D of the fourth type. The items in FIG. 42 are the same as those in FIG. 41 except that two selecting lines SEL1 and SEL2 are shown.

Voltage application timings and voltage amplitudes of the gate lines GL (GL1, GL2) and the source lines SL (SL1, SL2) are all the same as those in FIG. 41.

In the pixel circuit 2D, since the first switch circuit 22 is configured by a series circuit of the transistor T4 and the transistor T3, when connection/disconnection of the first switch circuit 22 is controlled, in addition to the on/off control of the transistor T4, the on/off-control of the transistor T3 is required. Therefore, in the present type, all the selecting lines SEL are not controlled in a lump, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

FIG. 42 shows changes in voltage of the two selecting lines SEL1 and SEL2 in the first two horizontal periods. In the first horizontal period, a selecting voltage of 8 V is applied to the selecting line SEL1, and a non-selecting voltage of −5 V is applied to the selecting line SEL2. In the second horizontal period, the selecting voltage of 8 V is applied to the selecting line SEL2, and the non-selecting voltage of −5 V is applied to the selecting line SEL1. In the subsequent horizontal periods, the non-selecting voltage of −5 V is applied to both the selecting lines SEL1 and SEL2.

Voltages applied to the reference line REF, the auxiliary capacitive line CSL, and the boost line BST and the counter voltage Vcom are the same as those in the first type shown in FIG. 41. In a non-selected row, when the first switch circuit 22 is set to a non-conducting state, the transistor T4 is completely set to an off state. For this reason, a non-selecting voltage of the selecting line SEL to turn off the transistor T3 may not be −5 V but 0 V.

In the pixel circuit of the present type, the transistor T3 is set to a conducting state in programming. However, since 8 V is applied to the reference line REF, even though the internal node N1 is in the first voltage state, the transistor T1 is not turned on in a direction from the reference line REF to the transistor T3. For this reason, 8 V applied to the reference line REF is not given to the internal node N1 through the second switch circuit 23, and a correct programming voltage given to the source line SL is given to the node N1.

(Fifth Type)

Also in the pixel circuit 2E of the fifth type shown in FIG. 16, as in the fourth type, the selecting lines SEL are not controlled in a lamp, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

In the configuration of the present type, since the transistor T3 is set to a conducting state in programming, 5 V needs to be given to the auxiliary capacitive line CSL to prevent the potential V20 of the internal node N1 from being varied by setting the second switch circuit 23 to a conducting state. The remaining programming action can be performed by the same voltage applying method as that in the pixel circuit 2D of the fourth type.

(Sixth Type)

Also in the pixel circuit 2F of the sixth type shown in FIG. 17, as in the fourth type, the selecting lines SEL are not controlled in a lamp, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

In the configuration of the present type, the transistor T3 may be probably set to a conducting state in programming. That is, if, during the programming action, both the first switch circuit 22 and the second switch circuit 23 are in a conducting state and there is a voltage difference between the source line SL connected to one terminal of the first switch circuit 22 and the voltage supply line VSL connected to one terminal of the second switch circuit 23, a current path is generated between the source line SL and the voltage supply line VSL, a voltage of the node located therebetween varies, and the correct pixel voltage V20 may not be programmed in the internal node N1.

For this reason, when the voltage supply line VSL extends in a vertical direction (column direction) in parallel to the source line SL and independently driveably arranged in units of columns, as a method of solving the above problem, the voltage supply line VSL connected to one terminal of the second switch circuit 23 is driven at the same voltage as that of the source line SL connected to one terminal of the first switch circuit 22 pairing with the second switch circuit 23 to prevent a potential difference between the source line SL and the voltage supply line VSL from being generated.

Besides the above method, there is a driving method of solving the above problem by setting the first switch circuit 22 of a selected row to a non-conducting state.

Since 8 V is applied to the reference line REF to set the transistor T2 to an on state, a voltage of the control terminal of the transistor T1 is equal to the voltage of the internal node N1. Thus, 5 V (first voltage state) is applied to the voltage supply line VSL to turn the transistor T1 in a diode connection state to a reverse bias state (off state), and the first switch circuit 22 of a selected row can be set to a non-conducting state. According to this method, since the voltage supply line VSL need not be driven at the same voltage as that of the source line SL, even in a circuit configuration in which the voltage supply line VSL extends in a horizontal direction (row direction) in parallel with the gate line GL, a programming action can be performed.

<2. Group Y>

A programming action in an always-on display mode in each pixel circuit in which the selecting line SEL is connected to the second terminal of the boost capacitor element Cbst and that belongs to the group Y will be described below.

(First to Third Types)

Referring to the timing chart of the programming action in the pixel circuit 2A of the first type of the group X shown in FIG. 41, a low-level voltage is always applied to the selecting line SEL throughout a 1-frame period. More specifically, the second switch circuit 23 is always in a non-conducting state, and, furthermore, a voltage given to one terminal of the boost capacitor element Cbst does not vary.

Thus, even in the pixel circuits 2*a*, 2*b*, and 2*c* of the first to third types of the group Y, a programming action can be performed by the same voltage application as that of the timing chart of the first type of the group X. In the third type, an applied voltage to the voltage supply line VSL may be set to a fixed voltage. In this case, for example, 5 V may be applied such that the transistor T1 forming a diode connection is in a reverse bias state.

(Fourth to Sixth Types)

Referring to the timing chart of the programming action in the pixel circuit 2D of the fourth type of the group X shown in FIG. 42, a high-level voltage is applied to the selecting line SEL, and a low-level voltage is applied to a non-selected row.

In this case, in the pixel circuit 2*d* of the fourth type of the group Y, when a high-level voltage is applied to the selecting line SEL, a voltage given to one terminal of the boost capacitor element Cbst rises accordingly. However, a high-level voltage (8 V) is given to the reference line REF in the programming action, and the transistor T2 is in an on state. Thus, since the node N1 having a large parasitic capacitance is electrically connected to the node N2, the potential of the node N2 rarely rises. Thus, the variation in voltage of the selecting line SEL does not influence a circuit action, and a programming action can be performed by the same voltage applying method as that in the pixel circuit 2D of the fourth type of the group X. Even in the fifth to sixth types, a programming action can be realized by the same voltage application as that in the fifth to sixth types of the group X.

Sixth Embodiment

In the sixth embodiment, a relationship between a self-refresh action and a programming action in an always-on display mode will be described.

In the always-on display mode, after a programming action is executed to image data of one frame, display contents obtained by the immediately previous programming action can be maintained without performing the programming action in a predetermined period.

By the programming action, a voltage is given to the pixel electrode 20 in each pixel through the source line SL. Thereafter, the gate line GL is set at a low level, and the transistor T4 is set to a non-conducting state. However, a potential of the pixel electrode 20 is kept by the presence of electric charges accumulated in the pixel electrode 20 by the immediately previous programming action. More specifically, the voltage Vlc is maintained between the pixel electrode 20 and the counter electrode 80. In this manner, even after the programming action is completed, a state in which a voltage required to display image data is applied across both the terminals of the liquid crystal capacitance Clc continues.

When a potential of the counter electrode 80 is fixed, the liquid crystal voltage Vlc depends on the potential of the pixel electrode 20. The potential varies with time based on occurrence of a leakage current of a transistor in the pixel circuit 2. For example, when a potential of the source line SL is lower than a potential of the internal node N1, a leakage current flowing from the internal node N1 to the source line SL is generated, and the pixel voltage V20 decreases with time. In contrast to this, when the potential of the source line SL is higher than the potential of the internal node N1, a leakage current flowing from the source line SL to the internal node N1 is generated, a potential of the pixel electrode 20 increases with time. More specifically, when time has elapsed without performing an external programming action, the liquid crystal voltage Vlc gradually changes. As a result, a displayed image changes.

In a normal display mode, a programming action is executed to all the pixel circuits 2 for each frame even in a still image. Therefore, electric charges accumulated in the pixel electrode 20 need only be maintained in a one-frame period. Since a variation in potential of the pixel electrode 20 in a 1-frame period at most is very small, the variation in potential meanwhile does not give an influence that is enough to be visually confirmed to image data to be displayed. For this reason, in the normal display mode, the variation in potential of the pixel electrode 20 does not cause a serious problem.

In contrast to this, in the always-on display mode, a programming action is not configured to be executed for each frame. Thus, while the potential of the counter electrode 80 is fixed, depending on the circumstances, the potential of the pixel electrode 20 needs to be held throughout several frames. However, when the pixel circuit is left without performing a programming action for several frame periods, a potential of the pixel electrode 20 intermittently varies due to generation of the leakage current described above. As a result, image data to be displayed may be changed enough to be visually confirmed.

Figure 43:
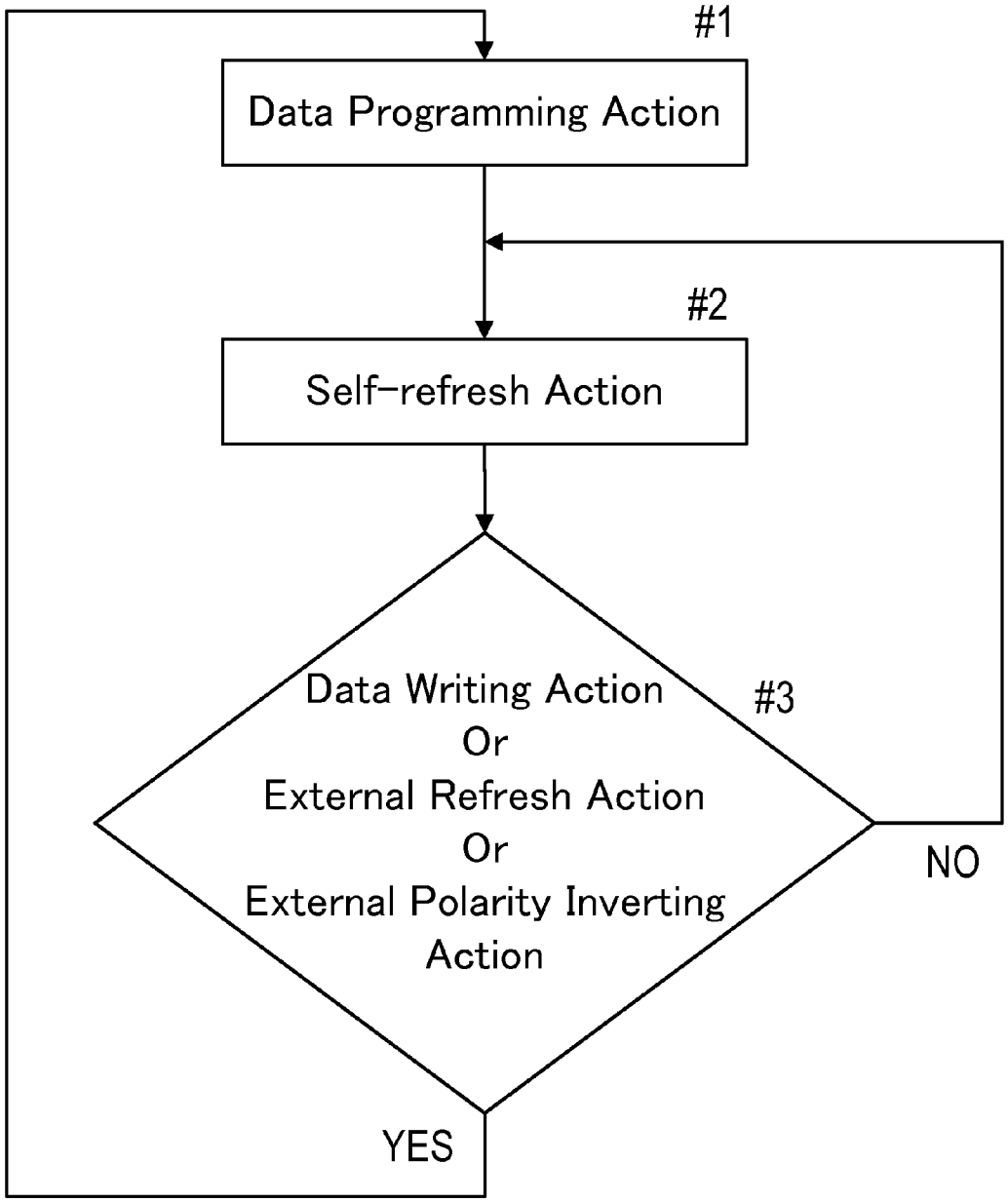
FIG. 43 is a flow chart showing procedures of the programming action and a self-refresh action in the always-on display mode.

In order to avoid the phenomenon, in the always-on display mode, by the manner shown in the flow chart in FIG. 43, the self-polarity-inverting action and the programming action are executed in combination with each other to considerably reduce a power consumption while suppressing a variation in potential of the pixel electrode.

A programming action of pixel data of one frame in the always-on display mode is executed by the manner described in the above fifth embodiment (step #1).

After the programming action in step #1, a self-refresh action is executed by the manner described in the above second embodiment (step #2). The self-refresh action is realized by the phase P1 that applies a pulse voltage and the phase P2 that sets a standby state.

In this case, in a period of the phase P2 of the self-refresh action period, when a request for a programming action (data writing) of new pixel data, an external refresh action, or an external polarity inverting action is received (YES in step #3), the control flow returns to step #1 to execute the programming action of the new pixel data or previous pixel data. In the period of the phase P2, when the request is not received (NO in step #3), the control flow returns to step #2 to execute the self-refresh action again. In this manner, a change of a display image by an influence of a leakage current can be suppressed.

A refresh action is to be performed by a programming action without performing a self-refresh action, a power consumption expressed by the relational expression shown in numerical expression 1 described above is obtained. However, when the self-refresh action is repeated at the same refresh rate, since the number of times of all source line voltages is one, the variable m in numerical expression 1 becomes 1. When VGA is supposed as a display resolution (the number of pixels), m=1920 and n=480. Thus, when a signal line configuring a voltage supply line is formed in parallel with the gate line GL as shown in FIGS. 1 and 3 to 5, a power consumption is expected to be reduced to one-1920$^{th}$ of it.

In the present embodiment, the self-refresh action and the external refresh action or the external polarity inverting action are combined to cope with the following case. That is, even in the pixel circuit 2 that normally operates at first, the second switch circuit 23 or the control circuit 24 is defected by aging, although a programming action can be performed without a trouble, a self-refresh action cannot be normally executed in some pixel circuits 2. More specifically, when only the self-refresh action is performed, displays of the corresponding pixel circuits 2 are deteriorated and the deterioration is fixed. However, when the external polarity inverting action is additionally used, the display defect can be prevented from being fixed.

In the pixel circuits (2B, 2*b*) of the second type, in order to realize the flow of the present embodiment, the auxiliary capacitive line CSL needs to be set to 5 V in step #1 to execute a programming action as described in the second embodiment.

Seventh Embodiment

In the seventh embodiment, a relationship between a self-polarity-inverting action and a programming action in an always-on display mode will be described.

In the always-on display mode, the programming action is not executed for each frame, and, after a predetermined number of frame periods have elapsed, the programming action is intermittently executed. Meanwhile, all the pixel circuits 2A are set to a non-conducting state, a non-selected row voltage of −5 V is applied to all the gate lines GL, and the non-selected row voltage of −5 V is applied to all the selecting lines SEL. Both the first switch circuit 22 and the second switch circuit 23 are set to a non-conducting state, and the internal node N1 is electrically separated from the source lines SL.

However, as described above, by a leakage current generated when the transistor T4 or the like connected to the internal node N1 is in an off state, the pixel voltage V20 of the internal node N1 moderately changes. Therefore, when an interval between frame periods in which the programming action is stopped becomes long, a display image is changed by a variation of the liquid crystal voltage Vlc. Before the change exceeds a visual tolerance limit, a reprogramming action needs to be performed. When the reprogramming action is to be performed to the same display image, the voltage value of the counter voltage Vcom is inverted between a high level (5 V) and a low level (0 V), and a voltage applied to the source line SL is inverted between the high level (5 V) and the low level (0 V) to make it possible to reprogram the same pixel data. This corresponds to an "external polarity inverting action" that is a polarity inverting action using a conventional external pixel memory.

In the above external polarity inverting action, as in the programming action, pixel data of one frame is programmed such that the pixel data is divided into horizontal periods the number of which is equal to the number of gate lines. For this reason, the source line SL of each column need to be changed for each up to one horizontal period, and a large power consumption is required. For this reason, in the present embodiment, in the always-on display mode, by a manner shown in the flow chart in FIG. 44, the self-polarity-inverting action and the programming action are executed in combination with each other to considerably reduce a power consumption.

First, a programming action of pixel data of one frame in always-on display mode is executed by the manner described in the fifth embodiment (step #11).

After the programming action in step #11, after a standby period corresponding to a predetermined number of frame periods has elapsed, a self-polarity-inverting action is executed in a lump to the pixel circuits 2 of one frame in the always-on display mode by the manner described in the third to fourth embodiments (step #12). As a result, while the standby period elapses, as shown in FIGS. 41 to 42, the pixel voltage V20 slightly varies, and, accordingly, the liquid crystal voltage Vlc in which a variation in voltage occurs is initialized, and the pixel voltage V20 returns to a voltage state obtained immediately after the programming action, and the liquid crystal voltage Vlc has the same absolute value as that of the voltage value obtained immediately after the programming action is performed and an inverted polarity of the voltage. Therefore, by the self-polarity-inverting action, the refresh action and the polarity inverting action of the liquid crystal voltage Vlc are simultaneously realized.

After the self-polarity-inverting action in step #12, while the standby period elapses, a request for a programming action (data writing) of new pixel data or an "external polarity inverting action" is received from the outside (YES in step #13), the control flow returns to step #11 to execute a programming action of the new pixel data or previous pixel data. While the standby period elapses, when the request is not received (NO in step #13), after the standby period has elapsed, the control flow returns to step #12 to execute the self-polarity-inverting action again. In this manner, each time the standby period has elapsed, the self-polarity-inverting action is repeatedly executed. For this reason, the refresh action and the polarity inverting action of the liquid crystal voltage Vlc are performed to make it possible to prevent a liquid crystal display element and image quality from being deteriorated.

Since the reason why a power consumption can be reduced by a self-polarity-inverting action and the reason why a self-polarity-inverting action and an external polarity inverting action are combined are the same as those in the case using a self-refresh action in the sixth embodiment, an explanation of the reasons will be omitted. In order to realize the flow of the present embodiment, as a matter of course, the type is limited to the type of the pixel circuit that can execute the self-polarity-inverting action.

In the pixel circuits (2B) of the second type, in order to realize the flow of the present embodiment, the auxiliary capacitive line CSL needs to be set to 0 V in step #11 to execute a programming action as described in the third and fourth embodiments.

Eighth Embodiment

In the eighth embodiment, a relationship between a self-refresh action, a self-polarity-inverting action, and a programming action in an always-on display mode will be described. As described in the sixth and seventh embodiments, a self-refresh action and a self-polarity-inverting action can advantageously reduce power consumptions, respectively. In the present embodiment, in the always-on display mode, by a manner shown in the flow chart in FIG. 45, the self-refresh action, the self-polarity-inverting action, and the programming action are executed in combination with each other to considerably reduce a power consumption.

A programming action of pixel data of one frame in the always-on display mode is executed by the manner described in the above fifth embodiment (step #21).

After the programming action in step #21, a self-refresh action is executed by the manner described in the above second embodiment (step #22).

Next, how many times the self-refresh action has been performed since the immediately previous programming action is detected. In other word, the number of frames of the self-refresh actions executed after the immediately previous programming action is performed is counted. When the count is equal to or smaller than the number of predetermined critical frames (NO in step #23), the control flow continuously returns to step #22 to execute a self-refresh action. On the other hand, when the count exceeds the number of critical frames (YES in step #23), a self-polarity-inverting action is executed by the manner described in the above third and fourth embodiments (step #24).

After the self-polarity-inverting action in step #24, when a request for a programming action (data writing) of new pixel data or an "external polarity inverting action" is received from the outside (YES in step #25), the control flow returns to step #21 to execute a programming action of the new pixel data or previous pixel data. On the other hand, when the request is not received (NO in step #25), the control flow returns to step #22 to execute the self-refresh action again. In this manner, the self-refresh action and the self-polarity-inverting action are repeatedly executed. For this reason, the refresh action and the polarity inverting action of the liquid crystal voltage Vlc are performed to make it possible to prevent a liquid crystal display element and image quality from being deteriorated.

Figure 44:
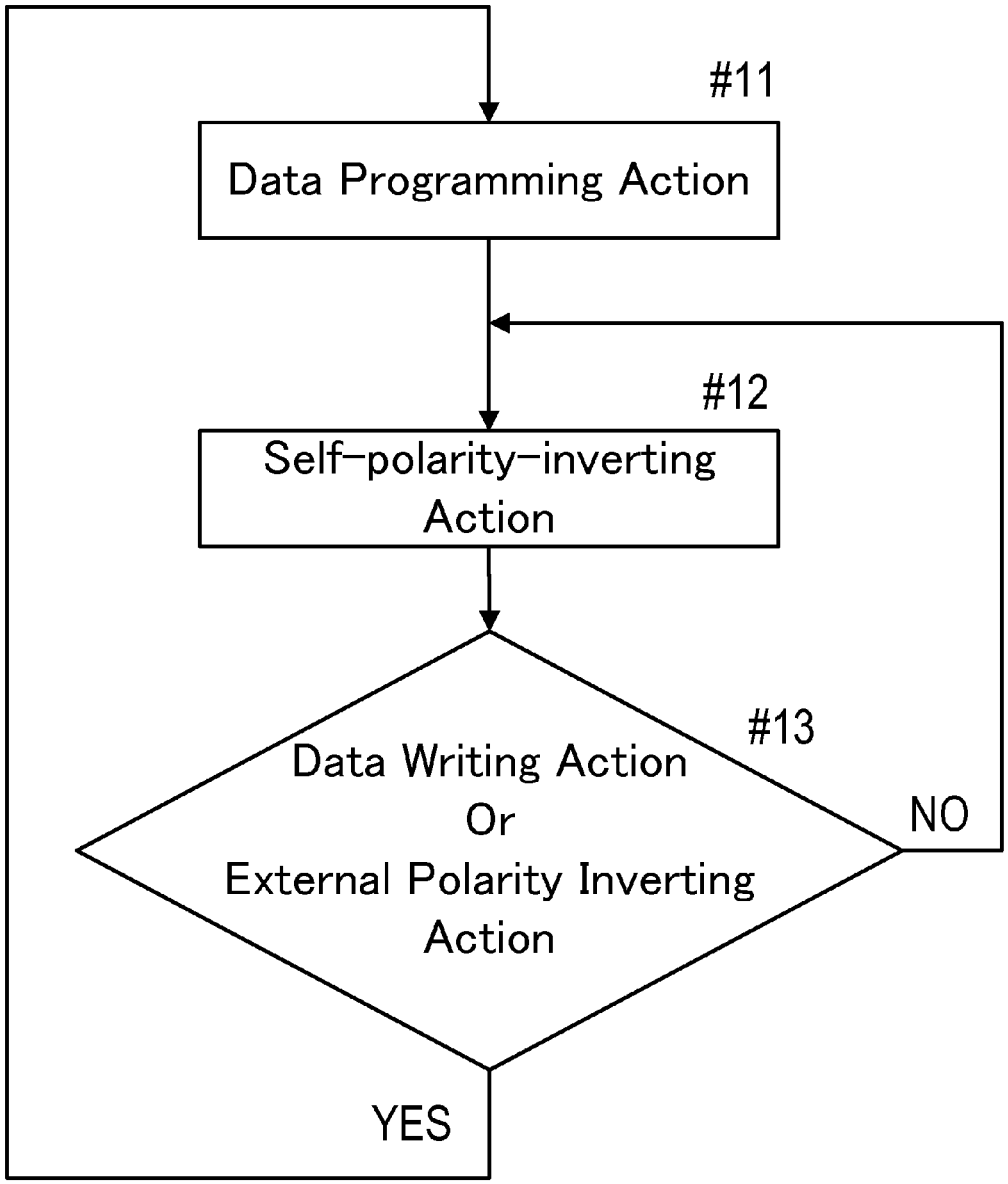
FIG. 44 is a flow chart showing procedures of the programming action and a self-polarity-inverting action in the always-on display mode.
Figure 45:
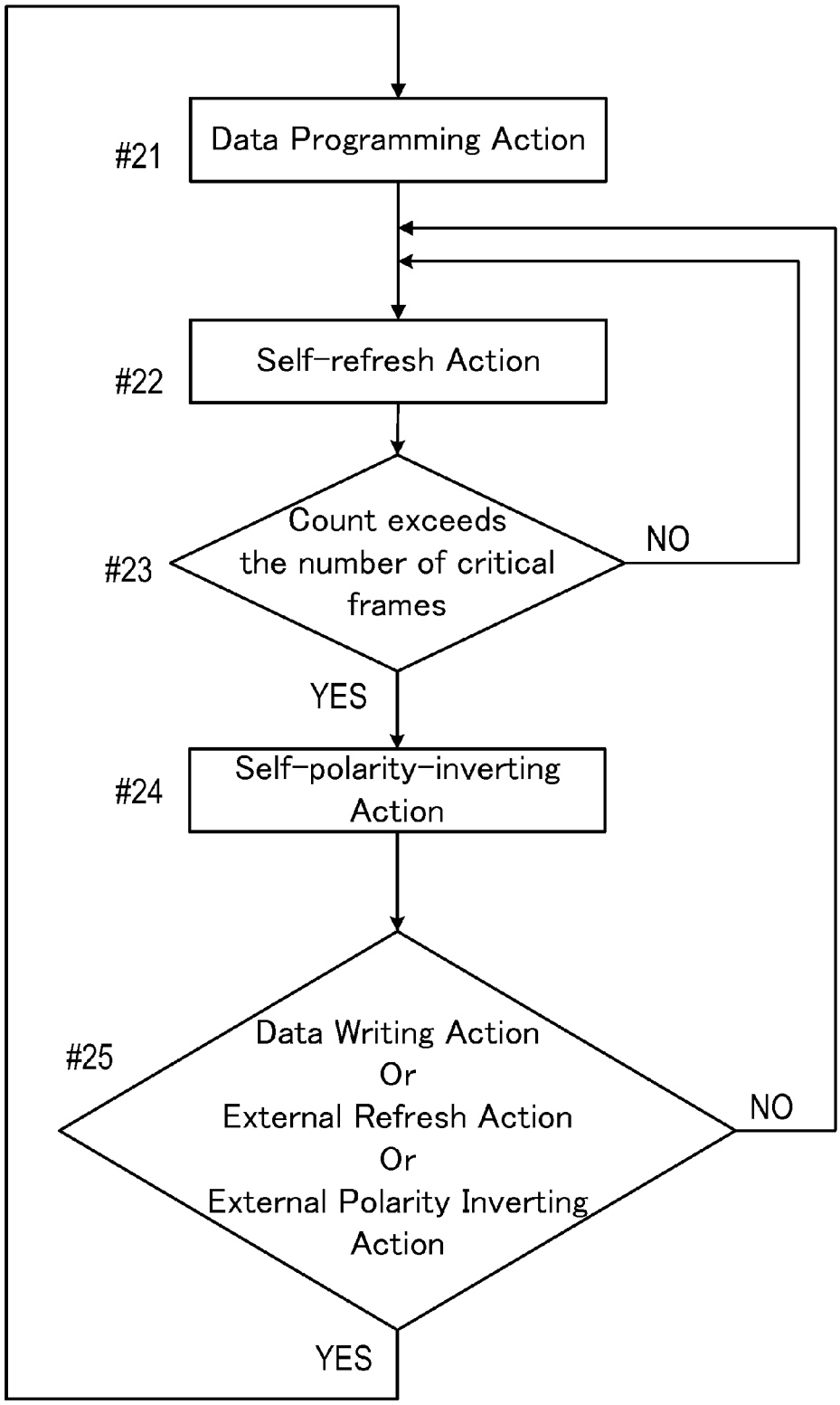
FIG. 45 is a flow chart showing procedures of the programming action, the self-refresh action, and the self-polarity-inverting action in the always-on display mode in combination with each other.

In place of the flow chart in FIG. 45, by arbitrarily combining the flow chart in FIG. 43 and the flow chart in FIG. 44 to each other, a configuration in which a self-refresh action and a self-polarity-inverting action are combined to each other may be used. In particular, in the pixel circuits (2B) of the second type, in order to realize the flow of the present embodiment, the auxiliary capacitive line CSL needs to be set to 5 V at the time of data programming (step #1) when a refresh action is performed, and the auxiliary capacitive line CSL needs to be set to 0 V at the time of data programming (step #11) when the self-polarity-inverting action is performed. In the pixel circuit described above, since the flow chart as shown in FIG. 45 cannot be executed, the flow chart in FIG. 43 and the flow chart in FIG. 44 are preferably executed in combination with each other.

Ninth Embodiment

In the ninth embodiment, a programming action in a normal display mode will be described for each type with reference to the accompanying drawings.

In the programming action in the normal display mode, pixel data of one frame is divided in units of display lines in a horizontal direction (row direction), and a multi-tone analog voltage corresponding to each pixel data of one display line is applied to the source lines SL of each column for each horizontal period, and a selected-row voltage of 8 V is applied to the gate line GL of a selected display line (selected row) to set the first switch circuits 22 of all the pixel circuits 2 of the selected row to a conducting state, and voltages of the source lines SL of the respective columns are transferred to the internal node N1 of each of the pixel circuits 2 of the selected row. A non-selected row voltage of −5 V is applied to the gate lines GL of display lines (non-selected rows) except for the selected display lines to set the first switch circuits 22 of all the pixel circuits 2 of the selected row to a non-conducting state.

Timing control of a voltage application of each signal line in a programming action (will be described later) is performed by the display control circuit 11, and each voltage application is performed by the display control circuit 11, the counter electrode drive circuit 12, the source driver 13, and the gate driver 14.

Figure 46:
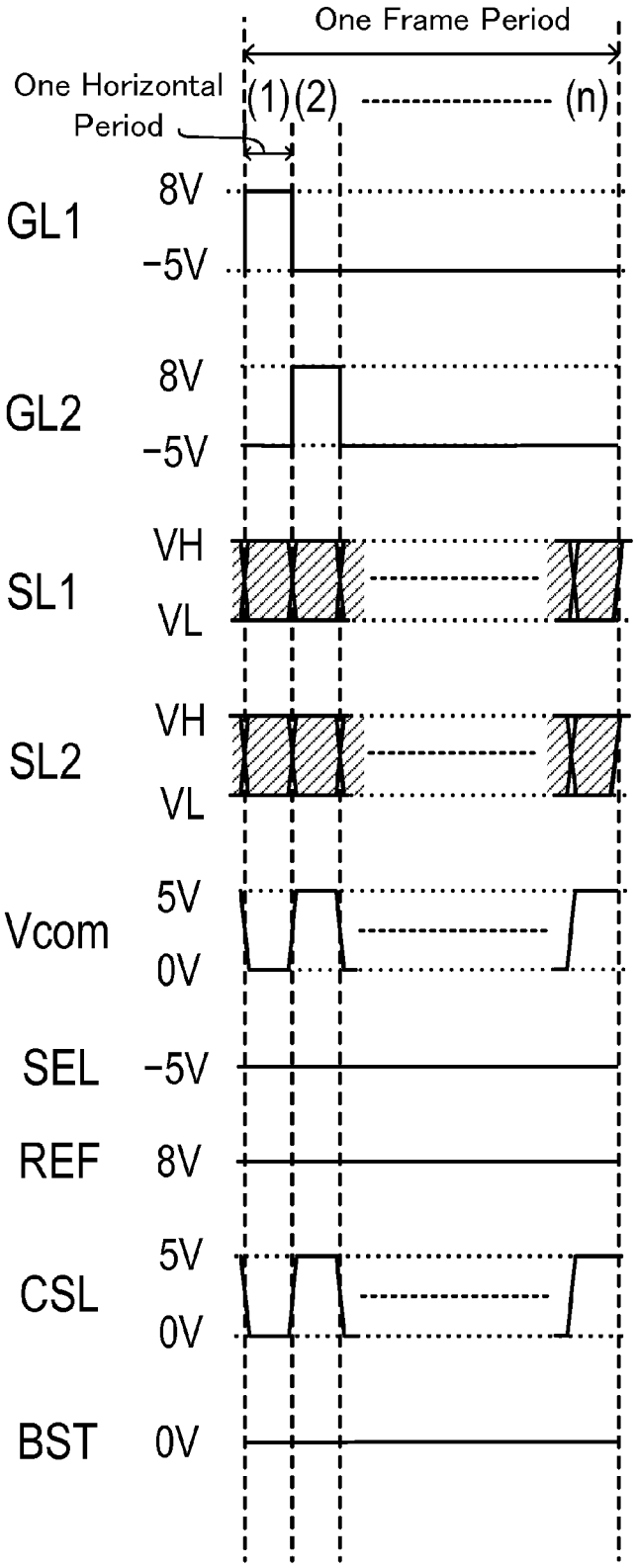
FIG. 46 is a timing chart of a programming action in a normal display mode performed by the pixel circuit of the first type.

FIG. 46 is a timing chart of a programming action using the pixel circuit 2A of the first type of group X. FIG. 46 shows voltage waveforms of two gate lines GL1 and GL2, two source lines SL1 and SL2, the selecting line SEL, the reference line REF, the auxiliary capacitive line CSL, and the boost line BST in a 1-frame period and a voltage waveform of the counter voltage Vcom.

A 1-frame period is divided into horizontal periods the number of which is the number of gate lines GL, and gate lines GL1 to GLn to be selected are sequentially allocated to the horizontal periods, respectively. FIG. 46 shows changes in voltage of the two gate lines GL1 and GL2 in the first two horizontal periods. In the first horizontal period, a selected-row voltage of 8 V is applied to the gate line GL1, and a non-selected row voltage of −5 V is applied to the gate line GL2. In the second horizontal period, the selected-row voltage of 8 V is applied to the gate line GL2, and the non-selected row voltage of −5 V is applied to the gate line GL1. In the subsequent horizontal periods, the non-selected row voltage of −5 V is applied to both the gate lines GL1 and GL2.

A multi-tone analog voltage corresponding to pixel data of a display line corresponding to each horizontal period is applied to the source lines SL of the respective columns. In the normal display mode, a multi-tone analog voltage corresponding to pixel data of an analog display line is applied, and the application voltage is not uniquely specified. For this reason, this is expressed by hatching the area in FIG. 46. In FIG. 46, the two source lines SL1 and SL2 are shown as typical source lines SL1, SL2, . . . SLm.

Since the counter voltage Vcom changes for each horizontal period (counter AC drive), the analog voltage has a voltage value corresponding to the counter voltage Vcom in the same horizontal period. More specifically, an analog voltage applied to the source line SL is set such that the voltage Vlc given by numerical expression 2 changes in only polarity without changing in absolute value depending on whether the counter voltage Vcom is 5 V or 0 V.

In the pixel circuits of the first and fourth types, since the first switch circuit 22 is configured by the only transistor T4, connection/disconnection control of the first switch circuit 22 is sufficiently performed by on/off-controlling only the transistor T4. Furthermore, the second switch circuit 23 need not be set to a conducting state in the programming action, and, in order to prevent the second switch circuit 23 from being set to a conducting state in the pixel circuit 2A of a non-selected row, in a 1-frame period, a non-selected voltage of −5 V is applied to the selecting line SEL connected to all the pixel circuits 2A. The non-selecting voltage is not limited to a negative voltage and may be 0 V.

In the 1-frame period, a voltage that always sets the transistor T2 in an on-state regardless of a voltage state of the internal node N1 is applied to the reference line REF. The voltage value need only be higher than a maximum value of voltage values given from the source line SL as multi-tone analog voltages by a threshold voltage of the transistor T2 or more. In FIG. 46, the maximum value is set to 5 V, and the threshold voltage is set to 2 V, and 8 V that is higher than the sum of the voltages is applied.

Since the counter AC drive is performed on the counter voltage Vcom for each horizontal period, the auxiliary capacitive line CSL is driven to have a voltage equal to the counter voltage Vcom. The pixel electrode 20 is capacitively coupled to the counter electrode 80 through a liquid crystal layer and also capacitively coupled to the auxiliary capacitive line CSL through the auxiliary capacitor element Cs. For this reason, when the voltage of the auxiliary capacitor element C2 on the auxiliary capacitive line CSL side is fixed, a change of the counter voltage Vcom is divided between the auxiliary capacitive line CSL and the auxiliary capacitor element C2 and appears at the pixel electrode 20, and the liquid crystal voltages Vlc of the pixel circuits 2 of non-selected row vary. Thus, when all the auxiliary capacitive lines CSL are driven at the same voltage as the counter voltage Vcom, the voltages of the counter electrode 80 and the pixel electrode 20 change in the same voltage direction, and the liquid crystal voltages Vlc of the pixel circuits 2 of the non-selected row can be suppressed from being varied.

As described in the fifth embodiment, for the same reason as that in the programming action in the always-on display mode, also in the pixel circuits of the second and third types, the programming action can be realized by the same voltage applying method as that in the first type. In the pixel circuits of the fourth to sixth types, as in the programming action in the always-on display mode, the selecting lines SEL may be independently controlled in units of rows, and the remaining programming action can be performed by the same voltage applying method as that in the first type. In the third and sixth types, an applied voltage to the voltage supply line VSL may be set to 0 V.

Furthermore, each pixel circuit (2*a* to 2*f*) of the group Y can realize a programming action by performing the same voltage application as that in each of the pixel circuits (2A to 2F) of the group X of the same type. Since this point can also be explained by the same reason as that in the programming action in the always-on display mode explained in the fifth embodiment, a detailed description thereof will be omitted.

In the programming action in the normal display mode, as a method of inverting the polarity of each display line for each horizontal period, in addition to the "counter AC drive", there is a method of applying a predetermined fixed voltage to the counter electrode 80 as the counter voltage Vcom. According to the method, a voltage applied to the pixel electrode 20 alternately changes into a positive voltage or a negative voltage every horizontal period with reference to the counter voltage Vcom.

In this case, there are a method of directly programming the pixel voltage through the source line SL and a method of adjusting a voltage to any one of a positive voltage and a negative voltage with reference to the counter voltage Vcom by capacitive coupling using the auxiliary capacitor element Cs after a voltage falling within a voltage range centered at the counter voltage Vcom is programmed. In this case, the auxiliary capacitive line CSL is not driven at the same voltage as the counter voltage Vcom, and independently pulse-driven in units of rows.

In the embodiment, in the programming action in the normal display mode, a method of inverting the polarity of each display line for each horizontal line is employed. However, the method is employed to cancel a disadvantage (will be described below) occurring when polarity inversion is performed in units of frames. As the method of canceling the disadvantage, there are a method of performing polarity inversion drive for each column and a method of performing polarity inversion drive in units of pixels in row and column directions at the same time.

It is assumed that the positive polarity liquid crystal voltage Vlc is applied in all pixels in a certain frame F1 and the negative polarity liquid crystal voltage Vlc is applied in all the pixels in the next frame F2. Even though the voltages having the same absolute value are applied to the liquid crystal layer 75, a slight difference may occur in light transmittance depending on the positive polarity or the negative polarity. When a high-quality still image is displayed, the presence of the slight difference may possibly cause small changes in display manners in the frame F1 and the frame F2. Even in a moving image display state, in a display area in which the same display contents should be displayed in the frames, the display manners may be possibly slightly changed. In display of a high-quality still image or moving image, it can be assumed that even the slight change can be visually recognized.

Since the normal display mode is a mode of displaying a high-quality still image or moving image, the above slight change may be possibly visually recognized. In order to avoid the phenomenon, in the present embodiment, the polarity is inverted for each display line in the same frame. In this manner, since the liquid crystal voltages Vlc having polarities different between display lines are applied in the same frame, an influence on display image data based on the polarity of the liquid crystal voltage Vlc can be suppressed.

Another Embodiment

Another embodiment will be described below.

<1> With respect to the pixel circuits 2A to 2F of the group X, in programming actions in the normal display mode and the always-on display mode, a low-level voltage may be given to the reference line REF to set the transistor T2 to an off state. In this manner, when the internal node N1 and the output node N2 are electrically separated from each other, the potential of the pixel electrode 20 is not influenced by the voltage of the output node N2 obtained before the programming action. In this manner, the voltage of the pixel electrode 20 correctly reflects an application voltage to the source line SL, and the image data can be displayed without an error.

As described above, a total parasitic capacitance of the node N1 is considerably larger than that of the node N2, and the potential of the node N2 in the initial state rarely influences the potential of the pixel electrode 20. For this reason, the transistor T2 may preferably always be set to an on-state.

<2> The above embodiment explains the case in which the self-polarity-inverting action is performed to all the pixel circuits in units of frames. However, for example, 1 frame is divided into a plurality of row groups each including a predetermined number of rows, and the self-polarity-inverting action may be executed in units of the row groups. For example, execution of the self-polarity-inverting action to pixel circuits of even-numbered rows and execution of the next self-polarity-inverting action to odd-numbered rows may be sequentially repeated. In this manner, when the self-polarity-inverting action is performed such that the even-numbered rows and the odd-numbered rows are separated from each other, even though a small display error occurs due to the self-polarity-inverting action, the small error is diffused in units of the even-numbered rows or the odd-numbered rows to make it possible to further reduce an influence on a display image. Similarly, one frame is divided into a plurality of column groups each including a predetermined number of columns, and self-polarity-inverting actions can be executed in units of the column groups.

<3> In the above embodiments, the second switch circuits 23 and the control circuits 24 are arranged in each of all the pixel circuits 2 arranged on the active matrix substrate 10. In contrast to this, on the active matrix substrate 10, when pixel units of two types, i.e., a transmissive pixel unit that performs a transmissive liquid crystal display and a reflective pixel unit that performs a reflective liquid crystal display are provided, only pixel circuits of the reflective pixel unit may include the second switch circuits 23 and the control circuits 24, and pixel circuits of the transmissive display unit may not include the second switch circuits 23 and the control circuits 24.

In this case, an image display is performed by the transmissive pixel unit in the normal display mode, and an image display is performed by the reflective pixel unit in the always-on display mode. With the above configuration, the number of elements formed on the entire area of the active matrix substrate 10 can be reduced.

<4> In the above embodiments, each of the pixel circuits 2 includes the auxiliary capacitor element Cs. However, the pixel circuit 2 need not include the auxiliary capacitor element Cs. However, in order to more stabilize the potential of the internal node N1 to reliably stabilize a display image, the auxiliary capacitor element Cs is preferably included.

Figure 47:
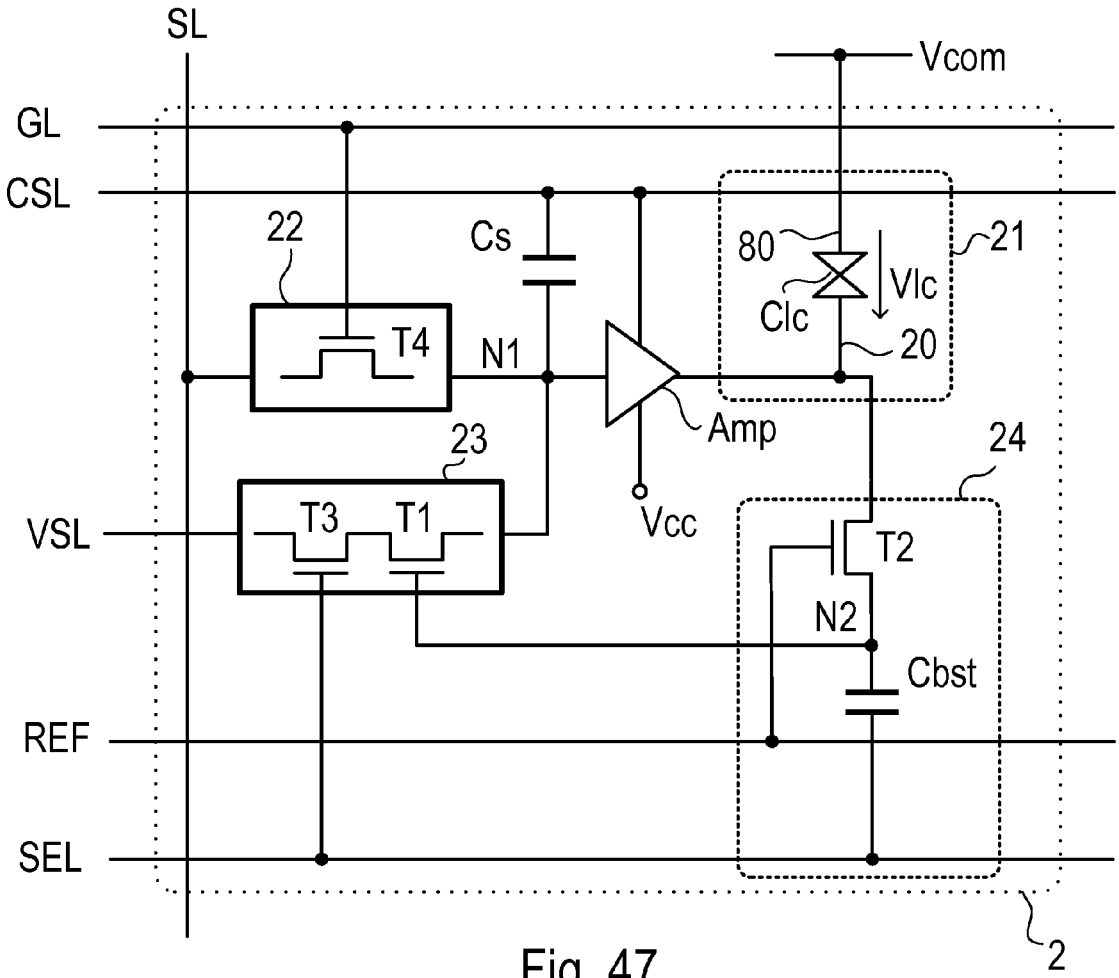
FIG. 47 is a circuit diagram showing still another basic circuit configuration of the pixel circuit of the present invention.

<5> In the above embodiments, it is assumed that the display element unit 21 of each of the pixel circuits 2 is configured by only the unit liquid crystal display element Clc. However, as shown in FIG. 47, an analog amplifier Amp (voltage amplifier) may be arranged between the internal node N1 and the pixel electrode 20. In FIG. 47, as an example, as a power supply line for the analog amplifier Amp, the auxiliary capacitive line CSL and a power supply line Vcc are used.

In this case, a voltage given to the internal node N1 is amplified by a gain η set by the analog amplifier Amp, and the amplified voltage is supplied to the pixel electrode 20. Thus, in the configuration, a small voltage change at the internal node N1 can be reflected on a display image.

In this configuration, in the self-polarity-inverting action in the always-on display mode, the voltage of the internal node N1 is amplified by the gain η and supplied to the pixel electrode 20. For this reason, a voltage difference between the first and second voltage states applied to the source line SL is adjusted to make it possible to make the voltages in the first and second voltage states supplied to the pixel electrode 20 equal to the high-level and low-level voltages of the counter voltage Vcom.

<6> In the above embodiments, it is assumed that the transistors T1 to T4 in the pixel circuit 2 are n-channel polycrystalline silicon TFTs. However, a configuration using p-channel TFTs or a configuration using amorphous silicon TFTs can also be used. Also in a display device having a configuration using p-channel TFTs, by inverting the polarities of a power supply voltage and a voltage value shown as the above described action condition, by reversing application voltages in the case A and the case B, by replacing the first voltage state (5 V) and the second voltage state (0 V) with the first voltage state (0 V) and the second voltage state (5 V), respectively in a programming action in an always-on display mode, and the like, the pixel circuits 2 can be operated by the same manner as that in each of the above embodiments, and the same effect as that in the embodiment can be obtained.

<7> In the above embodiments, as the voltage values in the first and second voltage states of the pixel voltage V20 and the counter voltage Vcom in the always-on display mode, 0 V and 5 V are supposed, and, accordingly, voltage values applied to the signal lines are set to −5 V, 0 V, 5 V, 8V and 10V, respectively. However, the voltage values can be arbitrarily set depending on the characteristics (threshold voltages or the like) of liquid crystal elements and transistor elements to be used.

<8> In the above embodiments, the liquid crystal display device is exemplified. However, the present invention is not limited to the embodiments. The present invention can be applied to any display device that has a capacitance corresponding to the pixel capacitance Cp to hold pixel data and displays an image based on a voltage held in the capacitance.

Figure 48:
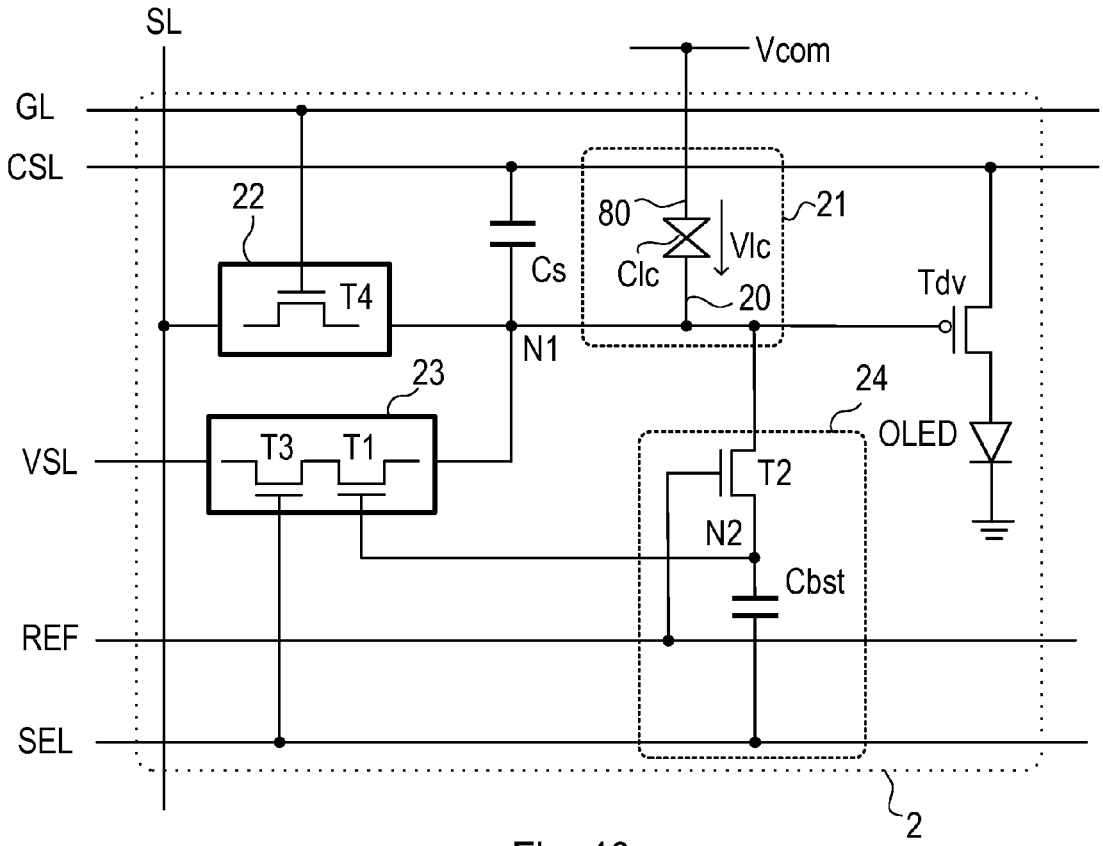
FIG. 48 is a circuit diagram showing still another basic circuit configuration of the pixel circuit of the present invention.

For example, in an organic EL (Electroluminescence) display device in which a voltage corresponding to pixel data is held in a capacitance corresponding to a pixel capacitance to display an image, the present invention can be especially applied to a self-refresh action. FIG. 48 is a circuit diagram showing an example of a pixel circuit of the organic EL display device. In the pixel circuit, a voltage held in the auxiliary capacitance Cs as pixel data is given to a gate terminal of a drive transistor Tdv configured by a TFT, and a current corresponding to the voltage flows in a light-emitting element OLED through the drive transistor Tdv. Thus, the auxiliary capacitance Cs corresponds to the pixel capacitance Cp in each of the above embodiments.

In the pixel circuit shown in FIG. 48, unlike in a liquid crystal display device in which a voltage is applied across electrodes to control a light transmittance to display an image, an element itself emits light by a current flowing in the element to display an image. For this reason, because of the rectification of the light-emitting element, the polarity of a voltage applied across both the terminals of the element cannot be inverted, and need not be inverted. For this reason, in the pixel circuit shown in FIG. 48, the self-polarity-inverting action described in the third and fourth embodiments cannot be performed.

EXPLANATION OF REFERENCES

1: Liquid crystal display device
2: Pixel circuit

2A, 2B, 2C, 2D, 2E, 2F: Pixel circuit
2*a*, 2*b*, 2*c*, 2*d*, 2*e*, 2*f*: Pixel circuit
10: Active matrix substrate
11: Display control circuit
12: Counter electrode drive circuit
13: Source driver
14: Gate driver
20: Pixel electrode
21: Display element unit
22: First switch circuit
23: Second switch circuit
24: Control circuit
74: Seal member
75: Liquid crystal layer
80: Counter electrode
81: Counter substrate
Amp: Analog amplifier
BST: Boost line
Cbst: Boost capacitor element
Clc: Liquid crystal display element
CML: Counter electrode wire
CSL: Auxiliary capacitive line
Cs: Auxiliary capacitor element
Ct: Timing signal
DA: Digital image signal
Dv: Data signal
GL (GL1, GL2, . . . , GLn): Gate line
Gtc: Scanning-side timing control signal
N1: Internal note
N2: Output node
OLED: Light emitting element
P1, P2: Phase
P10, P11, . . . , P18: Phase
P20, P21, . . . , P27: Phase
REF: Reference line
Sc1, Sc2, . . . , Scm: Source signal
SEL: Selecting line
SL (SL1, SL2, . . . , SLm): Source line
Stc: Data-side timing control signal
T1, T2, T3, T4, T5: Transistor
Tdv: Drive transistor
V20: Pixel electrode potential, internal node potential
Vcom: Counter voltage
Vlc: Liquid crystal voltage
VN2: Output node potential

The invention claimed is:

1. A pixel circuit comprising:

a display element unit including a unit display element;

an internal node that configures as part of the display element unit and holds a voltage of pixel data applied to the display element unit;

a first switch circuit that transfers the voltage of the pixel data supplied from a data signal line to the internal node through at least a predetermined switch element;

a second switch circuit that transfers a voltage supplied to a predetermined voltage supply line to the internal node without passing through the predetermined switch element; and a control circuit that holds a predetermined voltage depending on the voltage of the pixel data held by the internal node at one terminal of a first capacitor element and controls connection/disconnection of the second switch circuit, wherein the second switch circuit includes a first transistor element and a third transistor element, the control circuit includes a second transistor element, and each of the first to third transistor elements has a first terminal, a second terminal, and a control terminal that controls an electrical connection between the first and second terminals, the second switch circuit is configured by a series circuit of the first transistor element and the third transistor element, the control circuit is configured by a series circuit of the second transistor element and the first capacitor element, one terminal of the first switch circuit is connected to the data signal line, one terminal of the second switch circuit is connected to the voltage supply line, the other terminals of the first and second switch circuits and the first terminal of the second transistor element are connected to the internal node, the control terminal of the first transistor element, the second terminal of the second transistor element, and the one terminal of the first capacitor element are connected to each other, the control terminal of the second transistor element is connected to a first control line, the control terminal of the third transistor element is connected to a second control line, and the other terminal of the first capacitor element is connected to the second control line or a third control line.

2. The pixel circuit according to claim 1, wherein the first control line also serves as the voltage supply line.

3. The pixel circuit according to claim 1, further comprising a second capacitor element having one terminal connected to the internal node and having the other terminal connected a fourth control line or a predetermined fixed voltage line.

4. The pixel circuit according to claim 1, further comprising a second capacitor element having one terminal connected to the internal node and having the other terminal connected a fourth control line, wherein the fourth control line also serves as the voltage supply line.

5. The pixel circuit according to claim 1, wherein the predetermined switch element is configured by a fourth transistor element having a first terminal, a second terminal, and a control terminal that controls an electrical connection between the first and second terminals, and the control terminal of the fourth transistor element is connected to a scanning signal line.

6. The pixel circuit according to claim 5, wherein the first switch circuit does not include a switch element except for the predetermined switch element.

7. The pixel circuit according to claim 5, wherein the first switch circuit is configured by a series circuit of the third transistor element in the second switch circuit and the predetermined switch element or a series circuit of a fifth transistor having a control terminal connected to the control terminal of the third transistor element in the second switch circuit and the predetermined switch element.

8. A display device comprising a pixel circuit array configured by arranging a plurality of pixel circuits according to claim 1 in a row direction and a column direction, wherein the data signal line is arranged for each of the columns one by one, the pixel circuits arranged along the same column have the one terminals of the first switch circuits connected to a common data signal line, the pixel circuits arranged along the same row or the same column have the control terminals of the second transistor elements connected to a common first control line, the pixel circuits arranged along the same row or the same column have the control terminals of the third transistor elements connected to a common second control line, the pixel circuits arranged along the same row or the same column have the other terminals of the first capacitor elements connected to the common second control line or a common third control line, a data signal line drive circuit that independently drives the data signal lines and a control line drive circuit that independently drives the first and second control lines are provided, in a case where the first control line serves as the voltage supply line or in a case where the voltage supply line is an independent wire, the control line drive circuit drives the power supply line, and in a case where the other terminal of the first capacitor element is connected to the third control line, the control line drive circuit drives the third control line.

9. The display device according to claim 8, wherein in a case where the power supply line is an independent wire, in the pixel circuits arranged along the same row or the same column, the one terminals of the second switch circuits are connected to a common voltage supply line.

10. The display device according to claim 8, wherein the first switch circuit does not include a switch element except for the predetermined switch element, the predetermined switch element is a fourth transistor element having a first terminal, a second terminal, and a control terminal that controls an electrical connection between the first and second terminals, the first terminal, the second terminal, and the control terminal are connected to the internal node, the data signal line, and a scanning signal line, respectively, the scanning signal line is arranged for each of the rows one by one, and the pixel circuits arranged along the same row are connected to a common scanning signal line, and a scanning signal line drive circuit that independently drives the scanning signal lines is provided.

11. The display device according to claim 8, wherein the predetermined switch element is configured by a fourth transistor element having a first terminal, a second terminal, and a control terminal that controls an electrical connection between the first and second terminals, the first switch circuit is configured by a series circuit of the third transistor element in the second switch circuit and the fourth transistor element or a series circuit of a fifth transistor having a control terminal connected to the control terminal of the third transistor element in the second switch circuit and the fourth transistor element, one scanning signal line and one second control line are arranged for each of the rows, the control terminal of the fourth transistor element is connected to the scanning signal line, the pixel circuits arranged along the same row are connected to a common scanning signal line and the common second control line, and the scanning signal drive circuit that independently drives the scanning signal lines is provided.

12. The display device according to claim 10, wherein in a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, and the data signal line drive circuit applies data voltages corresponding to pixel data to be programmed in the pixel circuits of the columns of the selected row to the data signal lines, respectively.

13. The display device according to claim 2, wherein in the programming action, the control line drive circuit applies a predetermined voltage to the second control line to set the third transistor element to a non-conducting state.

14. The display device according to claim 12, wherein in the programming action, the control line drive circuit applies a predetermined voltage to the first control line to set the second transistor element to a conducting state.

15. The display device according to claim 12, wherein in the programming action, the control line drive circuit applies a predetermined voltage to the first control line to set the second transistor element to a conducting state regardless of a voltage state of the internal node, and applies a predetermined voltage to the voltage supply line to set the first transistor element to a non-conducting state and set the second switch circuit to a non-conducting state.

16. The display device according to claim 11, wherein in a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, the control line drive circuit applies a predetermined selecting voltage to the second control line of the selected row to set the third transistor element to a conducting state and applies a predetermined non-selecting voltage to the second control line of the non-selected row to set the third transistor element to a non-conducting state, and the data signal line drive circuit independently applies data voltages corresponding to the pixel data to be programmed in the pixel circuits of the columns of the selected row to the data signal lines, respectively.

17. The display device according to claim 16, wherein in the programming action, the control line drive circuit applies a predetermined voltage to the first control line to set the second transistor element to a conducting state.

18. The display device according to claim 11, wherein in a case where the power supply line is an independent wire, in a programming action to independently program the pixel data in the pixel circuits arranged along one selected row, the scanning signal line drive circuit applies a predetermined selected row voltage to the scanning signal line of the selected row to set the fourth transistor elements arranged along the selected row to a conducting state and applies a predetermined non-selected row voltage to the scanning signal line of a non-selected row to set the fourth transistor elements arranged along the non-selected row to a non-conducting state, the control line drive circuit applies a predetermined selecting voltage to the second control line of the selected row to set the third transistor element to a conducting state, applies a predetermined voltage to the first control line to set the second transistor element to a conducting state regardless of a voltage state of the internal node, and applies a predetermined voltage to the voltage supply line to set the first transistor element to a non-conducting state and set the second switch circuit to a non-conducting state, and the data signal line drive circuit independently applies data voltages corresponding to the pixel data to be programmed in the pixel circuits of the columns of the selected row to the data signal lines, respectively.

19. The display device according to claim 10, wherein in a self-refresh action to operate the second switch circuits and the control circuits to simultaneously compensate for variations in voltage of the internal nodes in the plurality of pixel circuits, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line so that when a voltage state of binary pixel data held by the internal node is a first voltage state, a current flowing from one terminal of the first capacitor element to the internal node is blocked by the second transistor element, and when the voltage state is a second voltage state, the second transistor element is set to a conducting state, applies a predetermined voltage to the second control line to set the third transistor element to a conducting state, applies a voltage pulse having a predetermined voltage amplitude to the second control line or the third control line connected to the other terminal of the first capacitor element to give a change in voltage by a capacitive coupling through the first capacitor element to the one terminal of the first capacitor element, so that when the voltage of the internal node is in the first voltage state, the change in voltage is not suppressed and the first transistor element is set to a conducting state, and when the voltage of the internal node is in the second voltage state, the change in voltage is suppressed and the first transistor element is set to a non-conducting state, and supplies a voltage of the pixel data in the first voltage state to all the voltage supply lines connected to the plurality of pixel circuits targeted by the self-refresh action.

20. The display device according to claim 19, wherein in a standby state immediately after the self-refresh action is ended, the control line drive circuit applies a predetermined voltage to the second control line to set the third transistor element to a non-conducting state, and ends the application of the voltage pulse.

21. The display device according to claim 20, wherein in the standby state, the control line drive circuit applies a voltage in the second voltage state to the data signal line.

22. The display device according to claim 20, wherein the self-refresh action is repeated with the standby state interposed between the self-refresh action and the subsequent self-refresh action, and the standby state is not less than 10 times a period of the self-refresh action.

23. The display device according to claim 19, wherein in a case where the first switch circuit has a configuration that does not include a switch element except for the fourth transistor element, the plurality of pixel circuits targeted by the self-refresh action are divided into a plurality of sections each of which consists of one or more columns, at least the second control line and the second control line or the third control line connected to the other terminal of the first capacitor element are arranged so as to be driven in units of the sections, and the control line drive circuit, with respect to a section that is not targeted by the self-refresh action, applies a predetermined voltage to the second control line to set the third transistor element to a non-conducting state or does not apply the voltage pulse to the second control line or the third control line connected to the other terminal of the first capacitor element, and sequentially switches the sections targeted by the self-refresh action to separately execute the self-refresh action for each of the sections.

24. The display device according to claim 10, wherein the pixel circuit has a configuration in which the first switch circuit does not include a switch element except for the fourth transistor element and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting operation performed before the self-polarity-inverting action is started, the scanning signal line drive circuit applies a predetermined voltage to the scanning signal lines connected to all the pixel circuits in the pixel circuit array to set the fourth transistor to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state or applies a predetermined voltage to the voltage supply line to set the first transistor element to a non-conducting state and sets the second switch circuit to a non-conducting state, and applies a predetermined initial voltage to the third control line connected to the other terminal of the first capacitor element, after the initial state setting operation, the control line drive circuit applies a voltage pulse having a predetermined voltage amplitude to the third control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and, when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between the two voltage states after the second transistor element is set to a non-conducting state until the scanning signal line drive circuit ends application of the voltage pulse, the control line drive circuit applies a predetermined voltage to the second control line to set the third transistor element to a conducting state for at least a predetermined period after the scanning signal line drive circuit ends application of the voltage pulse and, thereafter, stops pulse application to the third control line connected to the other terminal of the first capacitor element, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

25. The display device according to claim 24, wherein in a case where the first control line also serves as the voltage supply line, after the initial state setting action, the control line drive circuit applies a voltage in the second voltage state to the first control line as the predetermined voltage to set the second transistor element to a non-conducting state regardless of a voltage state of the internal node.

26. The display device according to claim 24, wherein the pixel circuit includes a second capacitor element having one terminal connected to the internal node and the other terminal connected to a fourth control line, in a case where the fourth control line also serves as the voltage supply line, the control line drive circuit continuously applies the voltage in the second voltage state to the fourth control line for a period of the self-polarity-inverting action.

27. The display device according to claim 10, wherein the pixel circuit has a configuration in which the power supply line is an independent wire without serving as the first to third control lines, the first switch circuit does not include a switch element except for the fourth transistor element, and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state and sets the second switch circuit to a non-conducting state, and applies a predetermined initial voltage to the third control line, after the initial state setting action, the control line drive circuit applies a voltage pulse having a predetermined voltage amplitude to the second control line and the third control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and sets the third transistor element to a conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit stops the voltage pulse application to the second control line and the third control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the voltage pulse to the second control line to set the third transistor element to a conducting state.

28. The display device according to claim 10, wherein the pixel circuit has a configuration in which the power supply line is an independent wire without serving as the first and second control lines, the first switch circuit does not include a switch element except for the fourth transistor element, and the other terminal of the first capacitor element is connected to the second control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the second control line and the voltage supply line, after the initial state setting action, the control line drive circuit applies a voltage pulse having a predetermined voltage amplitude to the second control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit stops the voltage pulse application to the second control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

29. The display device according to claim 11, wherein the pixel circuit has a configuration in which the power supply line is an independent wire without serving as the first to third control lines, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line and the voltage supply line, after the initial state setting action, the control line drive circuit applies a voltage pulse having a predetermined voltage amplitude to the third control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set in a non-conducting state until the scanning signal line drive circuit ends application of the voltage pulse, the control line drive circuit applies a predetermined voltage to the second control line to set the third transistor element to a conducting state for at least a predetermined period from the voltage pulse application of the scanning signal line drive circuit to the end of the voltage pulse application, thereafter, and stops the pulse application to the third control line connected to the other terminal of the first capacitor element, and the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal line drive circuit and a voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

30. The display device according to claim 11, wherein the pixel circuit has a configuration in which the power supply line is an independent wire without serving as the first to third control lines, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line and the voltage supply line, after the initial state setting action, the control line drive circuit applies a voltage pulse having a predetermined voltage amplitude to the second control line and the third control line to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit ends the voltage pulse application to the second control line and the third control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal line drive circuit and the voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the voltage pulse application to the second control line and the third control line.

31. The display device according to claim 11, wherein the pixel circuit has a configuration in which the power supply line is an independent wire without serving as the first and second control lines, the first switch circuit is configured by a series circuit of the third transistor element and the fourth transistor element or a series circuit of a fifth transistor having a control terminal connected to the control terminal of the third transistor element in the second switch circuit and the fourth transistor element, and the other terminal of the first capacitor element is connected to the second control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, characterized by executing a series of operations:

in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, and applies a predetermined voltage to the second control line to set the third transistor element to a non-conducting state, or applies a predetermined voltage to the voltage supply line to set the first transistor element to a non-conducting state, and sets the second switch circuit to a non-conducting state, and after the initial state setting action, the control line drive circuit applies a voltage pulse having a predetermined voltage amplitude to the second control line connected to the other terminal of the first capacitor element to give a change in voltage by a capacitive coupling through the first capacitor element to one terminal of the first capacitor element, so that when a voltage of the internal node is in the first voltage state, since the second transistor element is set to a non-conducting state, the change in voltage is not suppressed and the first transistor element is set to a conducting state, and when the voltage of the internal node is in the second voltage state, since the second transistor element is set to a conducting state, the change in voltage is suppressed and the first transistor element is set to a non-conducting state, and, thereafter, applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, thereafter, returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit ends the voltage pulse application to the second control line at least after a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and while the voltage pulse is applied by the scanning signal line drive circuit and the voltage in the first voltage state is applied to the data signal line, the control line drive circuit applies the voltage in the first voltage state to all the voltage supply lines connected to the plurality of pixel circuits targeted by the self-polarity-inverting action, and thereafter applies a voltage in the second voltage state to all the voltage supply lines connected to the plurality of pixel circuits targeted by the self-polarity-inverting action for at least a partial period immediately before the control line drive circuit ends the voltage pulse application to the second control line.

32. The display device according to claim 10, wherein the pixel circuit has a configuration in which the first switch circuit does not include a switch element except for the fourth transistor element and the other terminal of the first capacitor element is connected to the third control line, the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element in a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, so that in the case where a voltage at a first or second terminals of the first transistor element is set in the second voltage state, when the internal node is in the first voltage state, the first transistor element is set to a conducting state, and when the internal node is in the second voltage state, the first transistor element is set to a non-conducting state, depending on the voltage difference at the one terminal of the first capacitor element, applies a predetermined voltage to the second control line to set the third transistor element to a non-conducting state or, in the case where the voltage supply line is an independent wire, applies a predetermined voltage to the voltage supply line to set the first transistor element to a non-conducting state, and sets the second switch circuit to a non-conducting state, and applies a predetermined initial voltage to the third control line connected to the other terminal of the first capacitor element, after the initial state setting action, the control line drive circuit applies a predetermined voltage to the first control line to set the second transistor element to a non-conducting state regardless of whether the internal node is in the first voltage state or the second voltage state, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, and thereafter returns the fourth transistor element to a non-conducting state, the counter electrode voltage supply circuit changes a voltage applied to the counter electrode between two voltage states after the second transistor element is set to a non-conducting state until the scanning signal line drive circuit ends the application of the voltage pulse, the control line drive circuit applies a predetermined voltage to the second control line to set the third transistor element to a conducting state for at least a predetermined period after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

33. The display device according to claim 11, wherein the pixel circuit has a configuration in which the power supply line is an independent wire without serving as the first to third control lines, the other terminal of the first capacitor element is connected to the third control line, and the first switch circuit is configured by a series circuit of the third transistor element and the fourth transistor element or a series circuit of a fifth transistor having a control terminal connected to the control terminal of the third transistor element in the second switch circuit and the fourth transistor element, and the unit display element is configured by a liquid crystal display element including a pixel electrode, a counter electrode, and a liquid crystal layer interposed between the pixel electrode and the counter electrode, in the display element unit, the internal node is connected to the pixel electrode directly or through a voltage amplifier, and a counter electrode voltage supply circuit that supplies a voltage to the counter electrode is provided, in a self-polarity-inverting action to operate the first switch circuit, the second switch circuit, and the control circuit to invert a polarity of a voltage applied across the pixel electrode and the counter electrode, the self-polarity-inverting action being simultaneously executed for the plurality of pixel circuits, as an initial state setting action performed before the self-polarity-inverting action is started, the scanning signal line drive circuit applies a predetermined voltage to the scanning signal lines connected to all the pixel circuits in the pixel circuit array to set the fourth transistor element to a non-conducting state, the control line drive circuit applies a predetermined voltage to the first control line to generate a voltage difference at one terminal of the first capacitor element depending on whether a voltage state of binary pixel data held by the internal node is in a first voltage state or a second voltage state, applies a predetermined voltage to the second control line to set the third transistor element to a non-conducting state, or applies a predetermined voltage to the voltage supply line to set the first transistor element to a non-conducting state, and sets the second switch circuit to a non-conducting state, and applies a predetermined initial voltage to the third control line connected to the other terminal of the first capacitor element, after the initial state setting action, the control line drive circuit applies a predetermined voltage to the first control line to set the second transistor element to a non-conducting state regardless of a voltage state of the internal node, thereafter, the scanning signal line drive circuit applies a voltage pulse having a predetermined voltage amplitude to all the scanning signal lines connected to the plurality of pixel circuits targeted by the self-polarity-inverting action to temporarily set the fourth transistor element to a conducting state, and thereafter returns the fourth transistor element to a non-conducting state, the counter electrode voltage supply circuit changes the voltage applied to the counter electrode between two voltage states after the second transistor element is set to a non-conducting state until the scanning signal line drive circuit ends application of the voltage pulse, the control line drive circuit applies a predetermined voltage to the second control line to set the third transistor element to a conducting state for at least a period from when the scanning signal line drive circuit applies the voltage pulse to when a predetermined period has elapsed after the scanning signal line drive circuit ends the application of the voltage pulse, the data signal line drive circuit applies a voltage in the first voltage state to all the data signal lines connected to the plurality of pixel circuits targeted by the self-polarity-inverting action at least while the scanning signal line drive circuit applies the voltage pulse, and the control line drive circuit applies a voltage in the second voltage state to all the voltage supply lines connected to the plurality of pixel circuits targeted by the self-polarity-inverting action for at least a partial period immediately before the control line drive circuit ends the application of the predetermined voltage to the second control line to set the third transistor element to a conducting state.

34. The display device according to claim 24, wherein in a case where the pixel circuit includes a second capacitor element having one terminal connected to the internal node and the other terminal connected to a fixed voltage line, after the scanning signal line drive circuit ends application of the voltage pulse, a variation in voltage of the internal node caused when the application of the voltage pulse is ended is compensated for by adjusting a voltage of the fixed voltage line.

* * * * *